US012674308B2

(12) United States Patent
Le et al.

(10) Patent No.: US 12,674,308 B2
(45) Date of Patent: Jul. 7, 2026

(54) CISTERN SYSTEM, APPARATUS AND METHOD

(71) Applicant: FLUIDMASTER, INC., San Juan Capistrano, CA (US)

(72) Inventors: Tuan Van Le, Fountain Valley, CA (US); Joseph U. Han, Irvine, CA (US); Leland Wong, Costa Mesa, CA (US); Gabriel Wong, Irvine, CA (US); Jack Nguyen, San Clemente, CA (US); Daniel McAuley, Irvine, CA (US); Matjaž Smerdel, Pivka (SI); Henk Garst, Arnhem (NL); Gregor Deurič, Postojna (SI); Bart van der Velden, Arnhem (NL); Andrej Kobal, Ljubljana (SI)

(73) Assignee: FLUIDMASTER, INC., San Juan Capistrano, CA (US)

( * ) Notice: Subject to any disclaimer, the term of this patent is extended or adjusted under 35 U.S.C. 154(b) by 179 days.

(21) Appl. No.: 18/502,574

(22) Filed: Nov. 6, 2023

(65) Prior Publication Data

US 2025/0146260 A1 May 8, 2025

Related U.S. Application Data

(63) Continuation of application No. PCT/US2022/028044, filed on May 6, 2022.

(Continued)

(51) Int. Cl.
*E03D 1/34* (2006.01)

(52) U.S. Cl.
CPC ..... *E03D 1/34* (2013.01)

(58) Field of Classification Search
CPC ..... E03D 1/34; E03D 1/32; E03D 11/146

(Continued)

(56) References Cited

U.S. PATENT DOCUMENTS 4,069,521 A * 1/1978 Aleman ..... E03D 5/006 4/300
4,144,600 A * 3/1979 Mayes ..... E03D 1/14 4/324

(Continued)

FOREIGN PATENT DOCUMENTS

AT 523381 B1 * 8/2021 ..... E03D 11/146
BR 112014021538 B1 * 8/2021 ..... E03D 1/012

(Continued)

OTHER PUBLICATIONS

Caroma Invisi Series II Manual. Datasheet [online]. Caroma, 2014, Retrieved from the Internet: <URL: https://www.manualslib.com/manual/1555780/Caroma-Invisi-Series-li.html>.

*Primary Examiner* — Lori L Baker
(74) *Attorney, Agent, or Firm* — Greenberg Traurig, LLP

(57) ABSTRACT

A cistern system enables maintenance, removal, or adjustment of various components through a maintenance window. The cistern system includes screen support members that cooperate with a flush valve to remove fallen components. The cistern system includes a frame with an adjustable upper bar that can be removed to facilitate the installation of various components. The frame includes a bar holder fastener that enables vertical leveling when the frame is secured to a wall with one or more wall mounts. The frame includes adjustable frame supports that can be fixed in position by frame height adjusters when only supporting the weight of the cistern system but can be adjusted in and out of the frame by applying additional downward force to the frame.

15 Claims, 82 Drawing Sheets

Related U.S. Application Data

(60) Provisional application No. 63/184,923, filed on May 6, 2021.

(58) Field of Classification Search
USPC ..... 4/378, 324, 353
See application file for complete search history.

(56) References Cited

U.S. PATENT DOCUMENTS

| | | | | | |
|---|---|---|---|---|---|
| 4,230,145 | A * | 10/1980 | Badders | E03D 5/024 | 137/445 |
| 5,237,710 | A * | 8/1993 | Battle | E03D 1/306 | 4/324 |
| 5,926,861 | A * | 7/1999 | Frost | E03D 1/142 | 4/324 |
| 11,732,452 | B2 * | 8/2023 | Hausmann | E03D 1/34 | 4/378 |
| 2004/0073993 | A1 * | 4/2004 | Frost | E03D 1/142 | 4/378 |
| 2004/0107490 | A1 * | 6/2004 | Mercan | E03D 11/146 | 4/420 |
| 2006/0179560 | A1 | 8/2006 | Ouyoung | | |
| 2010/0212081 | A1 * | 8/2010 | Collins | E03D 5/006 | 4/415 |
| 2010/0251470 | A1 * | 10/2010 | Lake | E03D 1/14 | 4/353 |
| 2011/0258765 | A1 * | 10/2011 | Nguyen | E03D 1/142 | 4/324 |
| 2013/0152292 | A1 * | 6/2013 | Yu | E03D 5/024 | 4/378 |
| 2013/0167294 | A1 * | 7/2013 | Preciado-Villanueva | E03D 1/304 | 4/395 |
| 2015/0368890 | A1 * | 12/2015 | Gasca Salas | E03D 1/142 | 4/324 |
| 2016/0289936 | A1 * | 10/2016 | Horaites | E03D 1/012 | |
| 2023/0228075 | A1 * | 7/2023 | Gunawardena | E03D 1/087 | 4/368 |
| 2025/0146260 | A1 * | 5/2025 | Le | E03D 1/34 | |

FOREIGN PATENT DOCUMENTS

| | | | | | |
|---|---|---|---|---|---|
| CN | 106013362 | A * | 10/2016 | E03D 5/10 | |
| CN | 210636532 | U | 5/2020 | | |
| DE | 19962404 | A1 * | 7/2001 | E03D 1/34 | |
| DE | 20211004 | U1 | 9/2002 | | |
| DE | 102020120915 | A1 * | 2/2022 | E03D 11/146 | |
| DE | 102020133154 | A1 * | 6/2022 | E03D 11/146 | |
| EP | 2128350 | A1 | 12/2009 | | |
| EP | 2775052 | A1 | 9/2014 | | |
| EP | 226437 | B1 | 1/2015 | | |
| EP | 2921596 | B4 | 9/2015 | | |
| EP | 2182124 | B1 | 8/2017 | | |
| EP | 3321435 | A1 * | 5/2018 | E03D 1/34 | |
| EP | 3486386 | A1 * | 5/2019 | E03D 11/17 | |
| EP | 3469158 | B1 * | 7/2020 | E03D 9/14 | |
| EP | 3702544 | A1 | 9/2020 | | |
| EP | 3705635 | A1 * | 9/2020 | E03D 5/10 | |
| EP | 3702544 | B1 * | 4/2024 | E03D 1/34 | |
| ES | 2301723 | T3 * | 7/2008 | F16K 31/28 | |
| ES | 2330736 | T3 * | 12/2009 | E03D 1/34 | |
| ES | 2535165 | T3 * | 5/2015 | E03D 1/34 | |
| ES | 1257424 | U * | 12/2020 | E03D 5/105 | |
| ES | 2818616 | T3 * | 4/2021 | E03D 1/32 | |
| ES | 2862140 | T3 * | 10/2021 | E04C 2/521 | |
| ES | 2894769 | T3 * | 2/2022 | E03D 1/14 | |
| ES | 2910673 | T3 * | 5/2022 | E03D 5/01 | |
| ES | 2973708 | T3 * | 6/2024 | E03D 3/12 | |
| FR | 2912435 | A1 * | 8/2008 | E03D 9/14 | |
| FR | 3037978 | A3 * | 12/2016 | F16L 5/04 | |
| GB | 2458672 | A * | 9/2009 | E03D 1/32 | |
| GB | 2488382 | A * | 8/2012 | E03D 1/34 | |
| GB | 2573818 | A * | 11/2019 | F16K 31/18 | |
| PT | 1936048 | E * | 1/2011 | E03D 1/0125 | |
| PT | 1916343 | E * | 8/2012 | E03D 1/34 | |
| RU | 2721797 | C2 * | 5/2020 | E03D 1/34 | |
| WO | WO-9614479 | A1 * | 5/1996 | E03D 1/34 | |
| WO | WO-2008116256 | A1 * | 10/2008 | F16K 31/385 | |
| WO | WO-2009017391 | A1 * | 2/2009 | E03D 11/146 | |
| WO | WO-2009039561 | A1 * | 4/2009 | E03D 1/14 | |
| WO | WO-2012045099 | A2 * | 4/2012 | E03D 1/32 | |
| WO | WO-2013147447 | A1 * | 10/2013 | E03D 1/14 | |
| WO | WO-2019222744 | A1 * | 11/2019 | E03C 1/102 | |
| WO | WO-2020005660 | A1 * | 1/2020 | E03D 1/04 | |
| WO | WO-2022236035 | A1 * | 11/2022 | E03D 1/34 | |
| WO | WO-2023177680 | A1 * | 9/2023 | E03D 3/12 | |
| WO | WO-2025132679 | A1 * | 6/2025 | E03D 11/146 | |

* cited by examiner

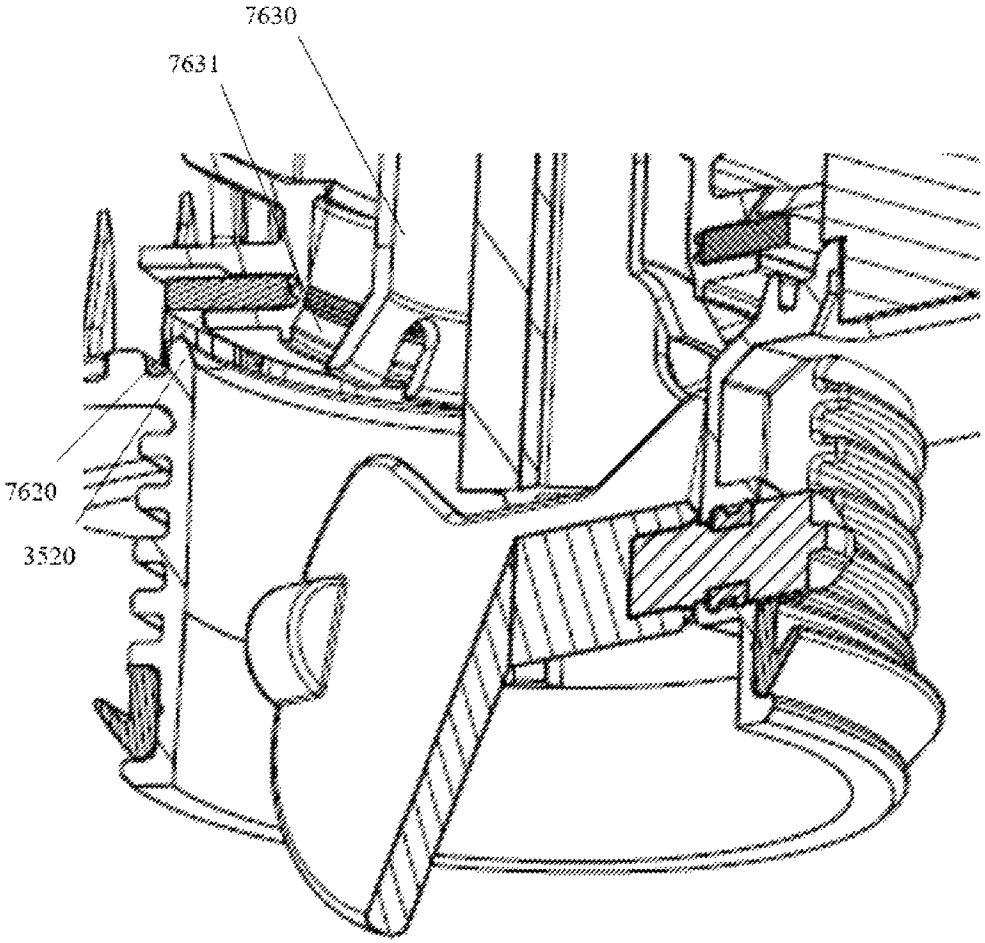
FIG. 77
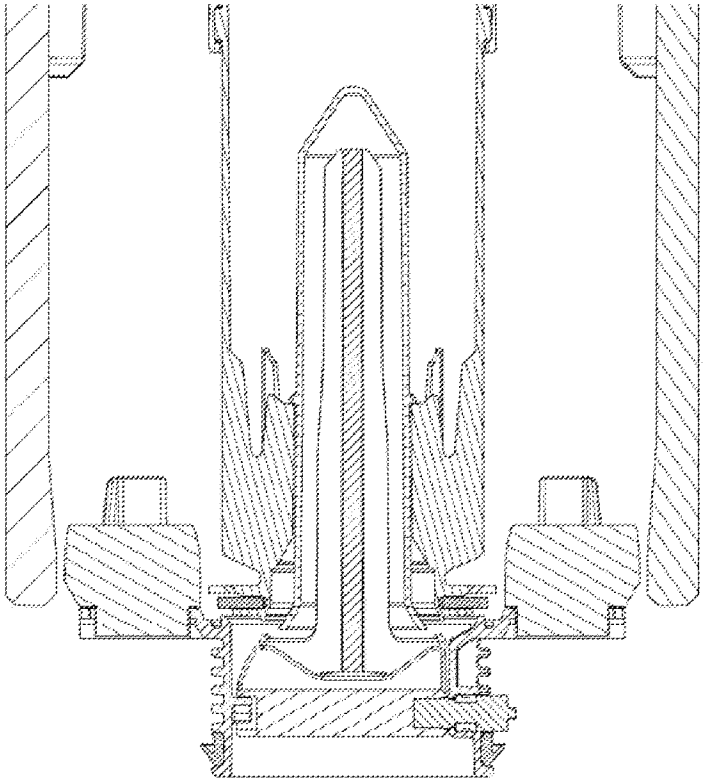

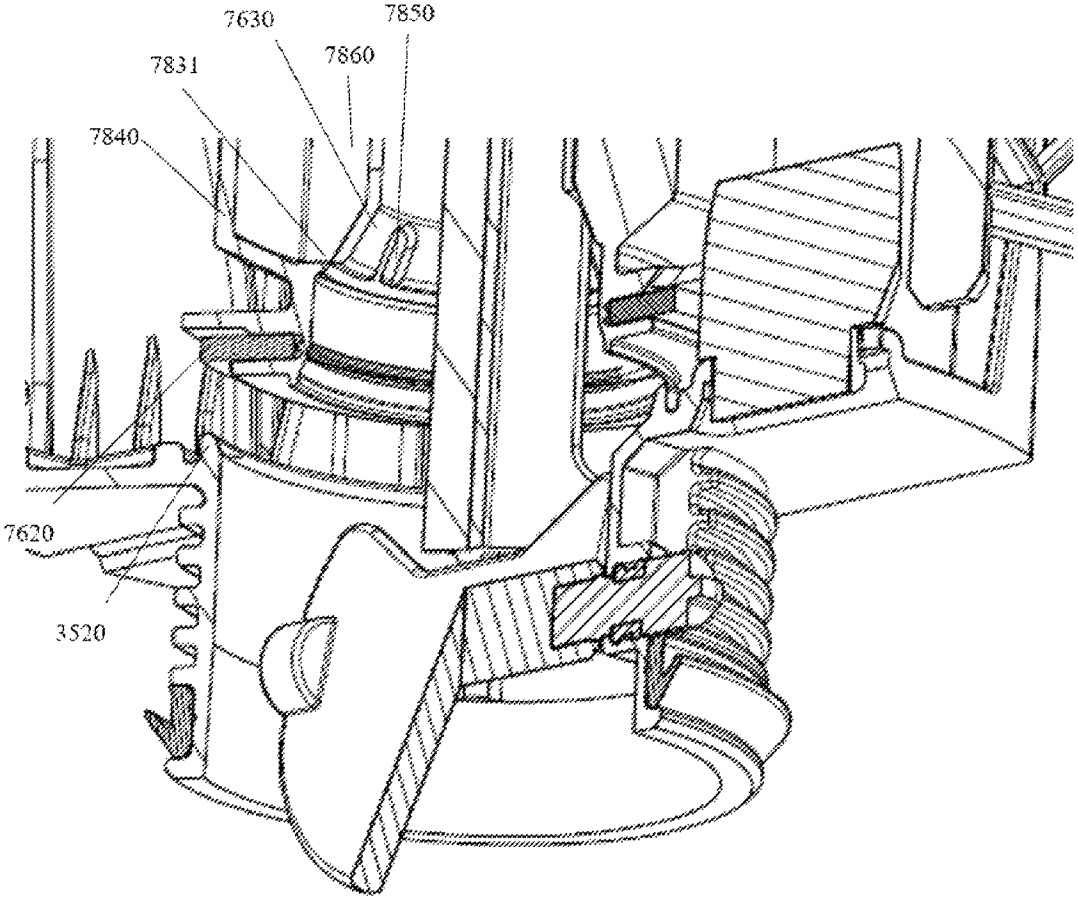
FIG. 78
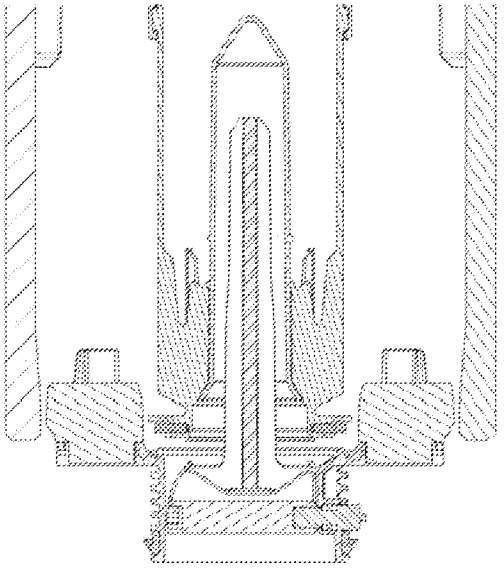

CISTERN SYSTEM, APPARATUS AND METHOD

RELATED APPLICATIONS

This application is a Continuation application relating to and claiming the benefit of commonly-owned, co-pending PCT International Application No. PCT/US2022/028044, filed May 6, 2022, which claims priority to and the benefit of commonly-owned U.S. Provisional Patent Application No. 63/184,923, filed May 6, 2021, entitled "CISTERN SYSTEM, APPARATUS AND METHOD," which is incorporated herein by reference in its entirety.

BACKGROUND

Fluid systems and toilet systems improve quality of life across the globe. Toilets remove hazardous waste from inside the home and direct the waste to sewage treatment facilities which reduces the impact humans have on the environment.

There are a wide variety of toilet systems which include a wide variety of cistern designs. Some cistern designs are designed to have portions of or the entire cistern to be hidden from view after installation.

While such designs are aesthetically pleasing, installation, adjustment, and maintenance of important components can be difficult. It would be advantageous to provide a cistern system, apparatus and method which are easier to install and maintain than prior art designs while providing similar or better performance.

SUMMARY

Removable Upper Frame Bar on Cistern Frame

In some embodiments, a removable upper frame bar can facilitate fluid connection on top of the frame. In some embodiments, after a fluid connection installation, the removable upper frame bar can be set in final position when installation is finished.

In some embodiments, the upper frame bar can be fixed on the upper frame one and/or both ends. In some embodiments, the upper frame bar can be fixed on the upper frame with a hinge connection. In some embodiments, the hinge connection includes a locking system. In some embodiments, the locking system can be on one or more sides of the upper frame to allow the bar connection to disconnect from the upper frame.

In some embodiments, the upper frame is configured to allow the open upper frame bar to rotate or swing open. In some embodiments, the rotation of the upper frame bar can include a movement to a generally vertical position. In some embodiments, when the upper frame bar is in the vertical position, the upper frame bar is configured return to its original horizontal lock position without the use of any tools.

Adjustable Frame Height after Frame Installation

In some embodiments, the upper frame bar height is configured to be adjusted after an upper portion of the frame has been installed and/or fixed. In some embodiments, with the upper frame fixed and/or installed, the upper frame can be adjusted without the use of a frame extension by using one or more adjustable bar holders.

In some embodiments, the upper frame bar includes a flexible latch to release the upper frame bar. In some embodiments, the upper bar holders are configured to adjust to one or more height levels with the release of a bar holder fastener.

Quick Coupler for Fluid Connection

In some embodiments, a fluid connection can be established between the components of the fluid line piping inside a toilet cistern. Some embodiments comprise a quick connect system. In some embodiments, the quick connect system can be used for fluid connection inside a toilet cistern. In some embodiments, the quick connect system can be a reliable and easy to use.

In some embodiments, the quick connect system can be used for connecting a fluid supply assembly between a stop valve and a filling valve. In some embodiments, the stop valve can be connected at the beginning of the fluid supply assembly. In some embodiments, the fill valve can be connected at the end of the fluid supply assembly. In some embodiments, the quick connect system can incorporate and/or connect multiple other connection elements.

Compact in One Piece Integrated Flush Valve Assembly for Cisterns

Some embodiments provide a compact integrated flush valve assembly for a cistern to control the fluid supply to the cistern and its flush volumes, which can be installed and uninstalled intuitively into a cistern through even a very narrow maintenance window. Some embodiments enable the installation, uninstalling, and/or adjustment of one or more components accessible through the maintenance window can be performed without using any tools. Some embodiments enable the installing and uninstalling of all components accessible through the maintenance window, except for the fluid tank and tank lid, without using any tools.

Some embodiments provide at least one valve adjuster to control the flush volumes for the flush valve that is portioned above and away from the fluid environment inside the cistern tank enabling the use of only one submerged moving part to improve robustness.

For adjustment and maintenance purposes, some embodiments provide easy access and visibility through a front maintenance window of the cistern to the control features of the cistern valves, fluid supply, and flush volumes after the installation.

Some embodiments provide easy maintenance for the cistern. Accordingly, some embodiments provide an integrated one-piece all in one plug and play module that can be swapped out with minimum installation steps.

Some embodiments provide a one piece design that integrates the fill valve assembly configured to control fluid supply to a cistern. In some embodiments the fill valve assembly is configured to be activated by an activation mechanism such as an actuation assembly which may include one or more of a cable assembly, a pneumatic actuator assembly, and an electronic actuator assembly as non-limiting examples. In some embodiments, a flush tube which cooperates with the flush valve assembly which comprises one or more fluid level sensors to control the residual fluid levels in the cistern for different flush volumes.

Some embodiments provide a fill valve assembly which includes a flush fork configured to cause the up and down motion of a the flush tube to activate and deactivate the fill valve assembly. In some embodiments, the fill valve assembly includes a quick coupling feature to be connected to a fluid manifold. Some embodiments include a flowrate valve configured to direct the fluid to an outlet without creating splashes or readily audible noise (e.g., less than 10 decibels). In some embodiments, the fill valve assembly includes a service cap covering a main seal, the service cap bayonet coupled to the valve body and pointed outward to the front open of the maintenance window for easy access and maintenance. In some embodiments, the fill valve assembly includes an engagement assembly on its housing. In some embodiments, the fill valve assembly can be positioned on either side of the flush valve assembly.

In some embodiments, flush valve assembly includes a vacuum assembly is positioned above the flush tube away from the fluid in the cistern tank to keep it clean from hard fluid or mineral deposits. In some embodiments the vacuum assembly includes a vacuum chamber that is generally cylindrical in shape with a slight taper surface on its upper inside diameter end. In some embodiments, the vacuum chamber includes an outlet port that is coupled to a diverter valve via a tube to allow air to come in and out. In some embodiments, the inside surface of the vacuum cap housing is smooth to have better engagement with the vacuum seal on the top of a vacuum cap. In some embodiments, the vacuum cap housing has a leading feature to allow the vacuum cap and its mounting structure to enter easily.

In some embodiments, the engagement assembly as described herein includes levers and cams to allow locking the flush valve assembly inside the cistern after the installation and automatically connect the fill valve assembly to a manifold fill valve outlet. In some embodiments, the engagement assembly also comprises an integrated cam on one of its levers to spread a fork shaped activation lever (flush fork) to engage and disengage the flush fork from a flange shoulder on top of the flush tube beneath the vacuum cap during installation and/or uninstallation.

In some embodiments, the activation mechanism is mounted on top of the flush valve assembly that provides connection between a user interface activator with the activation lever. In some embodiments, a pull cable is used with one of its ends connected to a pocket on the activation lever and the other end is connected to the user interface activator. In some embodiments, the activation mechanism is preferred to be flexible for easy assembly and adaption to different mounting structures.

In some embodiments, the activation lever is connected to a plunger and drives the plunger to interact with a diverter valve so that its one stroke will be enough to lift a flush tube and engage the plunger to the diverter valve to control the partial flush of the flush tube. In some embodiments, another stroke will be enough to lift the flush tube and engage the plunger to the diverter valve to control the full flush of the flush tube.

In some embodiments, one side of the diverter valve is connected to a fluid level sensor for the partial flush and the other side of the diverter valve is connected to anther fluid level sensor for the full flush. Different strokes from the activation lever control the position of the plunger relative to these two level sensors.

In some embodiments, the fluid level sensor (e.g., timing float) sits inside a sensor fluid reservoir (i.e., timing compartment). In some embodiments, the fluid level sensor comprises an inverted cup shape so that while submerged in the reservoir it can build up enough buoyancy to close an air inlet at the diverter valve. In some embodiments, when the fluid level inside the reservoir drops, the buoyant force disappears from the fluid level sensor and the weight on the fluid level sensor will open the air valve at the diverter valve allowing air to come in the vacuum chamber of the vacuum housing to break the vacuum so that the vacuum housing can release the flush tube. In some embodiments, the rate of the fluid level drop inside the reservoir is controlled by the size of the tank outlet. In some embodiments, the larger the size of the outlet, the quicker the fluid level drops. Therefore, to keep the flush tube on longer, the drain outlet can be adjusted smaller by an adjustable valve such as a butterfly valve as a non-limiting example. In some embodiments, to close the flush tube sooner, the adjustable valve can be opened using a valve adjuster accessible through the maintenance window.

In some embodiments, a pneumatic activation mechanism is used to connect a user interface activator with the activation lever. In some embodiments, the pneumatic activation mechanism includes a driving piston mounted on a housing driven by one or more (e.g., two) buttons installed in the housing. In some embodiments, one button is for a full flush and the other for a partial flush. In some embodiments, a flexible hose connects this driving piston to another slave piston mounted on top of the flush valve assembly, which is used to drive the activation lever. In some embodiments, a pneumatic diverter valve is also used to interface with both buttons and mounted on the same housing.

In some embodiments, the buttons have a cam on the surface that interfaces with the pneumatic diverter valve so that when activated, it can toggle the pneumatic diverter valve to switch from controlling a full flush to a partial flush and vice versa. In some embodiments, a hose is connected from the vacuum chamber of the latching mechanism. In some embodiments, another hose is used to connect the pneumatic diverter valve back to an air valve of one level sensor mounted inside a reservoir of the flush valve assembly for the communication among the vacuum chamber, pneumatic diverter valve, and level sensor. In some embodiments, another hose is used to connect the vacuum chamber of the flush valve assembly to the air valve of another level sensor mounted inside a reservoir of the flush valve assembly to establish a communication between the vacuum chamber and at least one level sensor in the vacuum assembly.

Some embodiments of a compact integrated flush valve assembly use an electronically controlled activation mechanism to send signal commands from an end user activator to the activation lever to open and close the flush tube to control flush volumes of the system. In some embodiments, the fluid level sensors can be used as described according to some embodiments to control the opening duration of the flush tube. In some embodiments, the opening duration of the flush tube can be controlled directly by a time duration of a linear actuator or motor with rack and pinion activating the activation lever according to some embodiments.

In some embodiments, the flush valve assembly is installed at the front opening of a cistern, over the top of a flush tube. In some embodiments, the installation of the flush valve assembly can be done by hand by first sliding it in substantially horizontally along the front opening of the cistern until its bottom touches the back wall of the cistern and rotating and turning it into its substantially vertical position and continuing to push it downward following the guides inside the cistern until it bottoms and rests on a shoulder inside the cistern. In some embodiments, the locking mechanism (engagement assembly) is then lifted up to lock the flush valve assembly down while forcing a lever of the locking mechanism to the left to lock the inlet port of the fill valve assembly into a fluid manifold inside the cistern to connect the fill valve assembly to the fluid supply.

In some embodiments, the other end of the cable of the activation mechanism is then connected to a user interface activator. In some embodiments, under fluid pressure, the fill valve assembly will fill up the cistern tank via an outlet spout that directs the fluid outlet into the tank below. In some embodiments, when fluid level inside the tank reaches a predetermined level, the fill valve assembly is shut off. In some embodiments, when one of the buttons of the user interface activator is actuated, it will pull the cable at a defined stroke, which in turn pulls the activation lever (e.g., flush fork) up to rotate (or generally pivot) it about a pivot point to magnify its stroke enough to be able to lift the flush tube from its seat.

In some embodiments, with this "jump-start", the flush tube is then popped up under its built-up buoyancy, driving the vacuum seal (e.g., vacuum cap) into the vacuum chamber (e.g., vacuum housing) of the vacuum assembly, at where vacuum pressure is created to hold the vacuum seal up until it is released by air intake from an air valve of the diverter valve due to fluid drop inside the cistern tank. In some embodiments, the rotation of the activation lever also drives a plunger to engage with the divert valve to activate at least one of the fluid level sensors that is controlled by the fluid level inside the sensor fluid reservoir. In some embodiments, when fluid level in this reservoir drops, the fluid level sensor will open an air valve on the diverter valve to allow air to come in the vacuum chamber, releasing the vacuum that hold the vacuum seal up to close the flush tube on the tank outlet.

In some embodiments, the rate of fluid level drop in the sensor fluid reservoir is controlled by the size of an outlet drain (i.e., timing opening). In some embodiments, the outlet drain includes multiple preset openings that are calibrated to match with different flush timer positions. In some embodiments, depending on what flush volume is required, the flush timer is set according to provide the right opening for the outlet drain. Therefore, in some embodiments, it is very convenient to adjust the flush volumes by adjusting this knob from the top, through the maintenance window opening of the cistern. In some embodiments, an alternative adjustment device (such as a flush volume adjuster lever) is used instead of a knob.

In some embodiments, the fill valve assembly comprises a cartridge to house the main diaphragm of the valve, which is designed to be bayoneted to the valve housing with its face pointed to the front opening of the cistern. In some embodiments, this configuration allows for easy access to the cartridge for services such as cleaning or repair the main diaphragm for any malfunction after the initial installation.

In some embodiments, the device is configured so the timing cup set fluid level is the same as the tank set fluid level. In some embodiments, the device is configured so the timing cup set fluid level does not change with changes to the tank set fluid level.

Some embodiments provide one or more of the following advantages:

1. Allows for one step installation of the whole control unit for fill and flush a cistern by hand to suitable for tight space application;
2. Less confusion for installers since there is only one integrated module with obvious controls; and
3. Covers the opening of the cistern to prevent accidental drops of components into the cistern.

Replaceable, Front-Access Fill Valve Cartridge

Some embodiments provide a front accessible fill valve cartridge which allows easy cleaning of trapped particles during installation or during use.

Some embodiments provide a fill valve cartridge which allows simple and quick disassembly for purposes of cleaning and/or replacing damaged seals as well as assembly with intuitive turning around and taking out or in system without use of any tool and placed in the relatively small cistern repairmen and maintaining opening.

In some embodiments, the fill valve assembly uses activation mechanism that transfers the buoyant force and gravity force from a float via linkages to a valve cover, which houses a diaphragm seal to shut off or turn on the valve. Therefore, in some embodiments, to remove the diaphragm seal (i.e., fill valve seal) for cleaning or service the prior art, the whole subassembly of diaphragm, cover, linkages, and float must be disassembled from the main body of the valve. In some embodiments, in the case of an in-wall cistern, the whole fill valve assembly must be removed from the cistern to allow for this access. In some embodiments, it can turn into a difficult and long process to provide a simple service.

Some embodiments include a replaceable, front-access fill valve cartridge. In some embodiments, the fill valve assembly comprises a cartridge (i.e., service cap) to house the main diaphragm of the fill valve, which is designed to be bayoneted to the valve housing with its face pointed to the front opening of the cistern. In some embodiments, the cartridge is not connected to an activation mechanism of the fill valve including the linkages and float. Therefore, in some embodiments, this configuration allows for easy access and removal of the cartridge alone for services without having to removing the whole fill valve assembly from the cistern.

Flexible Sealing Cup Handle Functionality in Slim Cistern

Some embodiments provide a flexible sealing base (i.e., flowrate valve) for easy installation in a narrow and tall cistern, through its front opening (i.e., maintenance window) or its top opening with limited space. In some embodiments, the flexible sealing base can be intuitively installed or removed as one completed unit without any special tool and can be done by one hand. Some embodiments provide an option to include a control valve (e.g., butterfly valve) on the sealing base with adjustment from the top to throttle the sealing base outlet for flowrate control.

In some embodiments, the flexible sealing base includes one or more of a base, a base seal to seal against the tank wall, guide ribs to provide alignment between the base and the tank wall during the installation or removal. In some embodiments, the flexible sealing base includes a swivel joint to cooperate with matching swivel joint geometries from to form a flexible joint between the two parts. In some embodiments, the flexible sealing base includes an upward protrusion feature (e.g., tube guide support) to provide bearing a surface for the body of a flush tube. Some embodiments provide a handle (e.g., flexible handle) that is coupled or to connected to the base at the swivel joints so that it can rotate about these swivel joints. In some embodiments, the handle has a substantially U-shaped upper body with slender structure so that it can be bent along an axis parallel to the axis of the swivel joints. In some embodiments, this flexible body allows this handle to be installed or uninstalled through the narrow front opening and narrow body of the cistern but be stiff enough to allow the whole assembly of the handle and base to be pushed down against the resistance between base seal and tank wall without buckling. In some embodiments, the handle also has locking tabs on a top side portion which are snapped into a locking structure (e.g., one or more grooves) inside the cistern to hold the flexible sealing base down after the installation. In some embodiments, the base seal is designed with a shape so that it can seal against the fluid head pressure above but will not create a lot of friction between itself and the tank wall so that the flexible sealing base can be installed and uninstalled easily.

Some embodiments provide the option to add additional components to form a throttle valve on the base with a top adjustment that can be turned to adjust the opening of the throttle valve. In some embodiments, the throttle valve can be in a form of a butterfly valve or other suitable valve that is connected to the adjustment rod via a crank. In some embodiments, the adjustment rod (e.g., valve adjusting arm) is connected to an adjustment screw. In some embodiments, the adjustment screw has its upper end fixed to a structure inside the cistern so that when the adjustment screw is rotated, it will pull the adjustment rod up and down and in return it will rotate the crank about the axis of the butterfly valve to throttle this valve to control the outlet flowrate of the cistern.

In some embodiments, the adjustment rod and the adjustment screw comprise flexible bodies and are mounted to the flexible sealing base and can be intuitively installed and uninstalled through the cistern.

In some embodiments, the flexible seal base can be installed into a narrow but tall cistern tank with a narrow front opening or a top opening with limited space. In some embodiments, the handle is used as a holder while inserting the flexible seal base into the tank with the base going first. In some embodiments, when the base passes through the front maintenance window opening, the swivel jointed between the Handle and the Base will allow the Base to rotate and align with the vertical direction of the tank. In some embodiments by continuing to push the assembly through, the handle starts to be bent slightly to allow this portion of the whole assembly to pass through and to change direction from horizontal to vertical direction. In some embodiments, the handle will continue to be bent and guided by the internal geometries of the tank until the whole flexible seal base assembly is completely inside the tank and at a vertical direction. In some embodiments, the handle is used to push the assembly all the way into engagement with the bottom opening of the tank. Finally, the handle is snapped into the locking portion with the tank structure to hold the assembly down during operation according to some embodiments.

In some embodiments, the uninstallation includes the reversed steps. First, in some embodiments, the handle is pulled out of the locking portion and pulled upward until it reaches the front opening of the cistern tank. Then, in some embodiments, the pulling direction changes from substantially vertical to a substantially horizontal direction. In some embodiments, during this period until the base reaches the front opening of the cistern tank, the handle will be slightly bent to allow the assembly to come out. In some embodiments, the swivel joints between the base and handle will allow the base to rotate near the opening and then slide out.

In some embodiments, when the throttle valve option is used on the flexible seal base, the adjustment rod and the adjustment screw can be held together with the handle during the installation or uninstallation process. In some embodiments, toward the end of the installation after the handle is locked in place, the adjustment screw is then locked into a fixed structure in the cistern tank to constraint the motion of the screw from vertical movement.

In some embodiments, a butterfly valve is opened to allow for higher output flowrate and closed to restrict flowrate to match the toilet bowl requirements. In some embodiments, this adjustment is needed when the whole system of the cistern is already installed in place and the user needs to adjust the flowrate up and down to fine tune the toilet performance. Therefore, in some embodiments, the adjustment feature must be easy for access and be able for real time adjustment. In some embodiments, having the adjustment screw located at the top with a knob to turn enables this adjustment. In some embodiments, the assembly can be handled by one hand during installation and uninstallation, making it suitable for tight space usage. In some embodiment, the butterfly valve can be adjusted using a cable mechanism.

Closed Tank from Inside Screen Guard Design

In some embodiments, a reinforcement screen guard design comprising one or more openings on a fill member and/or dosing member prevents bigger particles, tools, etc. from being dropped into side tank areas which are not readily accessible from cistern service opening and allows users to take items out without additional tools.

Some embodiments provide reinforcement elements in a mesh design inserted into the tank with the additional function of preventing particles to be dropped into side tank areas which are not accessible from the cistern service opening with hand or with elements which are part of the cistern.

All Controls Accessible Through the Maintenance Window (e.g., Fill Valve Cartridge, Volume Control, Flow Rate Control, Dosing Assembly)

Some embodiments place all the functional controls for a cistern characteristics such as fluid supply, activation connection, flush volumes, and flush flowrates in the front opening of a cistern for easy accessibility and visibility during installation and service. In some embodiments, the fluid supply assembly includes one or more of an angle stop valve, a filter, a fluid connector, a flow regulator, and a fill valve assembly. In some embodiments, the activation connection allows to connect an activation panel to the mechanism to activate the flush valve. In some embodiments, the flush volume control is a feature to allow for setting different flush volumes for a cistern. In some embodiments, the flush flowrate control is a feature to allow for adjusting flush flowrate of a cistern to tune its performance to match a toilet bowl requirements.

In some embodiments, all control features for the functions of a cistern are designed to be located or centered around the open maintenance window of the cistern so that they are accessible and visible from the front. In some embodiments, the adjustments can be done through the maintenance window by hand without any tools. In some embodiments, all adjustment features can be done without removal of any subsystem. In some embodiments, for serviceability, the subsystems can be readily assessed, removed, and replaced.

In some embodiments, through a maintenance window of a cistern system, an end user can visually see and reach in to turn the knob of the volume control feature to set up more or less flush volume and also turn the knob of the flush flowrate control to tune the flush flowrate at the outlet so that the toilet performance can be optimized. In some embodiments, the fill valve assembly cartridge, the flowrate regulator or the fluid filter can be removed for cleaning or repair after the stop valve is shut off by the same method from the front opening.

In some embodiments, having one or more adjustment feature accessible through a single maintenance window provides enables a simple customer interface to the control features and their serviceability. In some embodiments, one or more adjustable components are arranged to be seen through the maintenance window, which allows greater confidence when making fine adjustments. In some embodiments, both easy accessibility and visibility help to minimize the chances of mishandling the product and thereby causing malfunctions.

Sliding Control Panel

Some embodiments provide a sliding mechanism for a control plate (i.e., flush plate) which is a convenient and readily understood way of opening the panel to gain access to the detergent refill or moving and/or removing the control plate for maintenance purposes.

Some embodiments provide a sliding control plate design using a fixed base plate (i.e., actuation panel) and a removable face plate/control plate using a rail system, where the rail is part of the base plate and the slide is part of the face plate, or vice versa. In some embodiments, this configuration allows for an intuitive, one hand, tool free, opening of the control plate when accessibility of the control plate is needed to reach a detergent refill opening (i.e., dosing port). After access, in some embodiments, the panel can be closed by sliding it along the rails into a lock. Some embodiments provide the ability to remove the entire faceplate through a resistance feature or through a hidden locking feature connected to the slide or through a locking feature housed in the support plate in order to provide access to the base plate and/or maintenance window opening.

Automatic Cable Pre-Tension Setting

In some embodiments, a cable assembly that includes a cable pre-tensioner (i.e., position adjuster) eliminates the need for manual adjustment of flush valve to the overflow tube due to manufacturing tolerance variation and ensures a reliable activation stroke with minimal dead zone In some embodiments, the cable pre-tensioner enables automatic adjustment of the cable length, using a spring system of which the position is automatically locked when the cable is attached to the control panel. Some embodiments lock the position with tooth interface (i.e., position adjuster) with snap fit to one or more coupling teeth on the base plate. In some embodiments, this automatic adjustment accounts for the tolerance in the cistern and trim components to ensure the activation fork of the flush valve is engaged with the rim of the overflow tube so there is no dead space in the activation stroke to achieve a consistent flush.

Manifold Quick Connection System Hub

Some embodiments provide a connecting manifold like quick connection system fluid supply hub, which allows quick and easy, tool-less installation of filling valve and additional connecting pipes. In some embodiments, valve installation is possible without the use of tools using the quick connect system.

Quick Release Skewer

In some embodiments, a quick release skewer (i.e., panel fastener) design allows for a simple tool-free fixation for the control plate holder and is configured to precisely and accurately applies the desired connecting force without the possibility of over tension.

In some embodiments, the quick release skewer design allows for a tool-free, reliable, and simple length adjustment. In some embodiments, the control plate's fixation to the cistern is accomplished by connecting the panel fastener to the masonry aid and locking it in place by rotating the rod, and then by tightening the cam lever help ensure a consistent locking force. In some embodiments, this consistent locking force prevents over tension of the mounting structure between control plate holder and masonry aid or a loose connection of the control panel, an also allows for tool-free unlocking enabling access to the maintenance window opening.

Adjustable Discharge Elbow Bracket Button Release

Some embodiments provide an easily accessible and readily visible user screw release (i.e., pipe fixer adjuster), which allows simple adjustments of discharge elbow position. In some embodiments, the release includes an Allen key slot to unlock before free adjustment. Some embodiments enable changing the position of the discharge elbow during installation of a cistern, providing an adjustable and sliding discharge elbow bracket (i.e., discharge pipe fixer) with adjustability in one or more (e.g., 11) positions.

Flush Valve Assembly Locking Mechanism

Some embodiments provide an easy method to lock down or secure a flush valve assembly in a cistern and concurrently connect it to a connecting manifold. Some embodiments allow one hand and one motion to activate the locking mechanism (i.e., engagement assembly) and to secure the flush valve assembly to a connecting manifold locates on the tank and/or tank lid securing the flush valve assembly in place. In some embodiments, the reversed motion is used to unlock and disengage the flush valve assembly from the cistern assembly.

Some embodiments include a handle (i.e., locking lever) that is rotatably mounted to the flush valve assembly, possessing at least two cam surfaces, Cam 1 and Cam 2, to drive another linkage (i.e., fork widener) up and down while rotated at an angle about the mounting point on the flush valve assembly. In some embodiments, Cam 1 of the handle is used to push the linkage downward and Cam 2 to push the linkage upward.

In some embodiments, the handle has a flexible locking arm (top portion) to be locked to the mounting structure (e.g., frame, tank and/or tank lid). In some embodiments, lock and unlock operations of the mechanism convert the rotational motion of the handle to substantially vertical linear motion of the linkage. In some embodiments, cam 2 is configured to engage a valve assembly lock in its upward motion to drive the valve assembly lock horizontally to the left, locking the fill valve assembly and the flush valve assembly together. In some embodiments, in a reverse motion, Cam 2 of the linkage will engage with the valve assembly lock to drive the linkage substantially horizontally to the right so that the fill valve assembly can be removed.

In some embodiments, the handle is configured to lock the flush valve assembly inside a cistern while allowing a fixed connection of the flush valve assembly to a fill valve assembly by one motion of the handle. In some embodiments, the mechanism provides a means to intuitively and reliably lock and to unlock the flush valve assembly to two connection points in a cistern without any tools so that the flush valve assembly can be rigidly fixed in place during valve operation.

In some embodiments, a method of use is described by the following steps:

For Locking:

In some embodiments, the handle is rotated clockwise by itself for a distance until one of its cams contacts the cam in the linkage to push it up substantially vertically. In some embodiments, as a result, the cam in the linkage will push the linkage horizontally to the left to force it to engage with the manifold.

In some embodiments, the handle is locked into a feature on a fixed tab or other retention feature of a mounting structure. In some embodiments, its flexible locking arm can be deformed to absorb gaps between the flush valve assembly and the mounting structure to form a substantially rigid, direct connection so that a the working load between the manifold and the flush valve assembly (while the flush valve assembly is operational) can be transferred and absorbed by the mounting structure to keep the flush valve assembly in this fixed position.

For Unlocking:

In some embodiments, the handle is pulled out from the locking tab on the mounting structure and rotated counterclockwise until its cam comes in contact with a cam of the Linkage to push it downward substantially vertically. In some embodiments, as a result, another cam on the linkage will engage with another cam on the linkage to push it substantially horizontally to the right to disengage it from the manifold.

Accordingly, some embodiments provide a mechanism which allows for one hand operation without using any tool with one activation motion to deliver multiple functions; therefore, it can be used in a very compact space. In some embodiments, the mechanism can use gear forms, slots, or other mechanical features in place of cam surfaces to achieve the same function.

Cleaning Module

Some embodiments include a cleaning module. In some embodiments, the system is configured to provide a dosing system configured to automatically supply a controlled dose of cleaning chemicals to a toilet system for cleaning purposes using the available energy from fluid fall and rise in a toilet tank. In some embodiments, the cleaning module is used to meter cleaning solution such as a surfactant at a set rate to a toilet reservoir to provide a diluted solution for cleaning purposes.

In some embodiments, a refill funnel is used as an interface to enable the filling of cleaning liquid from an external container to the dispenser reservoir. In some embodiments, a check valve will open inward to allow for cleaning liquid to flow inside the reservoir while the check valve will also open outward to allow air inside the reservoir to be vented. In some embodiments, liquid from the reservoir drips down through the adjustable dosing nozzle under gravity until the reservoir in the bottom housing is full. In some embodiments, when the toilet tank is filling up, fluid level in the tank will reach the tank fluid level, overflow in, and flood the bottom housing through an opening on the side wall of the housing. In some embodiments, the fresh fluid will mix with the concentration solution in the reservoir.

In some embodiments, when the tank fluid drops below the siphon device due to a flush, a siphon action will start to siphon out all the mixed solution inside the bottom housing. In some embodiments, the rest of the liquid inside the reservoir will be drained out through a small bleed hole at its side wall. In some embodiments, the concentration liquid from the reservoir then starts to drip down and refill the small reservoir in the bottom housing again. In some embodiments, the same cycle repeats when the tank fluid is refilled back to the tank fluid level. In some embodiments, a level indicator can be incorporated into the design a to monitor the liquid inside the reservoir during filling and usage.

In some embodiments, a simple floating stick is used inside an enclosed structure extended from the top wall of the reservoir that will indicate its position corresponding to the liquid level. The key advantages to some embodiments of this system are no extra power is required and precision dosing is achieved.

In some embodiments, the system includes a cleaning module configured to work with dry cleaning tablet according to some embodiments. In some embodiments, the cleaning module utilizes fluid supply tapped from the outlet of a fill valve used in a cistern system for filling the tank via the supply tube to dissolve the tablet into a cartridge housing. In some embodiments, the drain tube, with vacuum generated from fluid flow out of the fill valve outlet due to a venturi effect, will suck all diluted solution inside the cartridge housing back to the fill valve outlet and dispersed into the tank. In some embodiments, this helps to keep the cleaning tablet dry most of the time for longevity purposes.

Flush Valve with Check Valve

In some embodiments, the system includes a check valve at the bottom of an open-end float of a tower flush valve (i.e., flush tube) so that it can be used to control how fluid from a toilet tank enters the bottom of the float during a flush. In some embodiments, the system is configured to activate the flush valve with a small stroke. In some embodiments, when fluid in the tank starts to flow down the flush valve seat, the check valve is still at its rest position. In some embodiments, the check valve is configured to pop-up under its own buoyancy to close the opening with the tower float, preventing fluid from surrounding to enter the tower float, maintaining the air volume inside the tower float according to some embodiments.

In some embodiments, it is this pocket of air inside the tower float is configured to build up the buoyant force on the float instantly, helping to lift the float up rapidly from the initial cracking position to the fully open position to latch on to a latching mechanism. In some embodiments, due to its head pressure, fluid surrounding the float starts to flow in through the designed gap between the check valve and the tower float to push the air out and fill up the space inside the tower float. In some embodiments, the more air is pushed out, the more buoyancy is reduced. In some embodiments, as soon as the tower float is released by the latching mechanism at a set time, the tower float will drop down under its own weight to close the flush valve.

In some embodiments, when there is an overflow condition such as when a fill valve fails to shut off, fluid rising in the tank will overflow into the top open of the tower float and flow to the drain through the bigger gap between the check valve and the tower float. Other advantages of the system, according to some embodiments, include making the flush valve performance less depended on the user interface. In conventional systems, the end user must lift a full stroke of the tower float to make it latch on a latching mechanism so that the valve can stay opened. In some embodiments, how fast or how long an end user hold on the activation mechanism will have effects on the flush volumes of the flush valve, which is not the case in some embodiments presented herein.

Two-Piece Discharge Extension

In some embodiments, the system includes a discharge extension (i.e., discharge adaptor) as part of toilet cistern connecting accessories and used for connection of a toilet bowl to a discharge pipeline system according to some embodiments. In some embodiments, splitting of discharge extension into two parts enables compact packaging of the whole product and a more transportable unit. In some embodiments, a bayonet locking system enables easy and secure connection between both parts for installation. In some embodiments, the discharge assembly includes markings on each part to indicate end locking position. In some embodiments, a seal prevents leaking between both parts.

DRAWING DESCRIPTION

FIG. 1 shows one or more aspects of the system 100 implemented in a bathroom according to some embodiments.

FIG. 2 shows a perspective view 201 with the wall 130 removed exposing an assembled view 220 of some aspects of the system 100 according to some embodiments.

FIG. 3 illustrates and exploded view 320 of the assembled view 220 according to some embodiments.

FIG. 4 shows an exploded view 400 of various components of the frame 301 and discharge assembly 303 according to some embodiments.

FIG. 5 illustrates a zoomed view 500 of a top portion 401 of the exploded view 400.

FIG. 6 is a sectional view 601 and an isometric view 602 of a top portion of the frame 301 at a first (lowest) position 610 when assembled according to some embodiments.

FIG. 7 is a sectional view 701 and an isometric view 702 of the upper bar 502 of a top portion of the frame 301 at a higher second position 710 when assembled according to some embodiments.

FIG. 8 is a sectional view 801 and an isometric view 802 of the upper bar 502 at a higher third position 810 when assembled according to some embodiments.

FIG. 9 is a sectional view 901 and an isometric view 902 of the upper bar 502 at a higher third position 910 when assembled according to some embodiments.

FIG. 77 shows an initial break of the seal between the flush tube seal 7620 and the valve seat 3520.

FIG. 78 shows a flush tube 7610 stage where water now fills underneath the flush tube driving the check valve 7630 up to create a seal 7831 with the flush housing 7840 to prevent unmetered flow into the flush housing.

DETAILED DESCRIPTION

Figure 1:
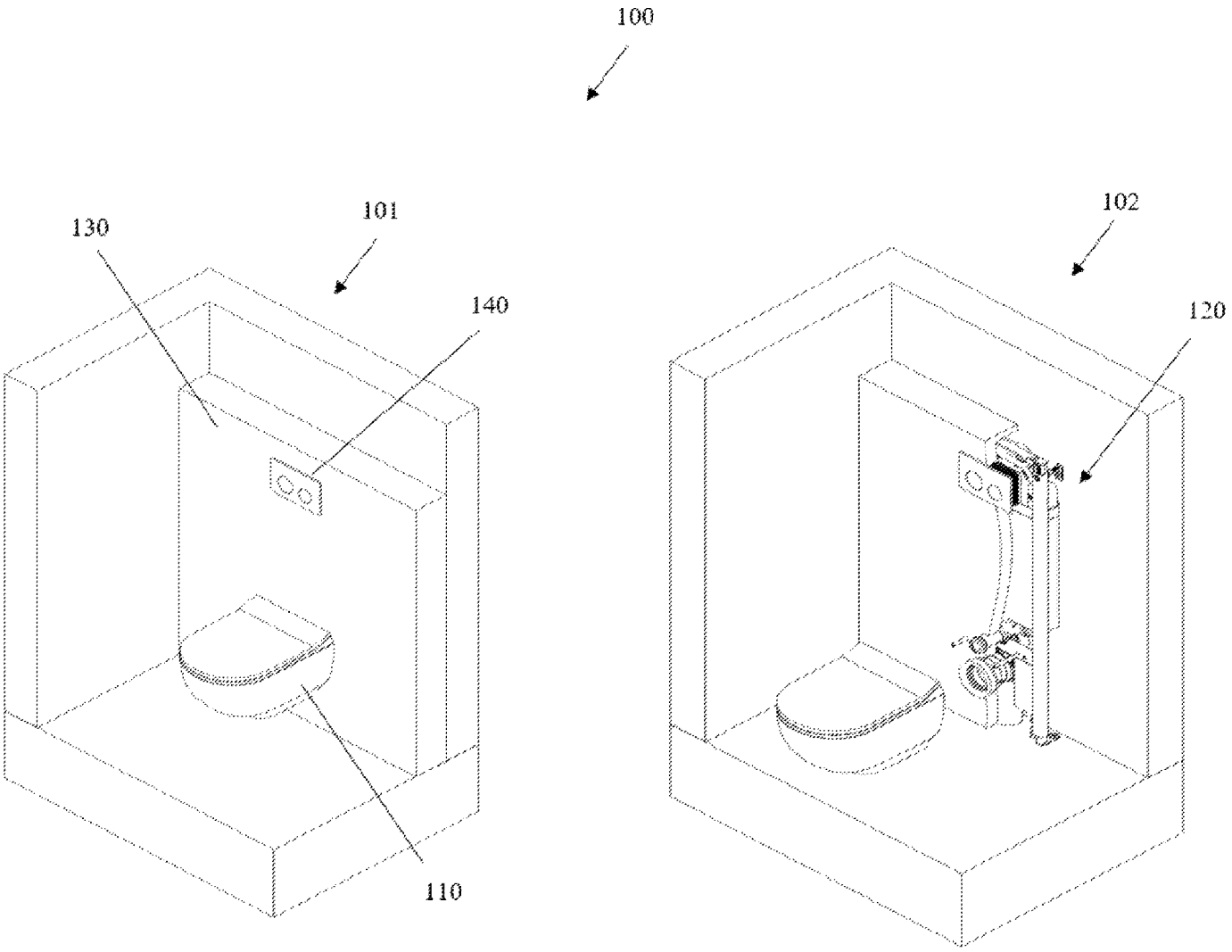

Some embodiments described herein are directed to a cistern system 100 comprising one or more of a frame 301, a cistern assembly 302, and a discharge assembly 303. In some embodiments, the cistern assembly 302 and the discharge assembly 303 are coupled to the frame 301. In some embodiments, the discharge assembly 303 is configured to couple to a toilet 110. In some embodiments, the cistern assembly 302 is configured to couple to the discharge assembly 303. In some embodiments, the cistern assembly comprises one or more adjustable components 4910, 5110, 5640, 3531, 3410, 6201, 3420, 3440, 3440.

In some embodiments, the cistern assembly 100 comprises a maintenance window 140. In some embodiments, wherein the maintenance window 140 is configured to enable an adjustment of at least a portion of each of the one or more adjustable components 4910, 5110, 5640, 3531, 3410, 6201, 3420, 3440, 3440. In some embodiments, wherein the maintenance window 140 is configured to enable an adjustment of at least a portion of each of the one or more adjustable components 4910, 5110, 5640, 3531, 3410, 6201, 3420, 3440, 3440 without uninstalling one or more cistern system 100 components. In some embodiments, wherein the maintenance window 140 is configured to enable an adjustment of at least a portion of each of the one or more adjustable components 4910, 5110, 5640, 3531, 3410, 6201, 3420, 3440, 3440 without uninstalling one or more cistern system 100 components located within the fluid tank 3210.

In some embodiments, the cistern assembly 100 comprises a flush valve assembly 3420, a fill valve assembly 5110, a fluid supply assembly 3410, an actuation assembly 4910, and a flowrate valve 3440. In some embodiments, the cistern assembly 100 is configured to enable at least a portion of the flush valve assembly 3420, the fill valve assembly 5110, the fluid supply assembly 3410, the actuation assembly 4910, and the flowrate valve 3440 are visible through the maintenance window 140.

In some embodiments, the one or more adjustable components 4910, 5110, 5640, 3531, 3410, 6201, 3420, 3440, 3440 comprise a flush timer 5120 at least partially housed within the flush valve assembly 3420. In some embodiments, the flush timer 5120 comprises a timing knob 5640. In some embodiments, the timing knob 5640 is configured to control the release of a flush tube 3440 from the flush valve assembly 3420. In some embodiments, the flush tube 3430 is configured to seat against the flowrate valve 3440 to seal a tank outlet 3250. In some embodiments, the cistern system 100 is configured to enable the timing knob 5640 to visible when looking through the maintenance window 140 along a horizontal axis.

In some embodiments, the one or more adjustable components 4910, 5110, 5640, 3531, 3410, 6201, 3420, 3440, 3440 comprise a fill valve seal 6020 within the fill valve assembly 5110. In some embodiments, the fill valve assembly 5110 comprises a service cap 6010 configured to enable access and/or removal of the fill valve seal 6020. In some embodiments, cistern assembly 100 is configured to enable the service cap 6010 to be visible when looking through the maintenance window 140 along a horizontal axis.

In some embodiments, the one or more adjustable components 4910, 5110, 5640, 3531, 3410, 6201, 3420, 3440, 3440 comprise a flowrate valve adjuster 3531 coupled to the flowrate valve 3440. In some embodiments, the flowrate valve adjuster 3531 is configured to limit and/or increase a fluid flowrate through a tank outlet 3250. In some embodiments, cistern assembly 100 is configured to enable the flowrate valve adjuster 3531 to be visible when looking through the maintenance window 140 along a horizontal axis.

In some embodiments, the flush valve assembly 3420 is configured to be removed from the cistern assembly 100 through the maintenance window 140. In some embodiments, the fill valve assembly 5110 is configured to be removed from the cistern assembly through the maintenance window 140. In some embodiments, the fluid supply assembly 3410 is configured to be removed from the cistern assembly 100 through the maintenance window 140. In some embodiments, the actuation assembly 4910 is configured to be removed from the cistern assembly 100 through the maintenance window 140. In some embodiments, the flowrate valve 3440 is configured to be removed from the cistern assembly 100 through the maintenance window.

In some embodiments, the cistern system further comprises a dosing assembly 6201. In some embodiments, at least a portion of the dosing assembly 6201 is configured to be removed from the cistern assembly 100 through the maintenance window 140. In some embodiments, the flush tube 3430 is configured to be removed from the cistern assembly 100 through the maintenance window.

In some embodiments, the flowrate valve 3440 comprises a flexible handle 3510 accessible through the maintenance window 140. In some embodiments, the cistern assembly 100 comprises a fluid tank 3210. In some embodiments, the flowrate valve 3440 is configured to retrieve a component that has fallen to a bottom of the fluid tank 3210 by pulling at least a portion of the flexible handle 3510 through the maintenance window 140.

In some embodiments, the cistern assembly 100 comprises a fill member 3230 and a dosing member 3240. In some embodiments, the fill member 3230 comprises a fill support structure 3231 comprising one or more openings 3233 configured to enable fluid to flow laterally within the fluid tank 3210 at any fluid level. In some embodiments, the dosing member 3240 comprises a dosing support structure 3241 comprising one or more openings 3243 configured to enable fluid to flow laterally within the fluid tank at any fluid level. In some embodiments, the fill support structure 3231 and the dosing support structure 3241 are each configured to prevent the component that has fallen to the bottom of the tank from falling off the flowrate valve 3440 when the flexible handle 3510 is being pulled through the maintenance window 140.

Figure 2:
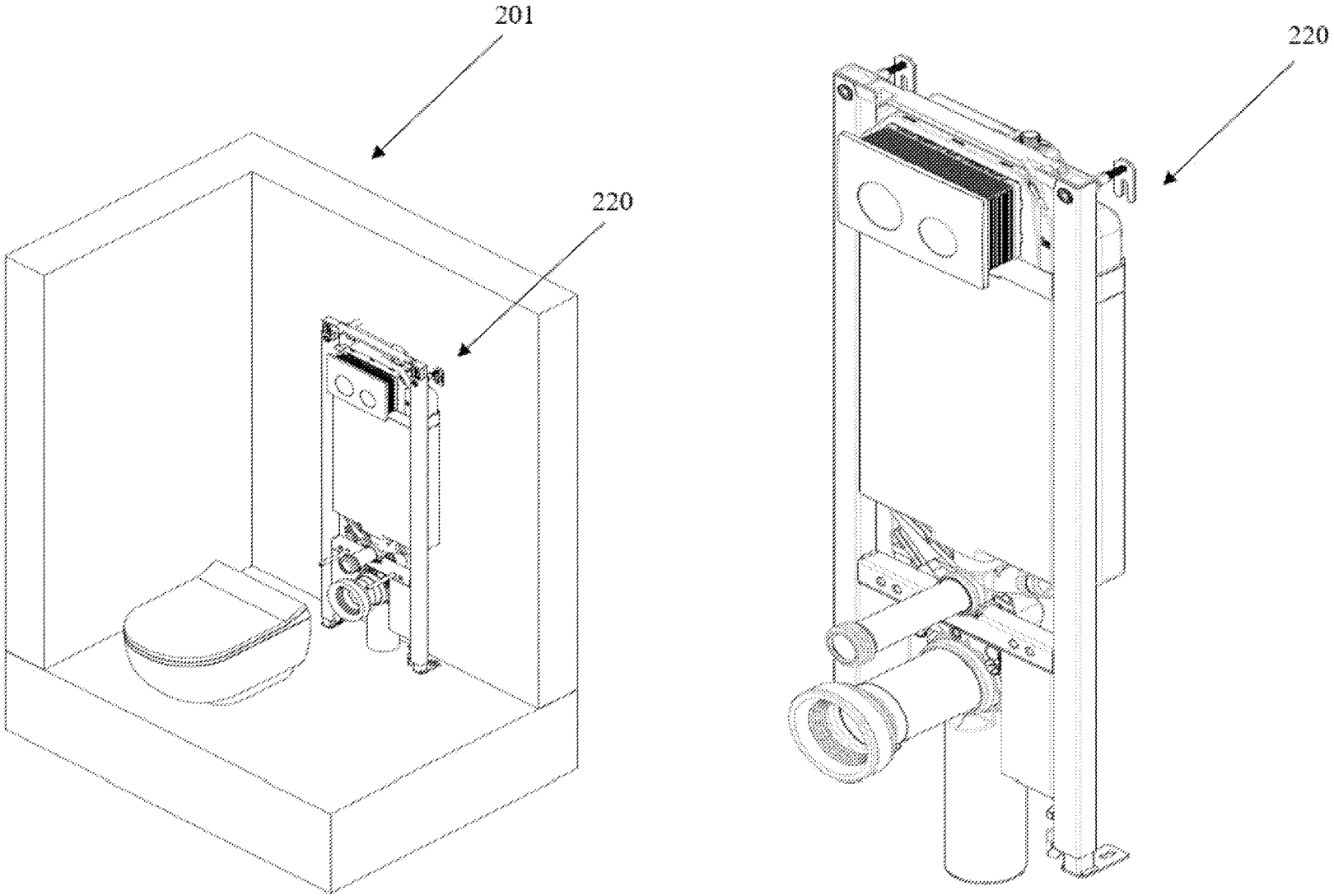
Figure 3:
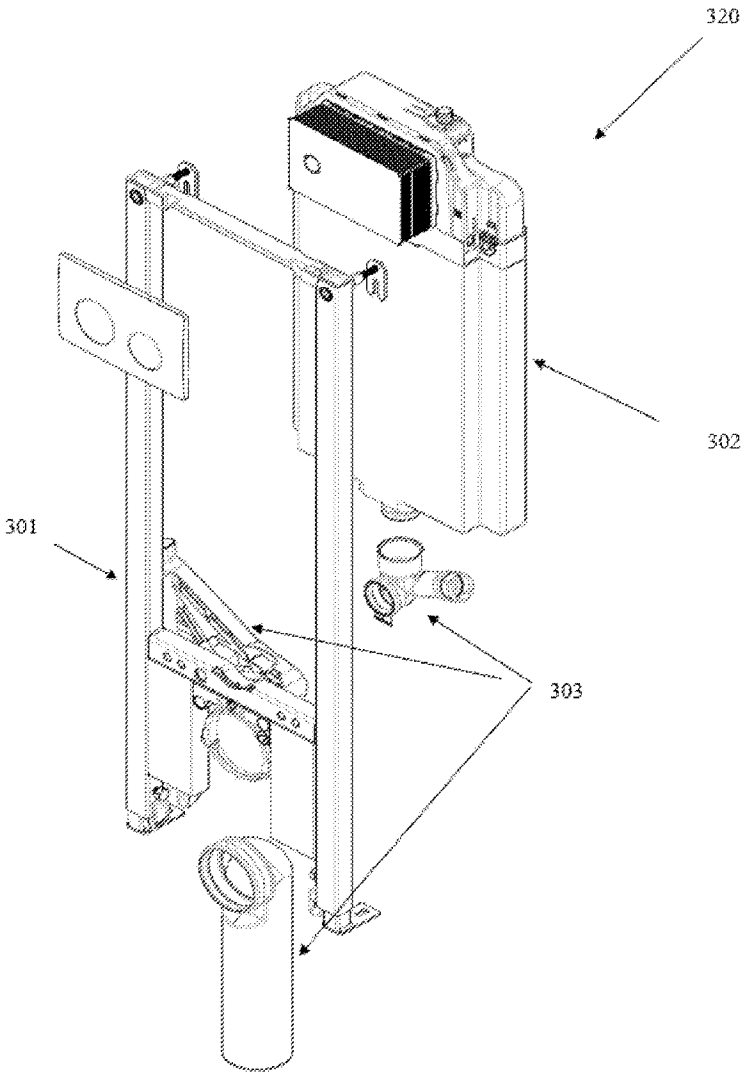
Figure 4:
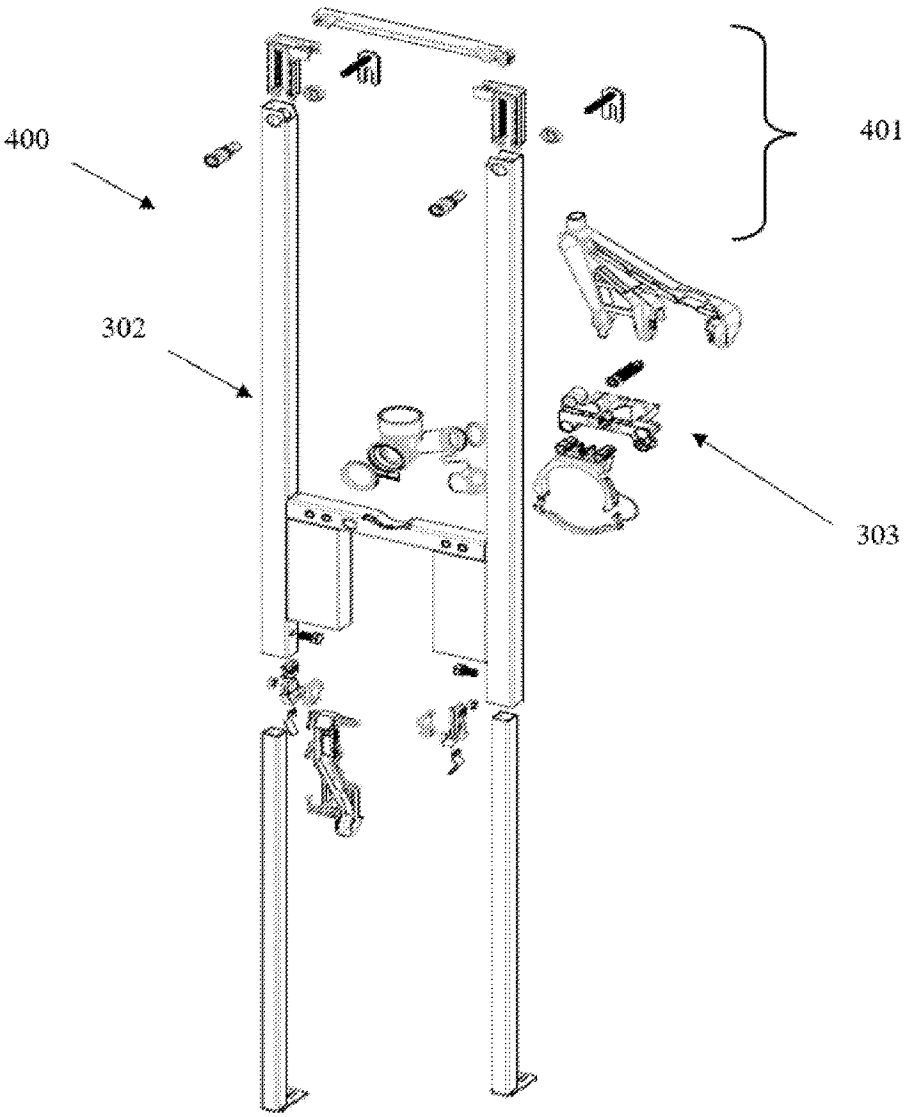
Figure 5:
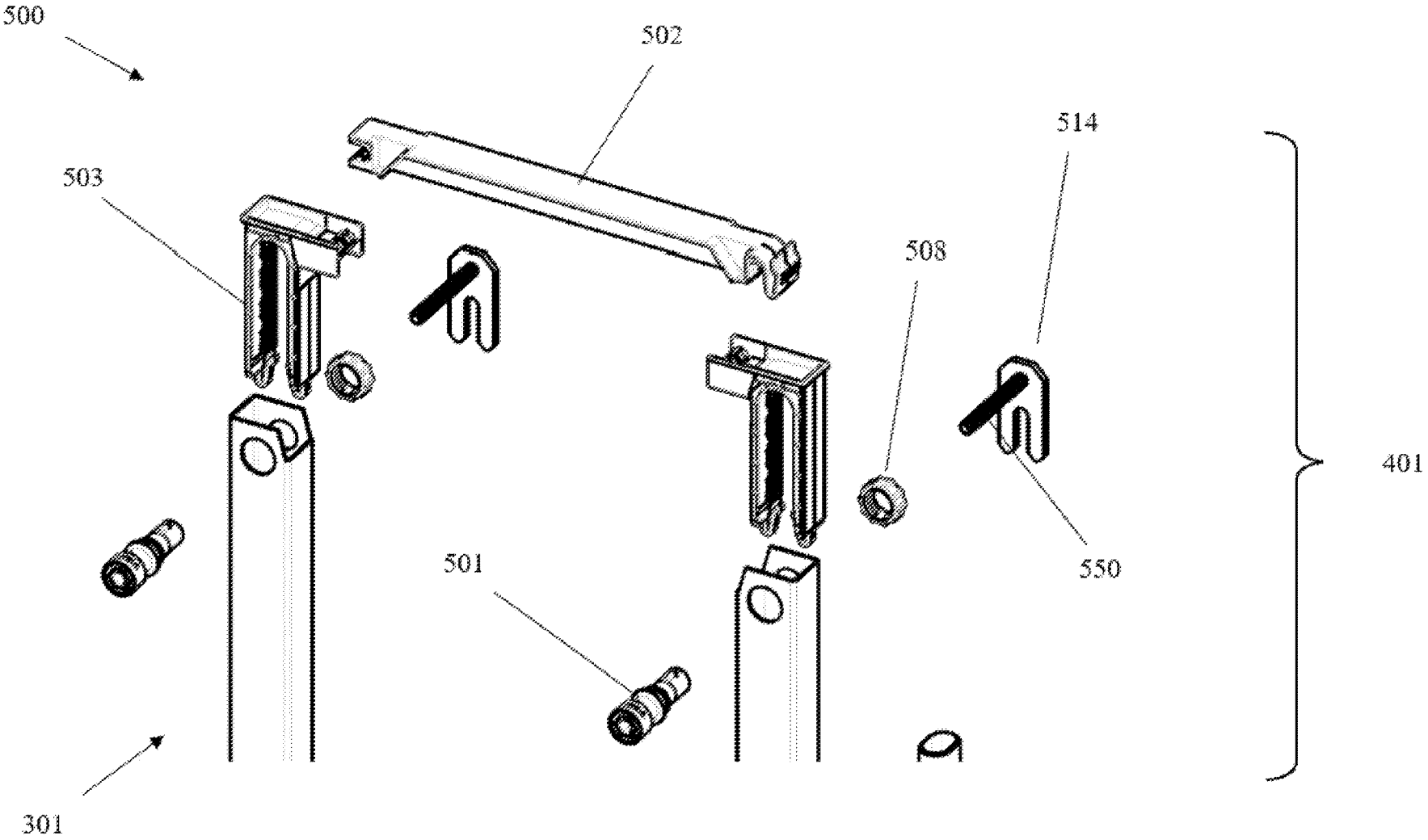

FIG. 1 shows one or more aspects of the system 100 implemented in a bathroom according to some embodiments. In some embodiments, a fully installed system 101 includes a toilet 110 where one or more portions 120 of the system 100 are hidden behind a wall 130 such that only a maintenance window 140 is visible as shown in partial view 102. FIG. 2 shows a perspective view 201 with the wall 130 removed exposing an assembled view 220 of some aspects of the system 100 according to some embodiments. FIG. 3 illustrates and exploded view 320 of the assembled view 220 according to some embodiments. In some embodiments, the system 100 comprises a frame 301, a cistern assembly 302, and a discharge assembly 303. FIG. 4 shows an exploded view 400 of various components of the frame 301 and discharge assembly 303 according to some embodiments. FIG. 5 illustrates a zoomed view 500 of a top portion 401 of the exploded view 400.

In some embodiments, the frame 301 comprises an upper bar 502 which is supported by one or more adjustable bar holders 503. In some embodiments, the system includes one or more wall mounts 514 configured to secure the frame 301 to a vertical wall at one or more rotational orientations about a central access defined by a mount screw 550 configured to couple with and/or interface with a bar holder fastener 501.

Figure 6:
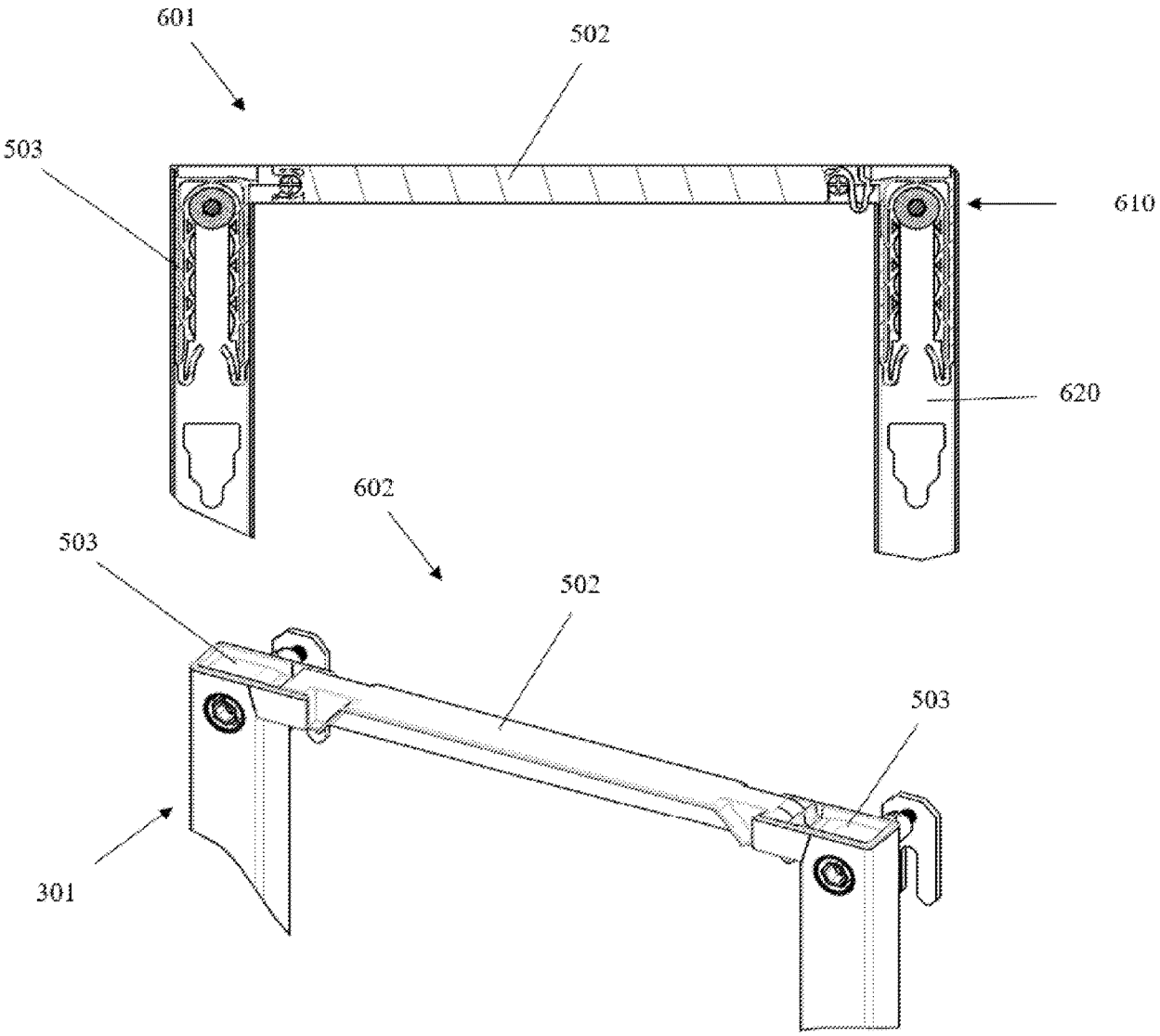

In some embodiments, the one or more adjustable bar holders 503 as well as the upper bar 502 are configured to be moved up or down relative to the floor (the floor defining a horizontal orientation) when the frame 301 is in a vertical orientation by manipulation of one or more bar holder fasteners 501, which also cooperate with one or more nuts 508 as further described herein. FIG. 6 is a sectional view 601 and an isometric view 602 of a top portion of the frame 301 at a first (lowest) position 610 when assembled according to some embodiments. In some embodiments, the one or more adjustable bar holders 503 are fully inserted into a hollow portion 620 of the frame 301 at a first position 610. Although the frame 301 is shown as comprising a square shape, any portion and/or component associated with the frame can comprise any shape including round and/or polygonal according to some embodiments. Any shape of one or more components described in this disclosure according to some embodiments is meant to aid those of ordinary skill in making and using the system and is not intended to be limiting in any way.

Figure 7:
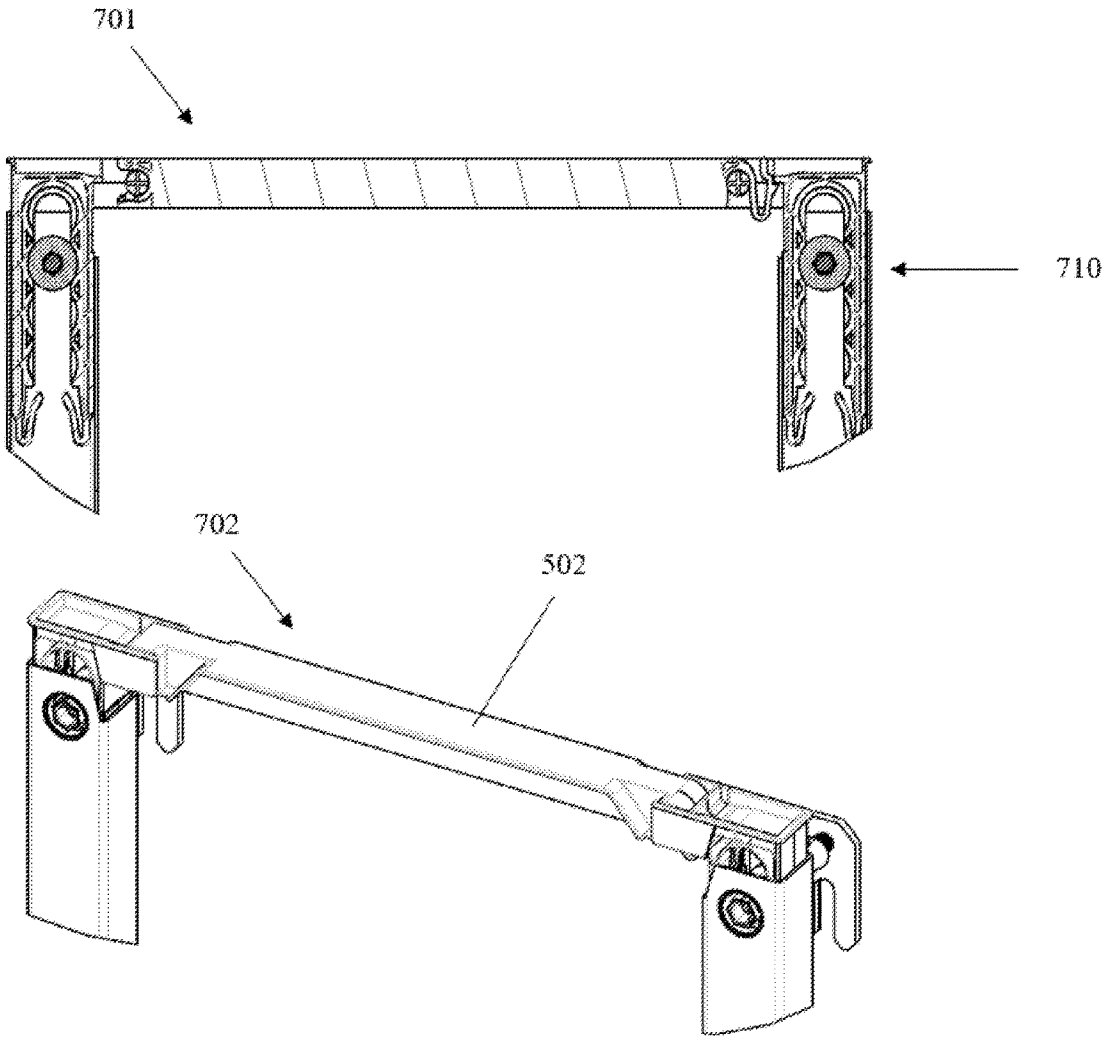
Figure 8:
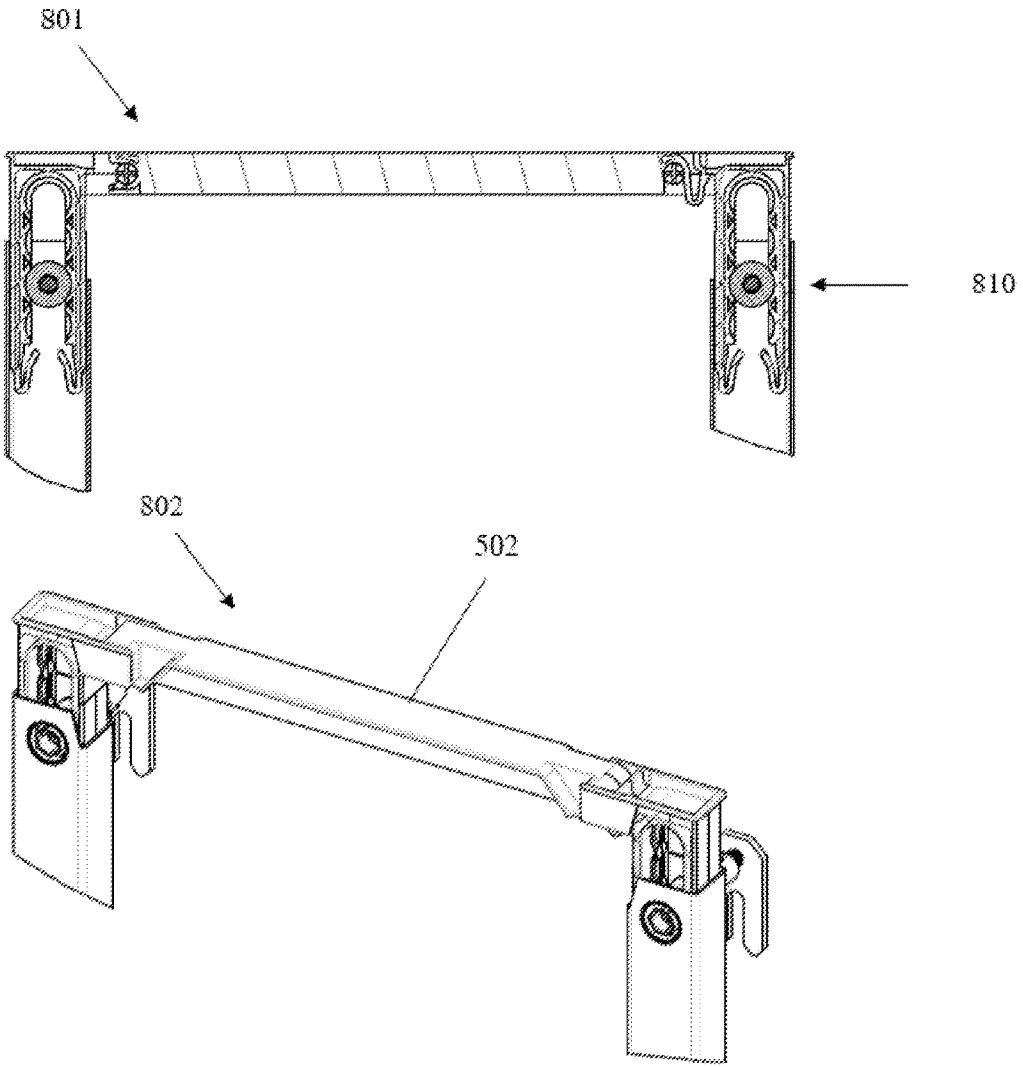
Figure 9:
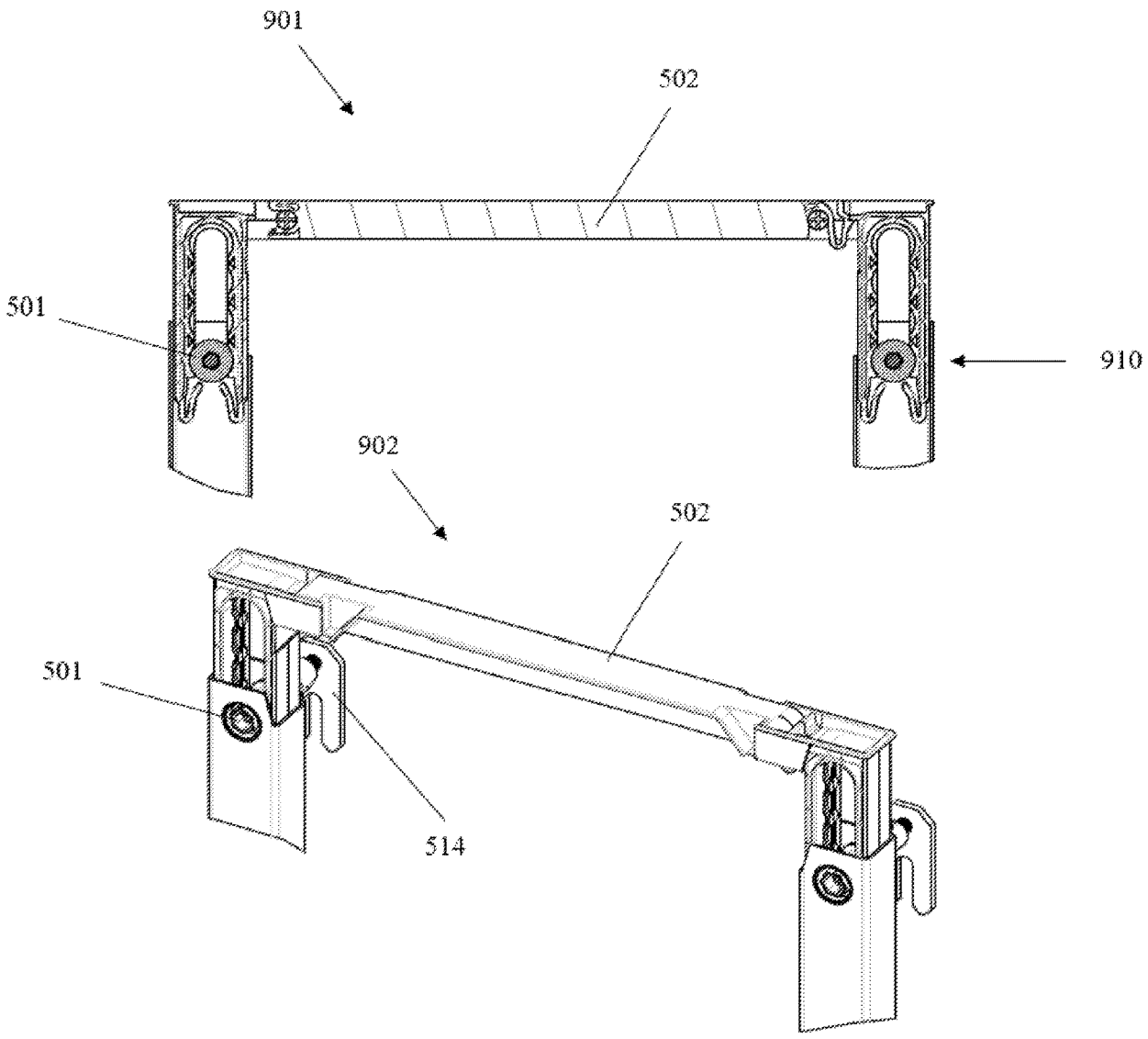

FIG. 7 is a sectional view 701 and an isometric view 702 of the upper bar 502 of a top portion of the frame 301 at a higher second position 710 when assembled according to some embodiments. FIG. 8 is a sectional view 801 and an isometric view 802 of the upper bar 502 at a higher third position 810 when assembled according to some embodiments. FIG. 9 is a sectional view 901 and an isometric view 902 of the upper bar 502 at a higher third position 910 when assembled according to some embodiments. In some embodiments, each level adjustment is a result of the manipulation of one or more bar holder fasteners 501 which also cooperate with one or more nuts 508 as further described in the following figures.

Figure 10:
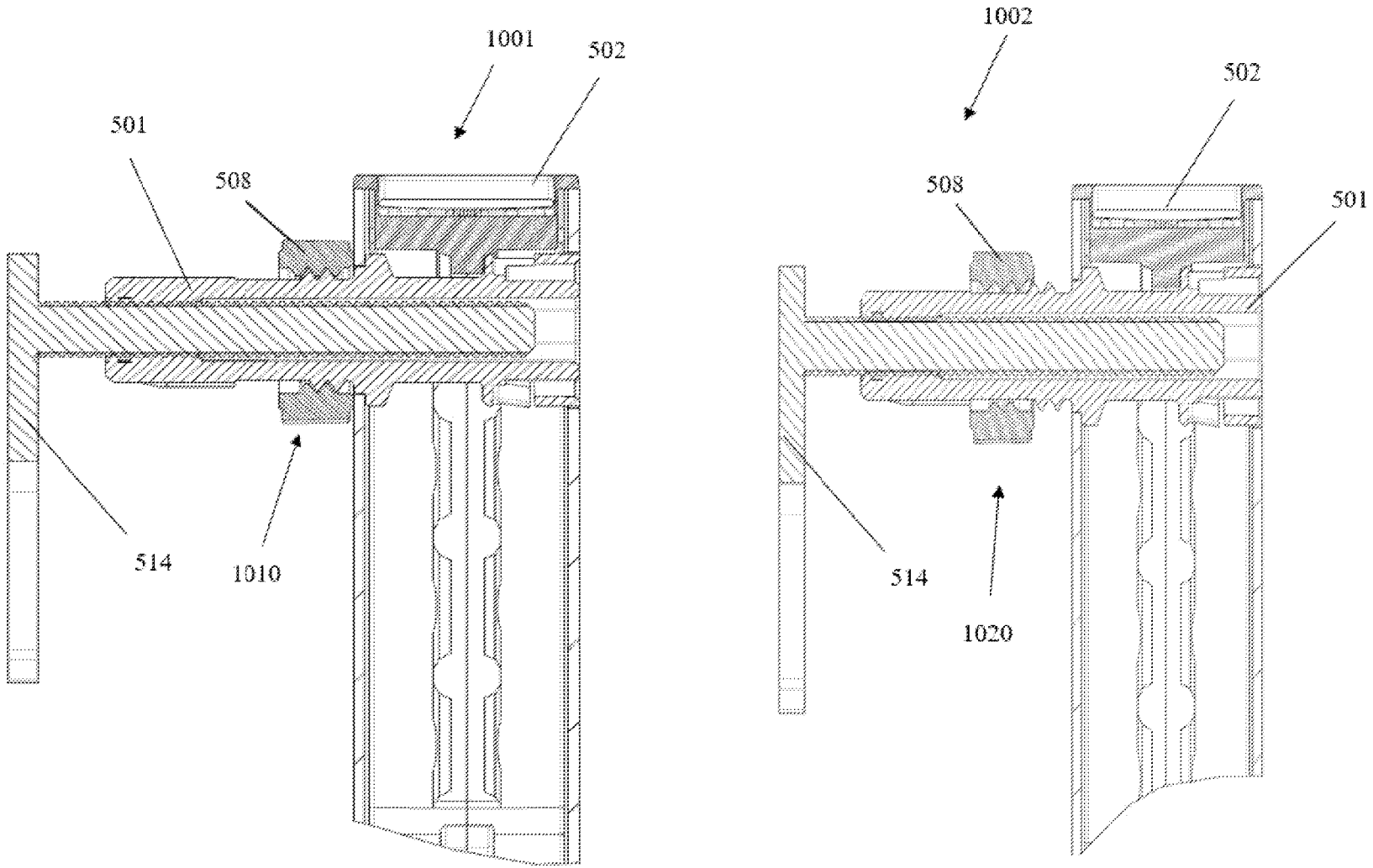
FIG. 10 shows a sectional view 1001 of a fastener (e.g., a nut) 508 in a secured position 1010 and a sectional view 1002 of the same nut 508 in a loosened position 1020.
Figure 11:
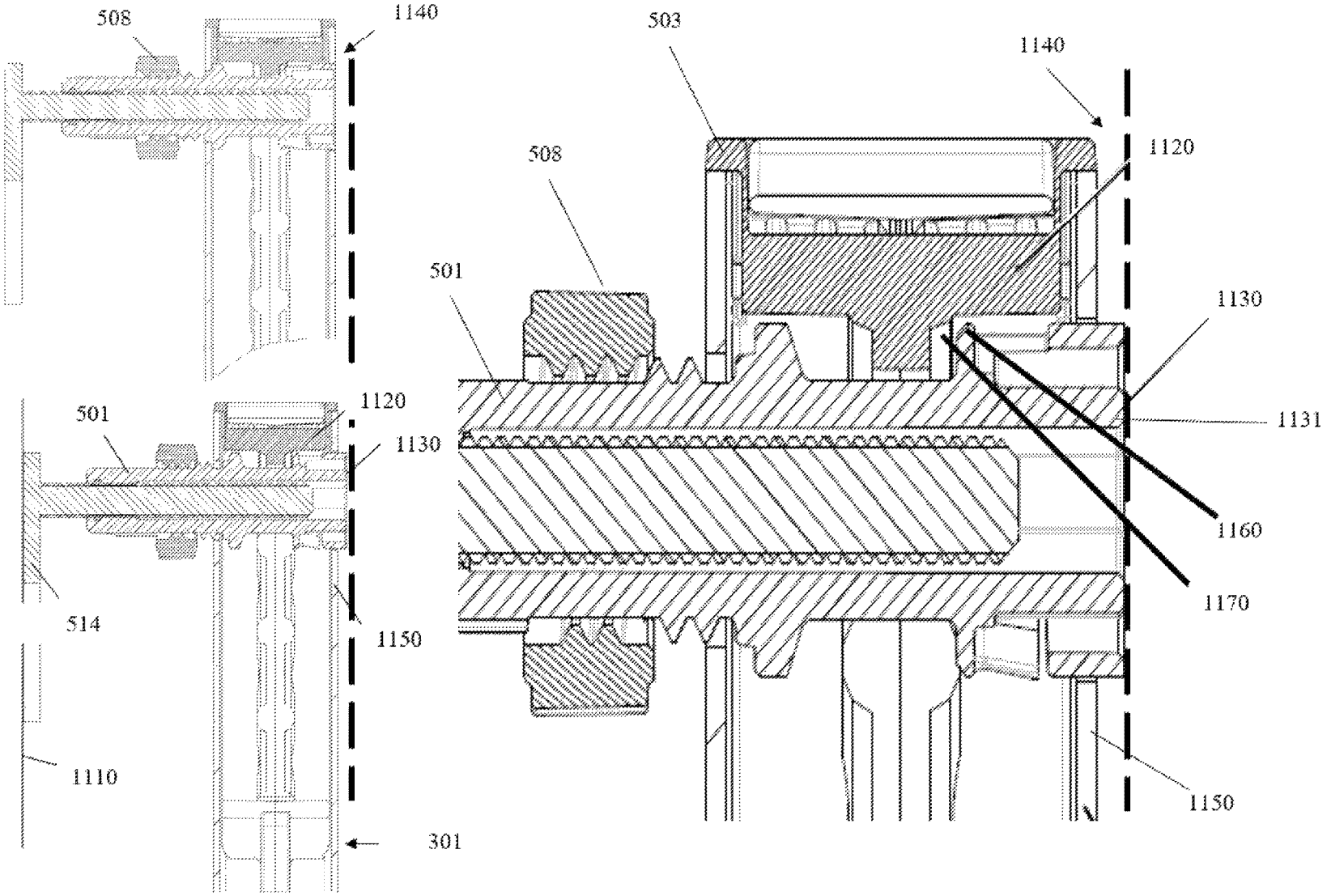
FIG. 11 depicts a movement of the bar holder fastener 501 to a forward position 1130 after loosening the nut 508 according to some embodiments.

FIG. 10 shows a sectional view 1001 of a fastener (e.g., a nut) 508 in a secured position 1010 and a sectional view 1002 of the same nut 508 in a loosened position 1020. FIG. 11 depicts a movement of the bar holder fastener 501 to a forward position 1130 after loosening the nut 508 according to some embodiments. According to a method of adjusting an adjustable upper bar 502 height, the first step is to loosen the nut 508 to create sufficient space to move the bar holder fastener 501 forward as shown in FIG. 11. In some embodiments, when the bar holder fastener 501 is moved forward, it creates a gap 1140 between the a front portion 1131 (relative to a back wall 1110) of the bar holder fastener 501 and the a front portion 1150 of the frame 301. In some embodiments, the forward position 1130 causes one or more locking protrusions 1160 on the bar holder fastener 501 to disengage from a first position seat 1170 located at a top portion 1120 of the adjustable bar holder 503.

Figure 12:
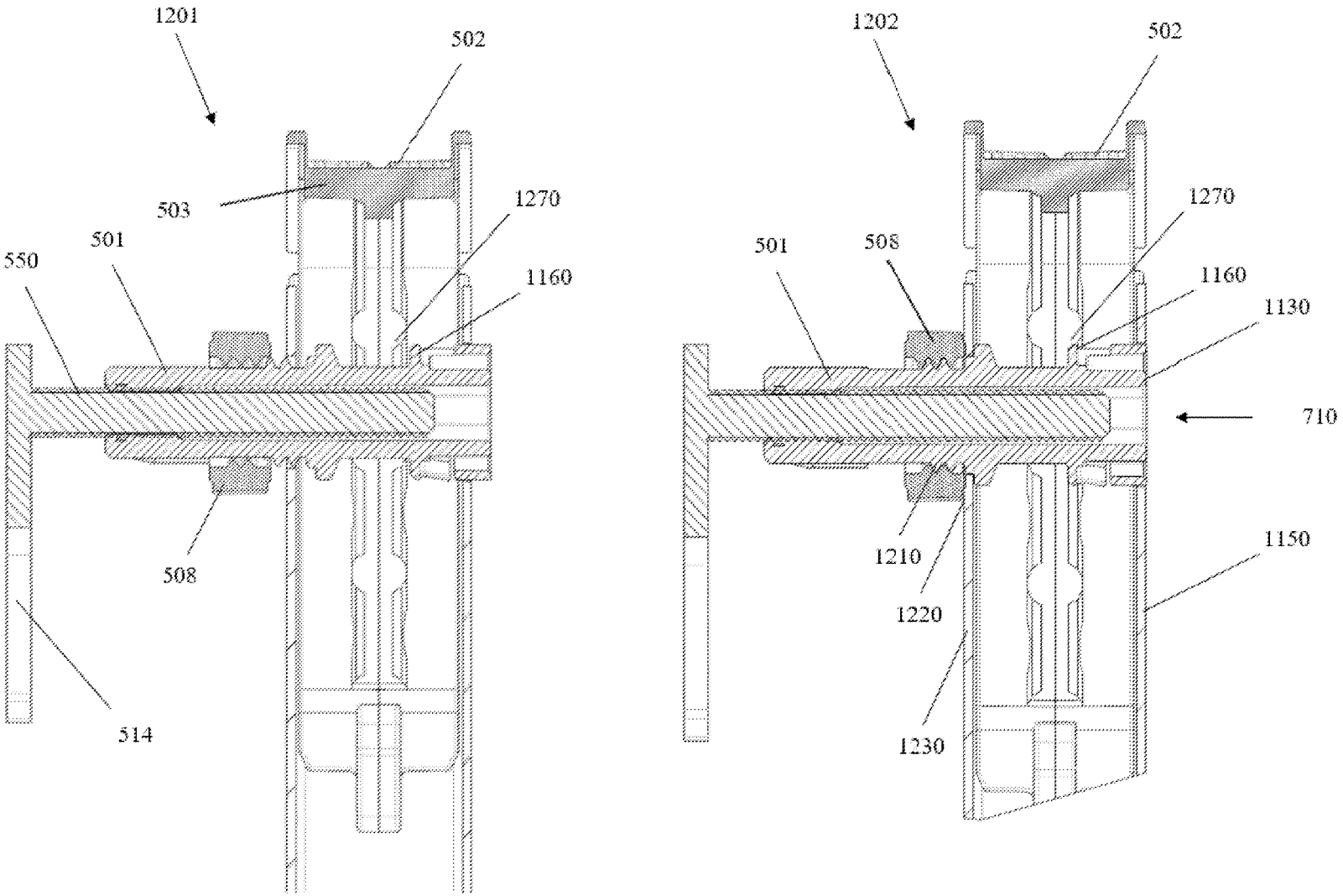
FIG. 12 shows the adjustable bar holder 503 moved to a second position 710 according to some embodiments.

FIG. 12 shows the adjustable bar holder 503 moved to a second position 710 according to some embodiments. In some embodiments, once the adjustable bar 502 and adjustable bar holder 503 have been moved to the second position 710 while the nut 508 is loosened as shown in view 1201, tightening the nut 508 retracts the front portion 1130 of the bar holder fastener 501 toward the adjustable bar holder 503 such that the locking protrusion 1160 engages a second position seat 1270 and locks into place. As evident from the drawings, a wall mount 514 will move with a respective bar holder fastener 501 during height adjustment when a wall mount 514 is not secured to the wall 1110. However, in some embodiments, the entire bar holder fastener 501 is configured to rotate around a fixed mount screw 550 such that the frame 301 can be vertically leveled when the wall mount 514 is secured to a wall 1110.

In some embodiments, the one or more bar holder fasteners 501 are configured to enable at least a portion of the frame 301 to move forward when the one or more wall mounts 514 secure the one or more bare holder fasteners 501 to the wall 1110. In some embodiments, the one or more bar holder fasteners 501 are configured to enable relative motion between the one or more bar holder fasteners 501 and the frame 301. In some embodiments, the one or more bar holder fasteners 501 are configured to enable relative motion between the frame 301 and the one or more wall mounts 514.

Figure 13:
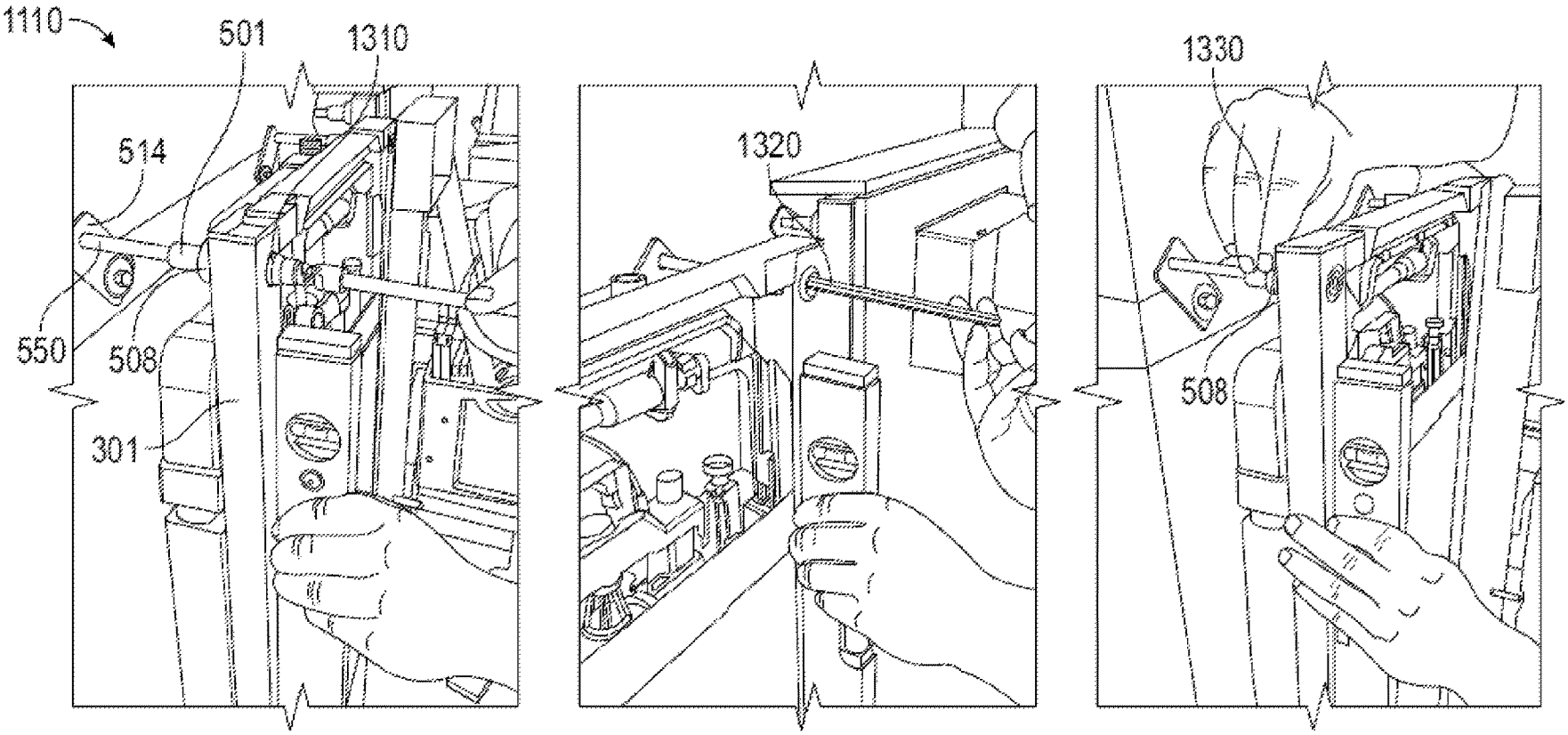
FIG. 13 illustrates leveling the frame 301 with one or more wall mounts 514 secured to a wall 1110 according to some embodiments.

FIG. 13 illustrates leveling the frame 301 with one or more wall mounts 514 secured to a wall 1110 according to some embodiments. In some embodiments, the system is configured to provide the advantage of being able to execute one or more leveling operations when the one or more wall mounts 514 are secured to the wall. In some embodiments, the wall mount 514 can be attached to the wall 1110 at any rotation angle, which is beneficial for coupling the wall mount 514 to the most secure location on a wall 1110.

According to a method, with the wall mount 514 coupled to the wall 1110 and the nut 508 in a loosened position, rotation of the bar holder fastener 501 using a rotational tool interface such as socket connection 1310 or an Allen wrench (i.e., hex key) connection 1320 enables the bar holder fastener 501 along with the entire frame 301 to move back or forth along the mount screw 550. In some embodiments, once the frame 301 is in a desired orientation, the nut 508 can be tightened 1330 against the back 1230 of the frame 301 such that a friction force between threads 1210 on the bar holder fastener 501 and a front face 1220 of the nut 580 against the back 1230 of the frame 301. In some embodiments, this prevents further rotation and secures both the position of the upper bar holder 503 and the position of the bar holder fastener 501 along the mount screw 550. Advantageously, the upper bar 502 can be pivoted and or removed from one or more upper bar holders 503 to facilitate installation of one or more components according to some embodiments.

Figure 14:
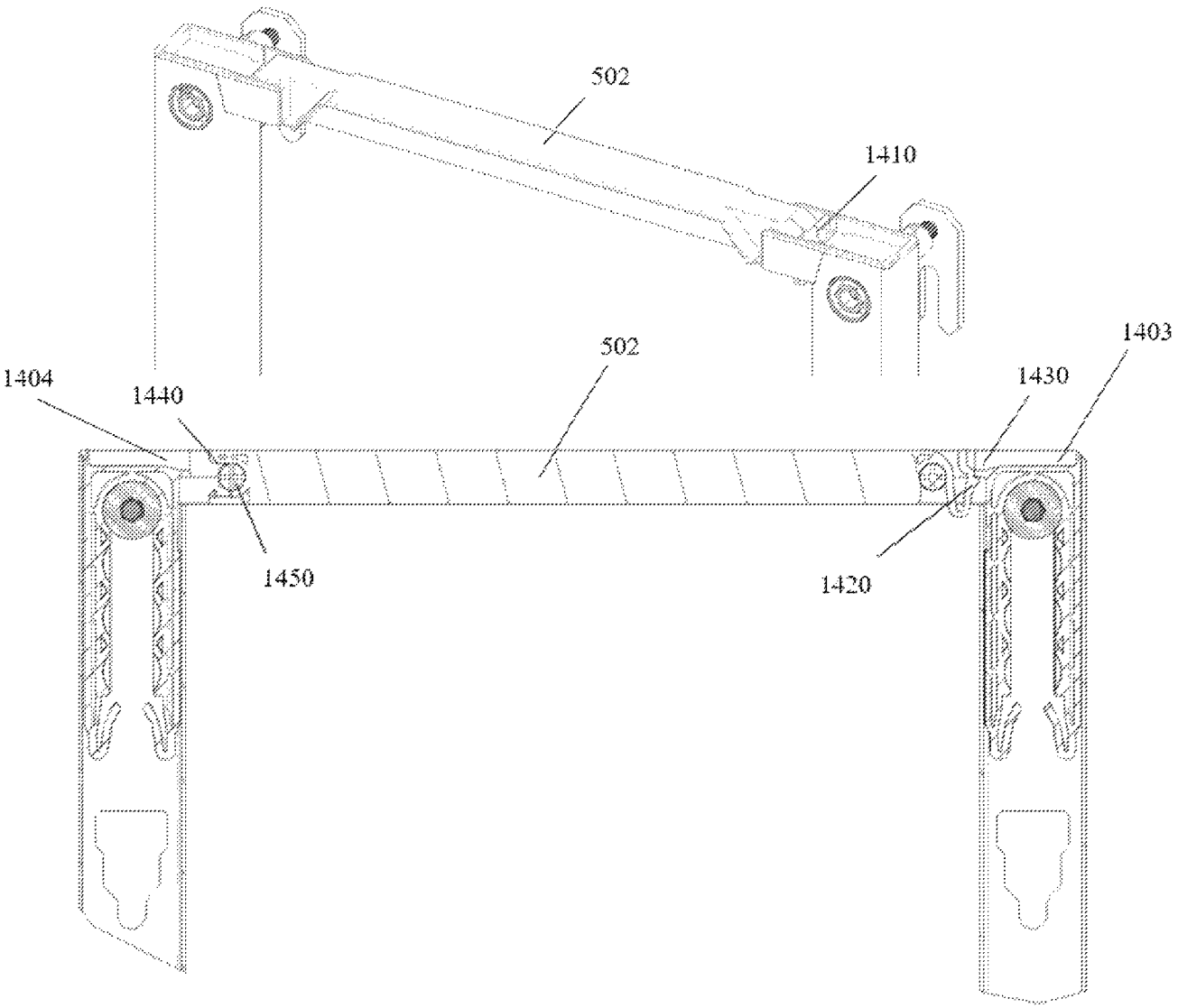
FIG. 14 show features of a first upper bar holder 1403 and a second upper bar holder 1404 enabling the pivoting and/or removal of the upper bar 502 according to some embodiments.
Figure 15:
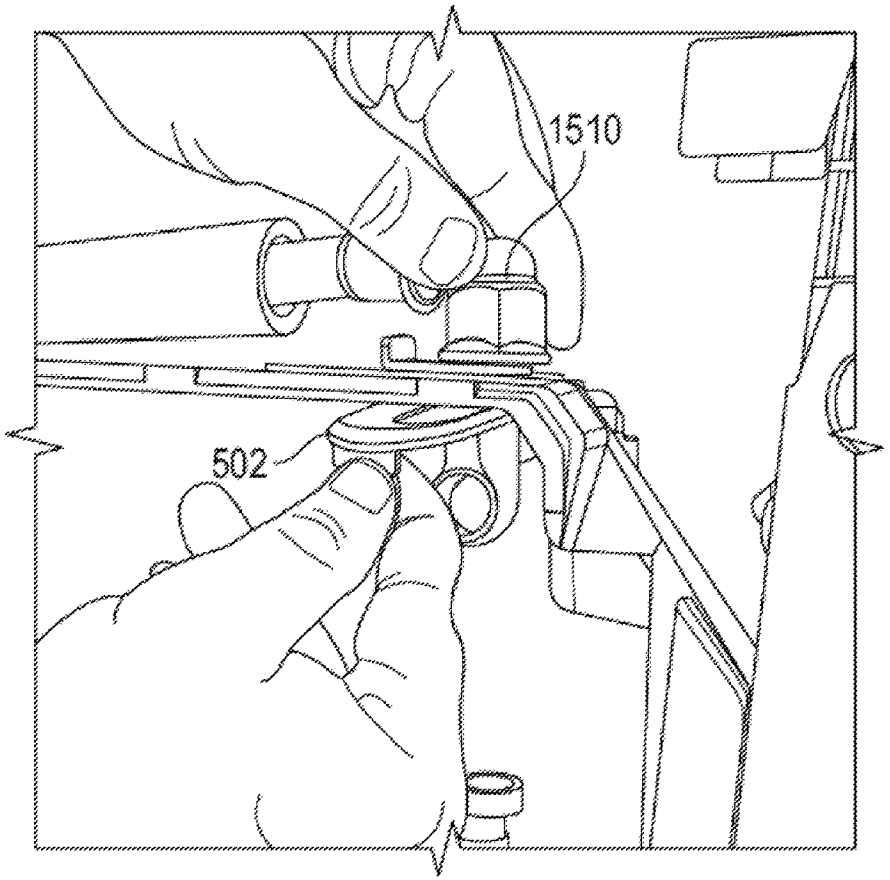
FIG. 15 shows the upper bar 502 completely separated 1501 to enable installation of a fluid supply line 1510 once the frame 301 has been secured in place according to some embodiments.
Figure 15:
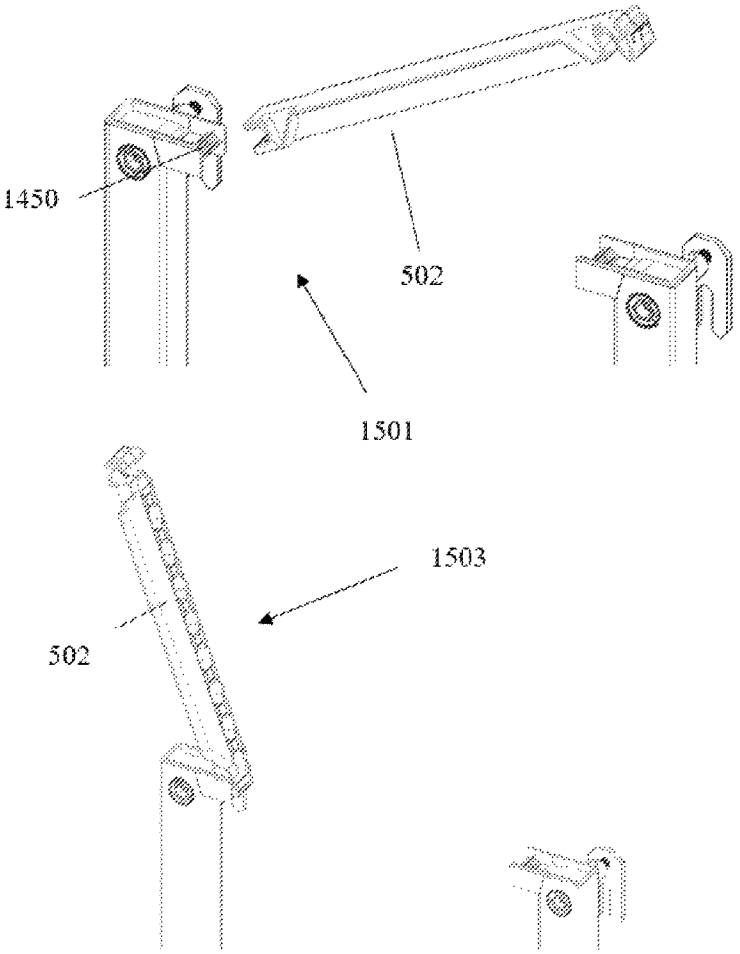

FIG. 14 show features of a first upper bar holder 1403 and a second upper bar holder 1404 enabling the pivoting and/or removal of the upper bar 502 according to some embodiments. In some embodiments, the upper bar 502 comprises a flexible latch 1410 that includes a latch seat 1420 configured to mate with a latch protrusion 1430 on a first upper bar holder 1403. In some embodiments, squeezing the flexible latch 1410 disengages the latch seat 1420 from the latch protrusion 1430 such that the upper bar 502 can be lifted and rotated about a pivot arm 1450 on a second upper bar holder 1404. In some embodiments, the upper bar 502 comprises a slot 1440 configured to enable the bar to slide away from the pivot arm 1450 such that the upper bar 502 can be completely removed. FIG. 15 shows the upper bar 502 completely separated 1501 to enable installation of a fluid supply line 1510 once the frame 301 has been secured in place according to some embodiments. In some embodiments, the upper bar 502 could be pivoted upwards 1503 where it rests against a portion of the upper bar holder 1404 and/or is supported by the pivot arm 1450. In some embodiments, after installation of one or more components, the upper bar 502 can be returned to and/or secured in its lower substantially horizontal position where it is configured to protect the fluid supply line 1510 and enable connection of one or more other system 100 components.

Figure 16:
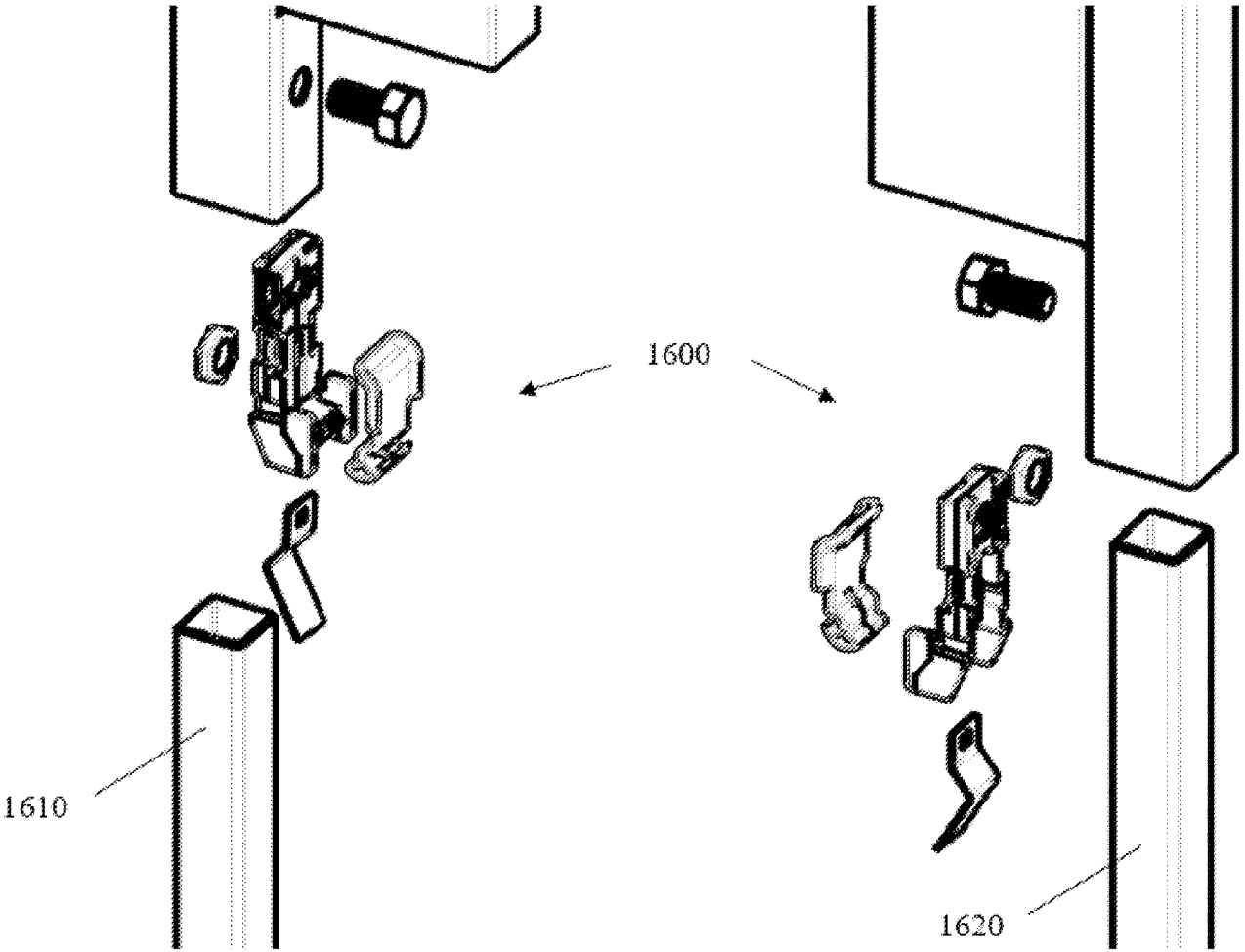
FIG. 16 shows aspects of the system that include one or more frame height adjusters 1600.
Figure 17:
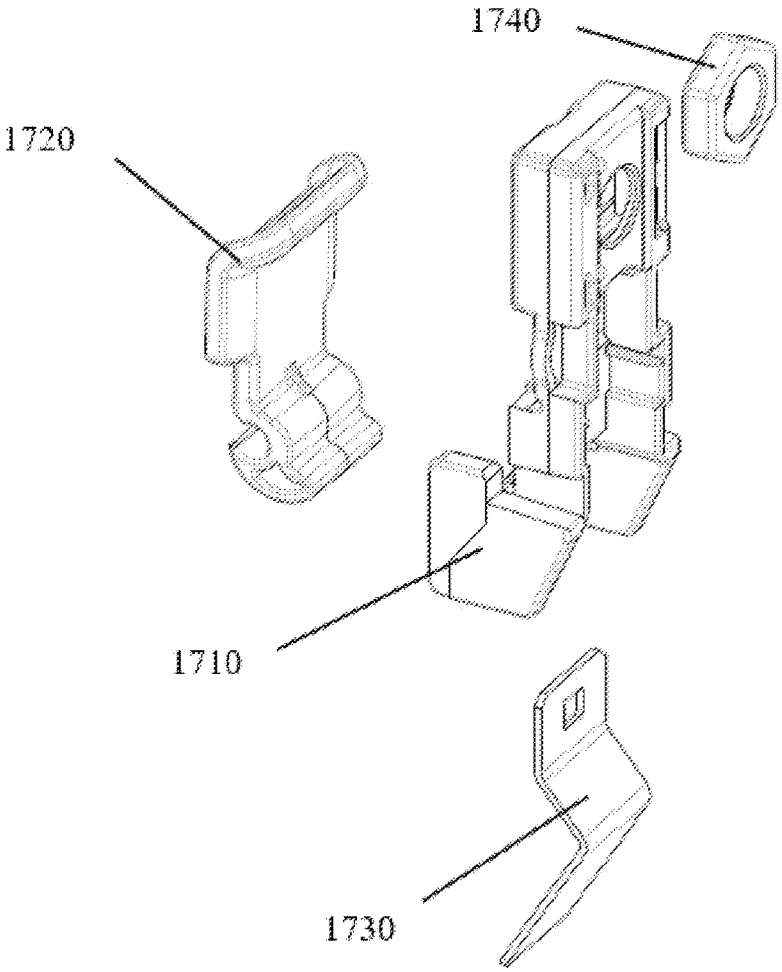
FIG. 17 shows various components of a frame height adjuster 1600 according to some embodiments.

FIG. 16 shows aspects of the system that include one or more frame height adjusters 1600. In some embodiments, the one or more frame height adjusters 1600 enable one or more adjustable frame supports 1610, 1620 to slide within the frame 301 such that one or more adjustable frame supports 1610, 1620 can be set at different heights to enable leveling of the frame 301 on an uneven surface. FIG. 17 shows various components of a frame height adjuster 1600 according to some embodiments. In some embodiments, a frame height adjuster 1600 includes one or more of a brake housing 1710, a brake handle 1720, a brake spring 1730, and a brake nut 1740.

Figure 18:
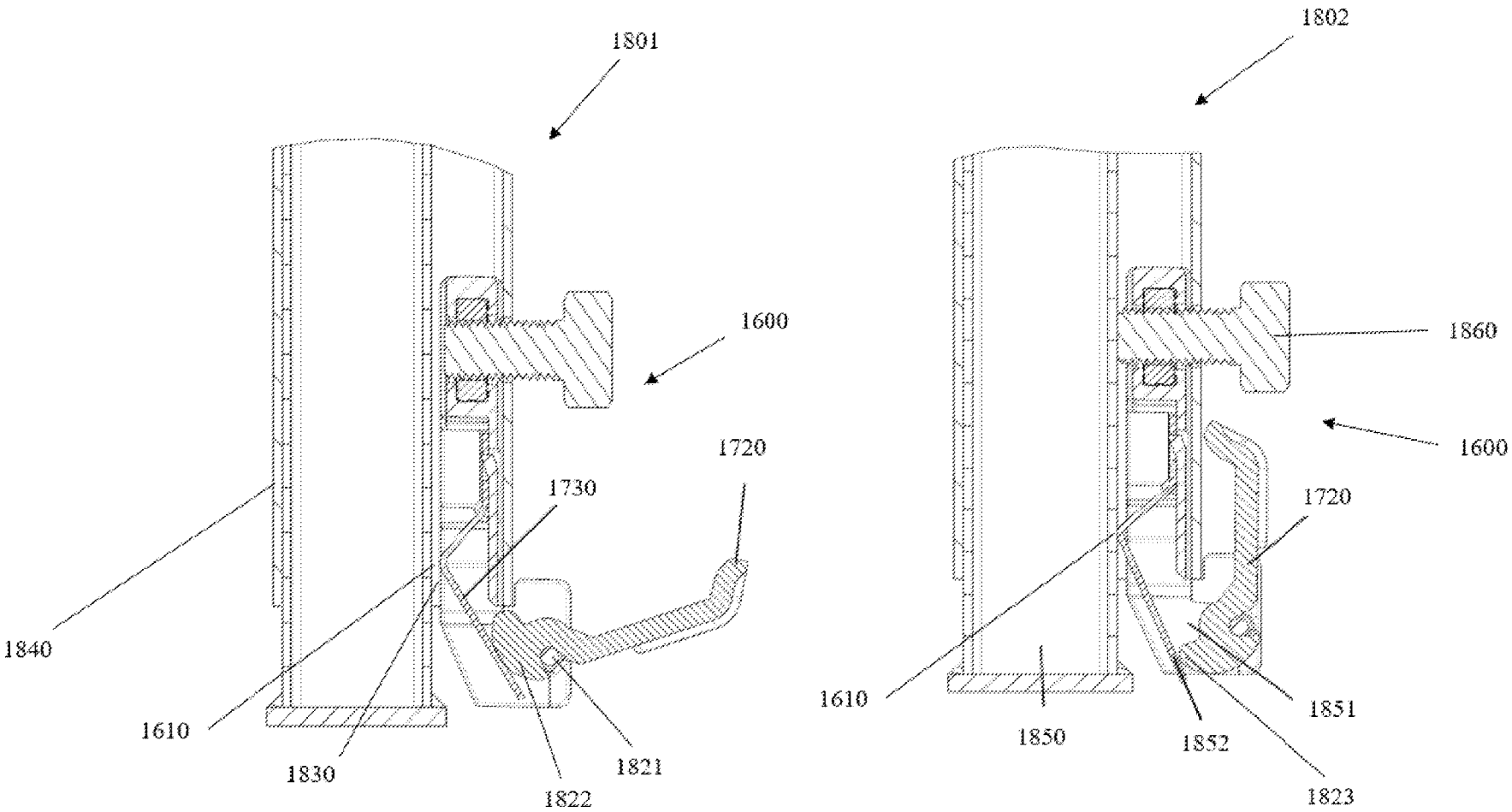
FIG. 18 shows a frame height adjuster 1600 in a disengaged 1801 and an engaged 1802 position according to some embodiments.

FIG. 18 shows a frame height adjuster 1600 in a disengaged 1801 and an engaged 1802 position according to some embodiments. In some embodiments, in a disengaged position 1801, the brake handle 1720 is rotated downward about a pivot 1821 such that a handle cam 1822 allows the brake spring 1730 to separate from the adjustable frame support

1610 creating a gap 1830 which enables the adjustable frame support 1610 to slide within a bottom portion 1840 of the frame 301.

In some embodiments, in a disengaged position 1801, the frame height adjuster 1600 is configured to enable the adjustable frame support 1610 move with no friction force or substantially no friction force from the brake, which improves safety by requiring less effort for adjustments. In some embodiments, in a disengaged position, the frame height adjuster 1600 is configured to enable the adjustable frame support 1610 to slide out of the frame 301 with no additional force other than gravity acting of the mass of the adjustable frame support 1610.

In some embodiments, in an engaged position 1802 the brake handle 1720 is rotated upward such that a front lobe 1823 of the handle cam 1822 moves the brake spring 1730 from its disengaged position 1851 to its engaged position 1852 pressing the break spring against the adjustable frame support 1610 and providing friction force to hold the adjustable frame support 1610 in a desired position 1850.

Advantageously, the frame height adjuster 1600 is configured to apply enough friction force against the adjustable frame support 1610 to support the weight of the system 100 and its various components, while allowing the adjustable frame support to slide withing the bottom portion 1840 when an additional downward force (e.g., more than 10 lbf) is applied to the top of the frame 301. In some embodiments, the frame height adjuster 1600 is configured to allow rough adjustment of one or more adjustable frame supports 1610 in a disengaged position 1801. In some embodiments, the frame height adjuster 1600 is configured to enable fine horizontal leveling by adding downward force to the frame 301 while the frame height adjuster 1600 is in an engaged position 1802.

Figure 19:
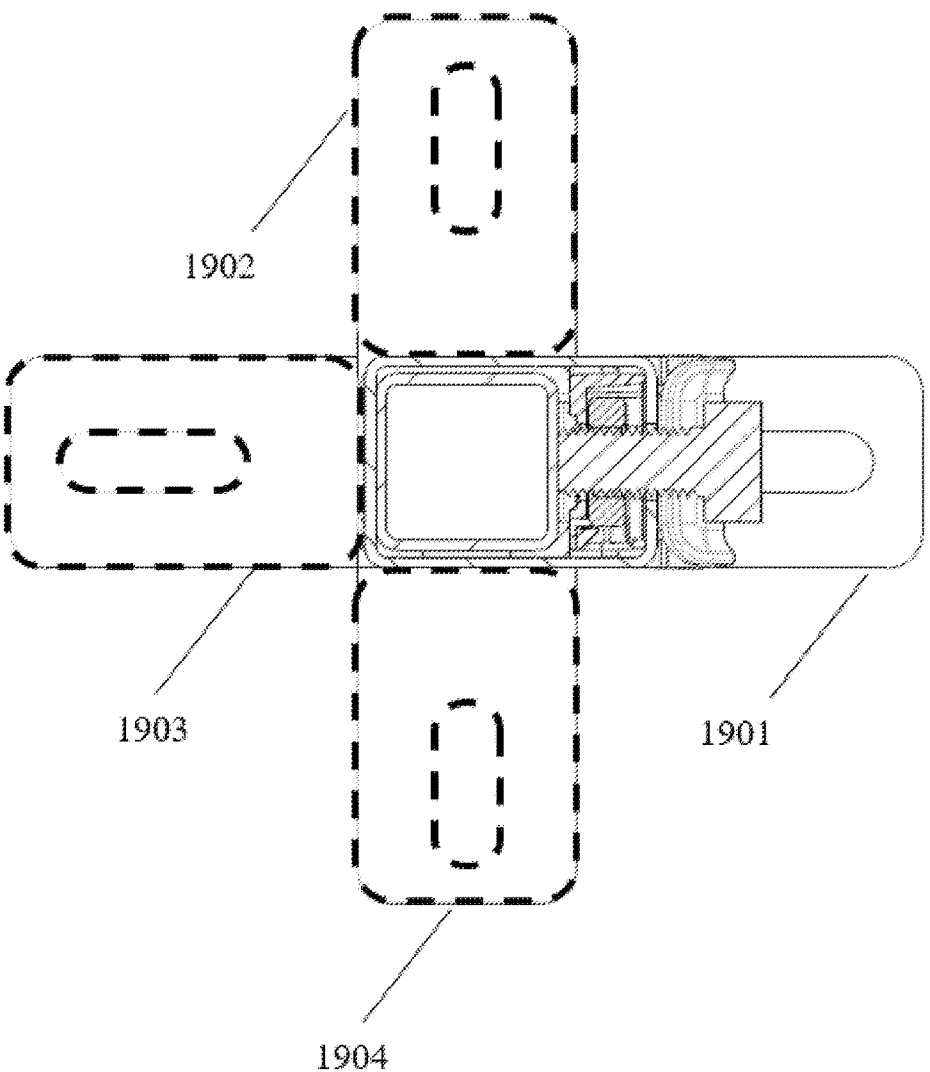
FIG. 19 depicts an adjustable frame support 1610 being completely removed from a bottom portion 1840 of the frame 301 and rotated in various positions 1901, 1902, 1903, and 1904 to enable the adjustable frame support 1610 to couple to the most secure location on a floor.
Figure 19:
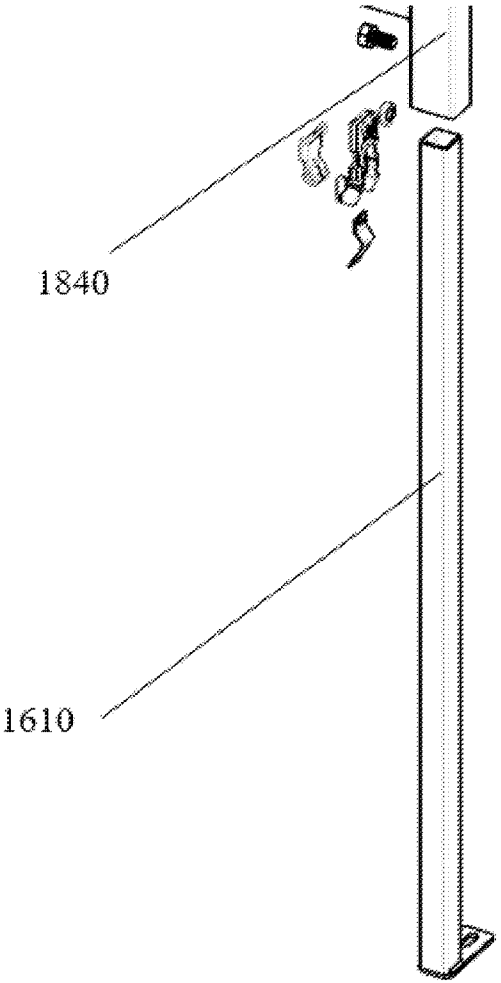

In some embodiments, to fully secure an adjustable frame support 1610 in place, the frame 301 is configured to enable a locking screw 1860 to be tightened against and/or into the adjustable frame support 1610 to lock the adjustable frame support in place. FIG. 19 depicts an adjustable frame support 1610 being completely removed from a bottom portion 1840 of the frame 301 and rotated in various positions 1901, 1902, 1903, and 1904 to enable the adjustable frame support 1610 to couple to the most secure location on a floor. Although the adjustable frame support 1610 is shown as square in this example, it can be any shape including round and/or polygonal according to some embodiments, allowing for infinite rotational positions.

Figure 20:
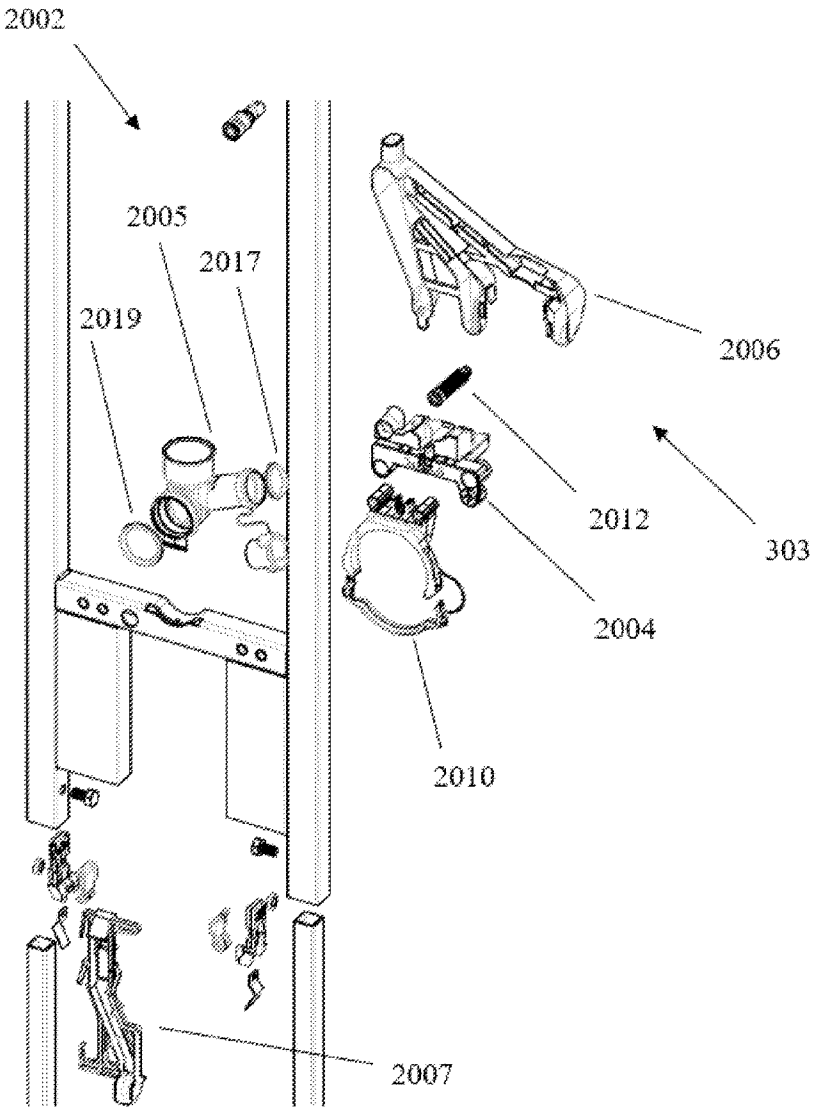
FIG. 20 shows an assembled view 2001 and a disassembled view 2002 of the discharge assembly 303.
Figure 20:
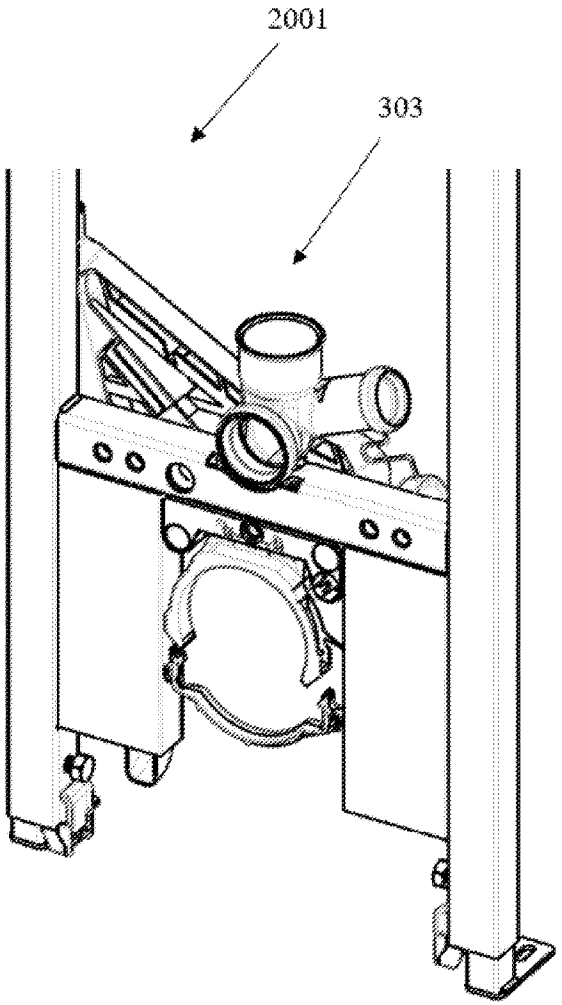
Figure 21:
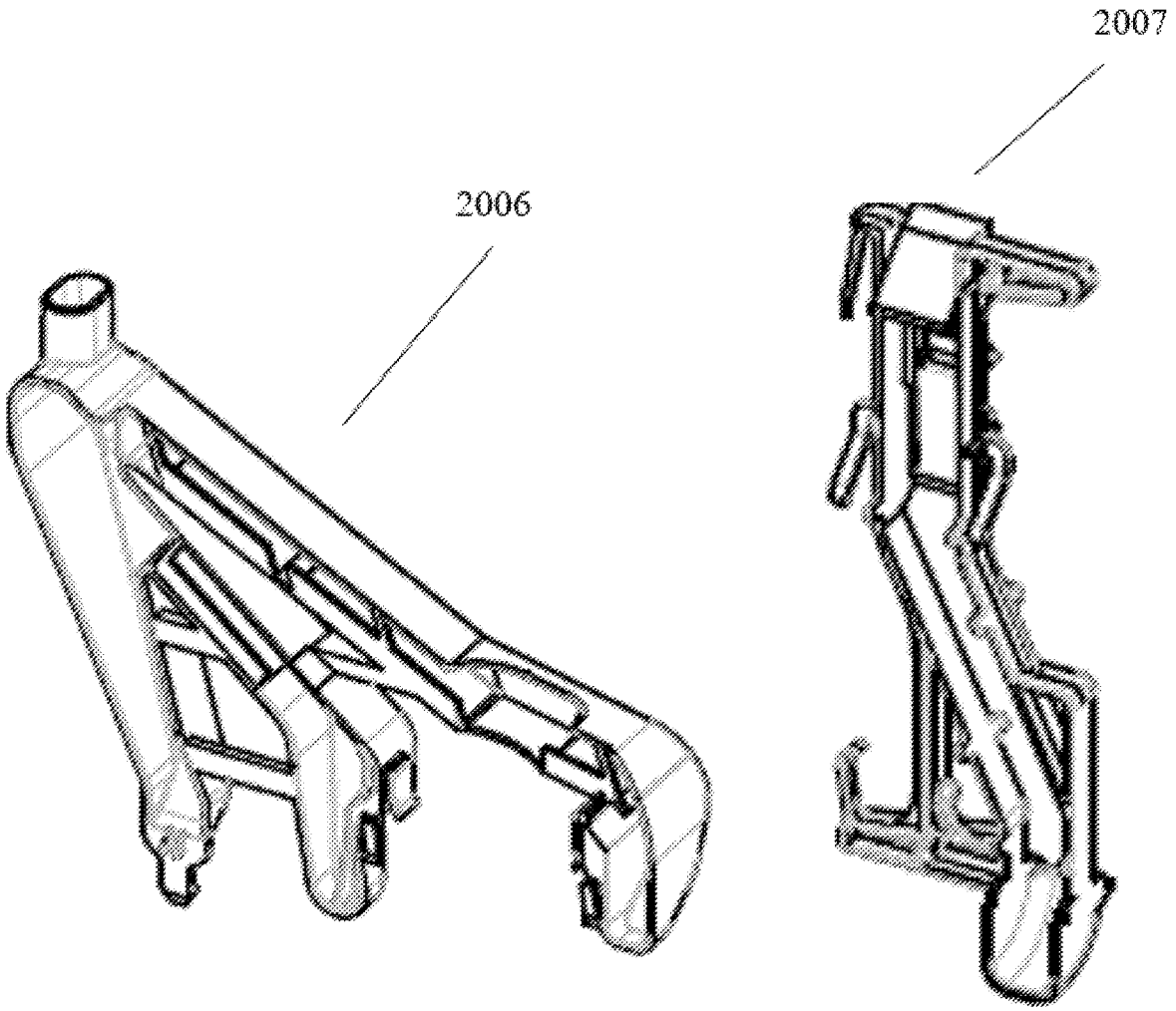
FIG. 21 shows further details of the upper tube support 2006 and lower tube guide support 2007, which couple to the frame 301 and assist with routing and/or management of various system inputs such as pipes and hoses according to some embodiments.

FIG. 20 shows an assembled view 2001 and a disassembled view 2002 of the discharge assembly 303. In some embodiments, the discharge assembly comprises a discharge pipe fixer 2010, a pipe fixer holder 2004, a pipe fixer adjuster 2012, an upper tube support 2006, a lower tube support 2007, a flush pipe 2005, an air vent seal 2017, and a front seal 2019. FIG. 21 shows further details of the upper tube support 2006 and lower tube guide support 2007, which couple to the frame 301 and assist with routing and/or management of various system inputs such as pipes and hoses according to some embodiments.

Figure 22:
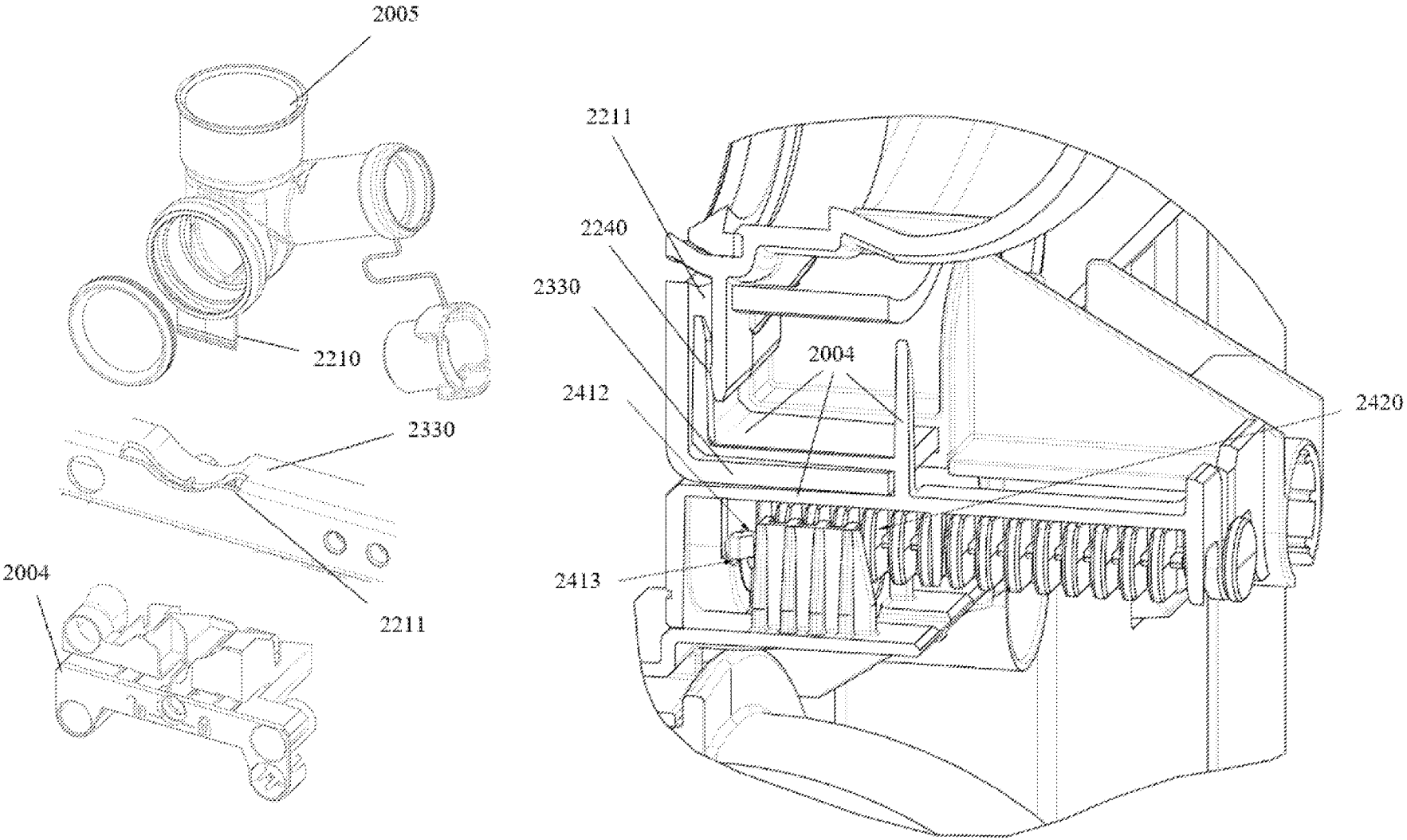
FIG. 22 illustrates where the flush pipe 2005 elbow rib 2210 is inserted into the bottom bar slot 2211 which is located on a substantially "u-shaped" bottom bar 2330 in this non-limiting example according to some embodiments.

FIG. 22 illustrates where the flush pipe 2005 elbow rib 2210 is inserted into the bottom bar slot 2211 which is located on a substantially "u-shaped" bottom bar 2330 in this non-limiting example according to some embodiments. In some embodiments, a least a portion of the pipe fixer holder 2004 is configured to couple to the bottom bar 2330. n some embodiments, a least a portion of the pipe fixer holder 2004 is configured to couple to the bottom bar by one or more snap tabs 2910 interfacing with one or more bar slots 2920 located on the bottom bar 2330. In some embodiments, the elbow rib 2210 is configured to prevent forward, backward, and/or lateral movement of the flush pipe 2005. In some embodiments, the elbow rib 2210 is configured to snap fit to the pipe fixer holder 2004 at a snap fit interface 2240. In some embodiments, the flush pipe 2005 is configured to couple to the a tank outlet 3250 and guide the fluid from the tank outlet 3250 into the toilet 110.

Figure 23:
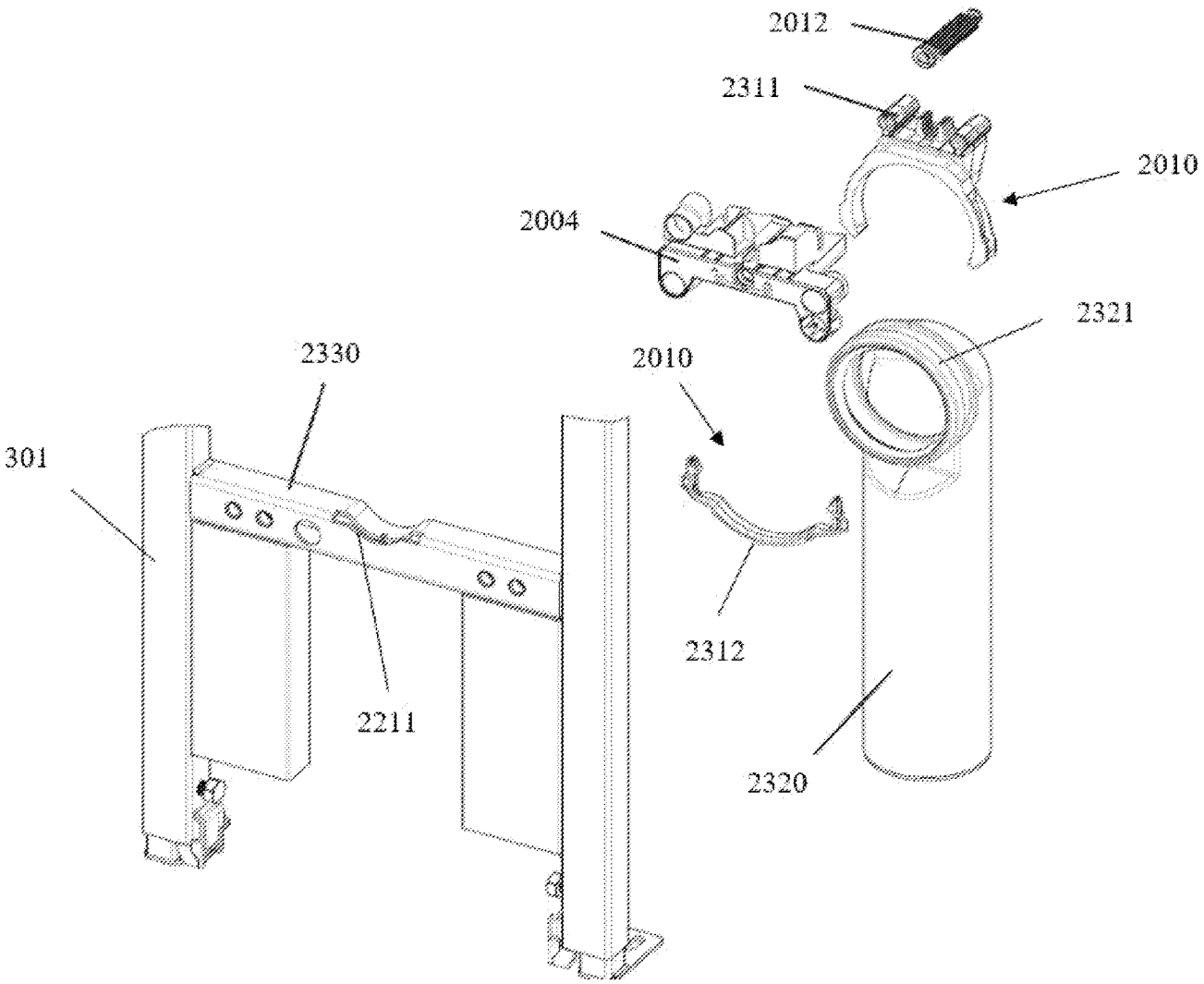
FIG. 23 shows various components of the discharge assembly 303 disassembled from the frame 301 according to some embodiments.

FIG. 23 shows various components of the discharge assembly 303 disassembled from the frame 301 according to some embodiments. In some embodiments, the discharge assembly 303 is configured to couple to a bottom bar 2330 of the frame 301. In some embodiments, the discharge pipe fixer 2010 comprises an upper bracket 2311 and a lower bracket 2312 configured to couple to a recess 2321 of a discharge pipe 2320 which carries waste from toilet 110. In some embodiments, a unique feature of the discharge pipe fixer 2010 is that it is configured to adjustably slide along pipe fixer holder 2004 enabling various positioning relative to bottom bar 2330.

Figure 24:
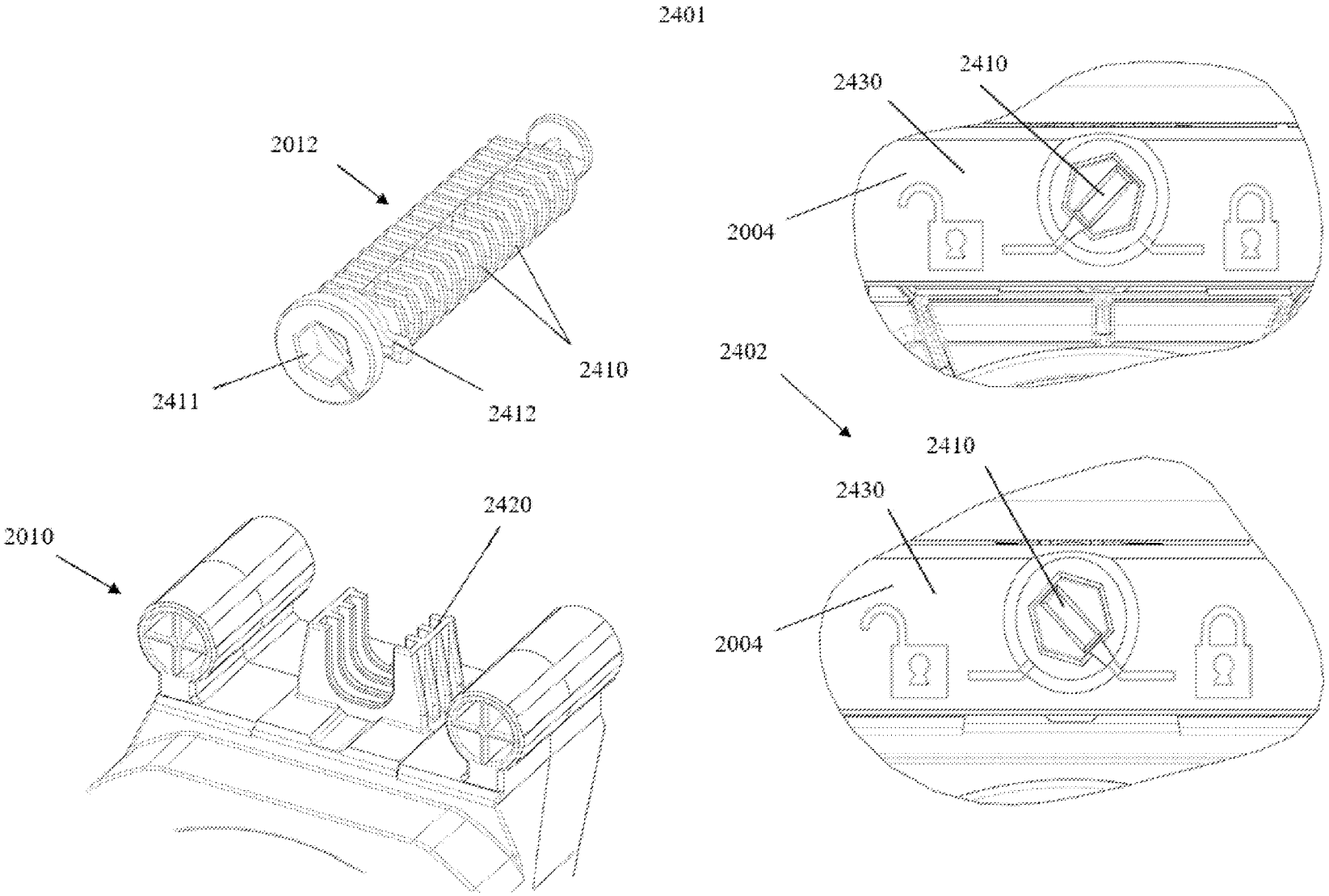
FIG. 24 shows details of how the pipe fixer adjuster 2012, the discharge pipe fixer 2010, and the pipe fixer holder 2004 cooperate to enable adjustment of the discharge pipe 2320 according to some embodiments.

FIG. 24 shows details of how the pipe fixer adjuster 2012, the discharge pipe fixer 2010, and the pipe fixer holder 2004 cooperate to enable adjustment of the discharge pipe 2320 according to some embodiments. In some embodiments, the pipe fixer adjuster 2012 comprises an elongated shape such that one or more protrusions 2410 extend further along one axis than another axis (e.g., a substantially rectangular profile with rounded edges). In some embodiments, in an unlocked position 2430 the one or more protrusions 2410 do not engage with one or more slots 2420 on the discharge pipe fixer 2010 when the pipe fixer adjuster is assembled within the pipe fixer holder 2004.

In some embodiments, by rotating the locking mechanism 2411 by a rotational tool such as either a screwdriver or a socket wrench, as non-limiting examples, the pipe fixer adjuster 2012 is rotated such that the one or more protrusions 2410 engage with the one or more slots 2420 preventing sliding motion of the pipe fixer 2010. In some embodiments, the locking tab 2412 is configured to interface with a locking receiver 2413 on the pipe fixer holder 2004. In some embodiments, the locking receiver 2413 is configured to limit rotation of the pipe fixer adjuster 2012 and/or hold the pipe fixer adjuster in one or more of a locked and unlocked position.

Figure 25:
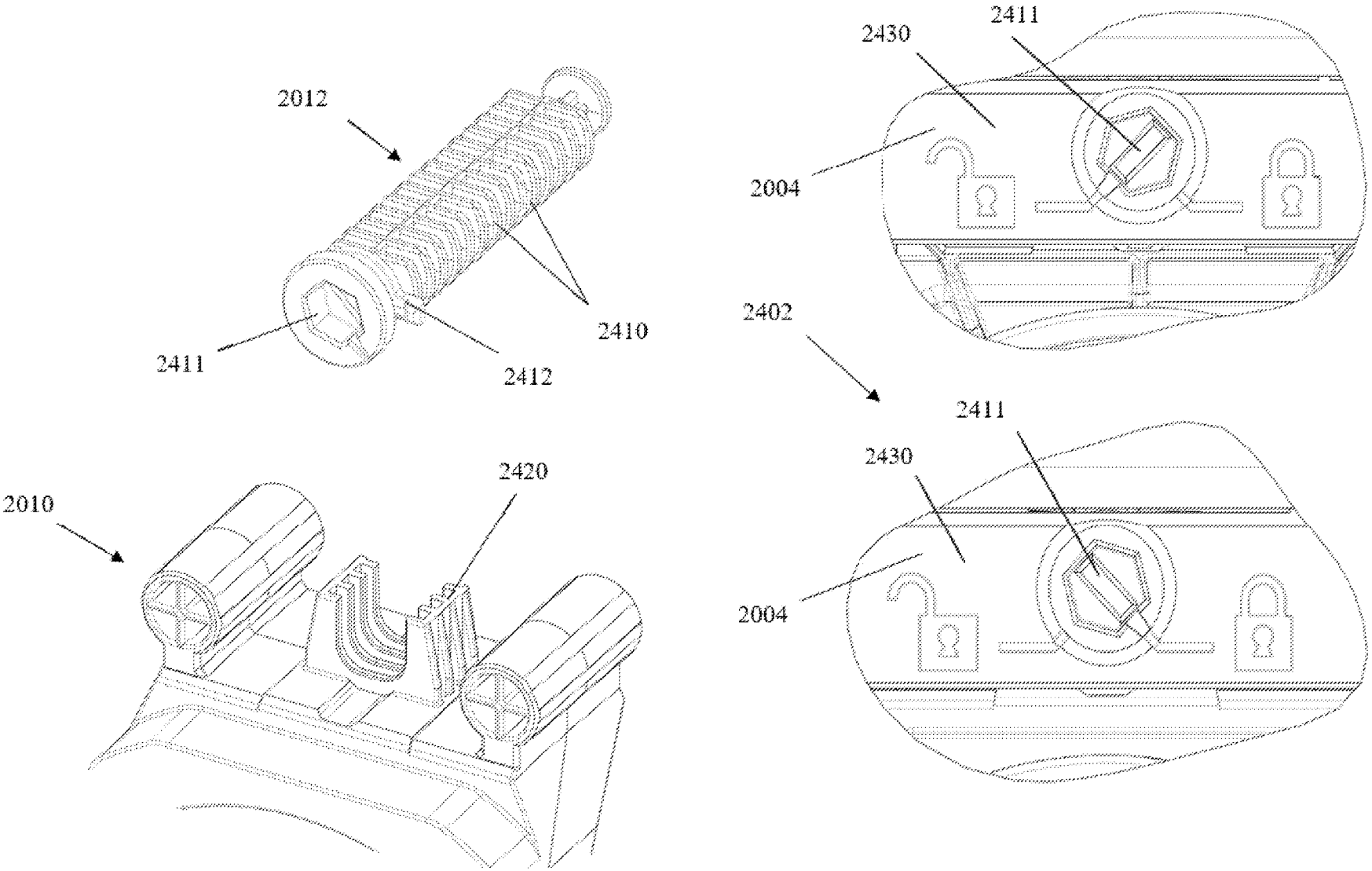
FIG. 25 shows a disengaged rear portion view 2501 where the dashed line emphasizes a gap 2511 and an engaged front portion view 2502 emphasizes an overlap 2512 between the one or more protrusions 2410 and the one or more slots 2420.
Figure 26:
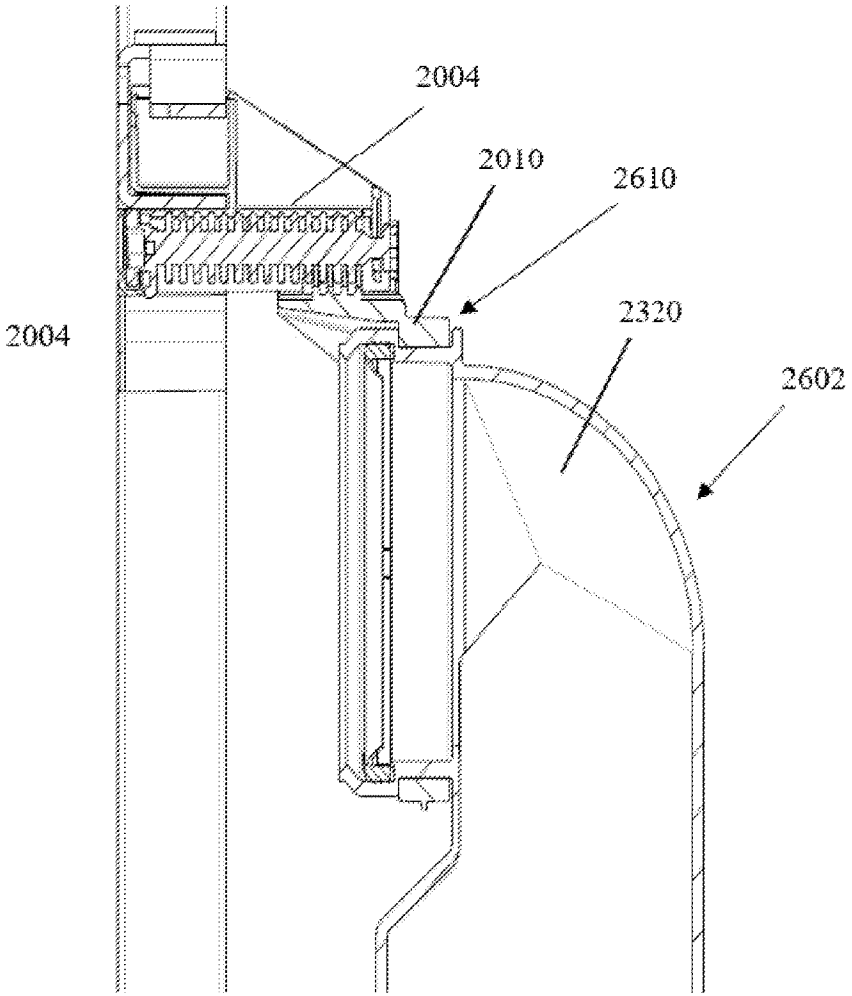
FIG. 26 shows the discharge pipe 2320 in a frontmost position 2601 as well as a rearmost position 2602 according to some embodiments.
Figure 26:
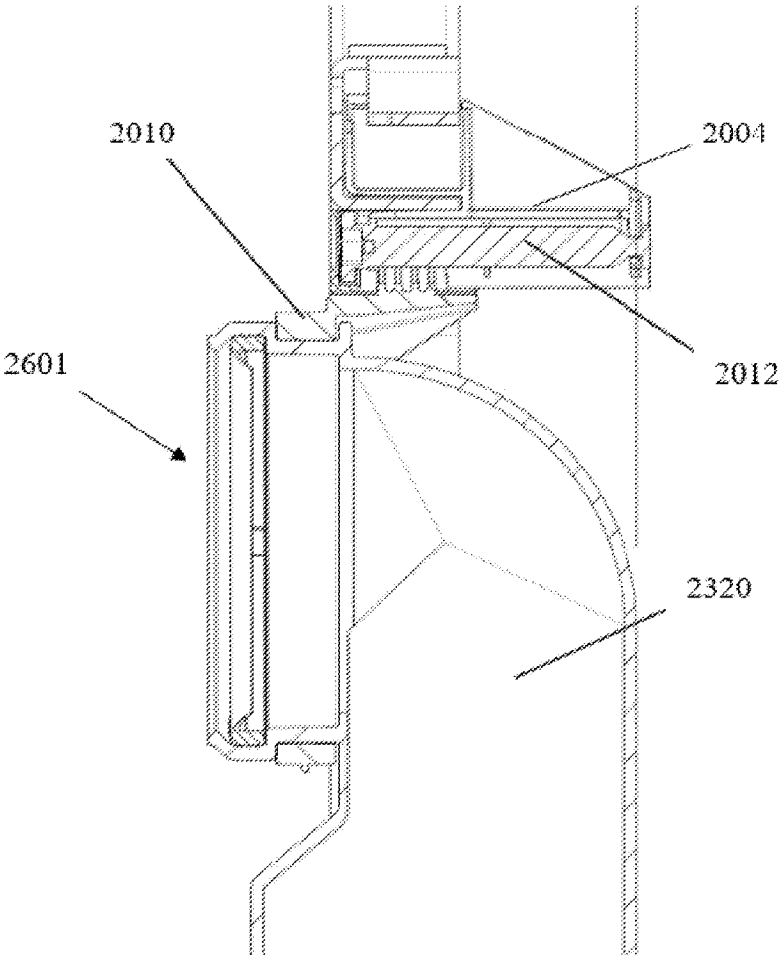

FIG. 25 shows a disengaged rear portion view 2501 where the dashed line emphasizes a gap 2511 and an engaged front portion view 2502 emphasizes an overlap 2512 between the one or more protrusions 2410 and the one or more slots 2420. FIG. 26 shows the discharge pipe 2320 in a frontmost position 2601 as well as a rearmost position 2602 according to some embodiments. Advantageously, the pipe fixer 2010 comprise a symmetrical shape which allows it to be installed in a reverse direction 2610 to enable the discharge pipe to be moved even further away and/or forward from the bottom bar 2330.

Figure 27:
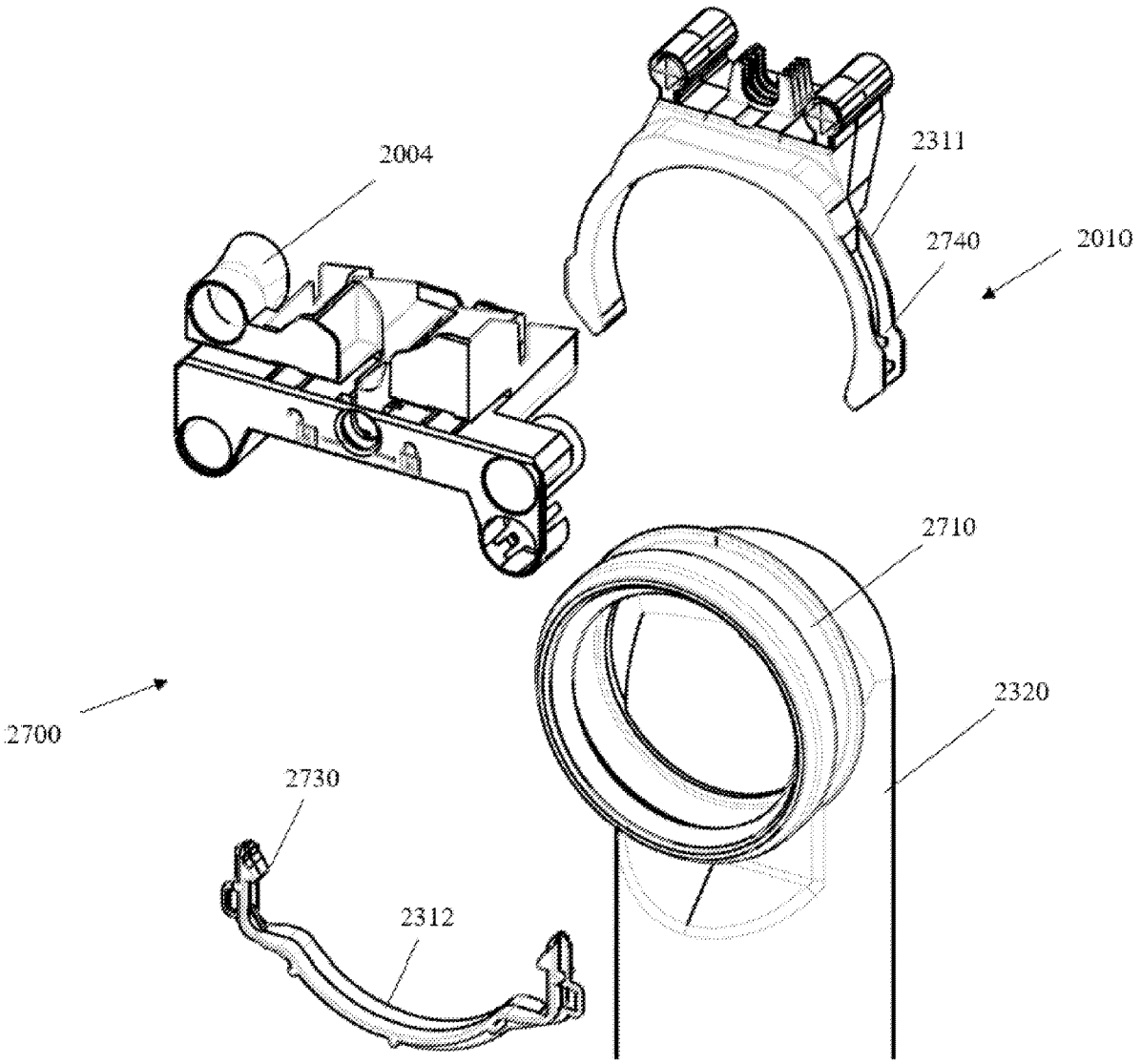
FIG. 27 shows a zoomed view 2700 of a portion of the discharge assembly 303 according to some embodiments.

FIG. 27 shows a zoomed view 2700 of a portion of the discharge assembly 303 according to some embodiments. In some embodiments, the upper bracket 2311 and/or the lower bracket 2312 of the pipe fixer 2010 is flexible enough to enable a snap fit around a groove 2710 in the discharge pipe 2320. In some embodiments, a protrusion 2730 on the lower bracket 2312 engages a seat 2740 on the upper bracket (or vice versa) to prevent axial motion of the discharge pipe 2320 while allowing rotational motion of the discharge pipe 2320.

Figure 28:
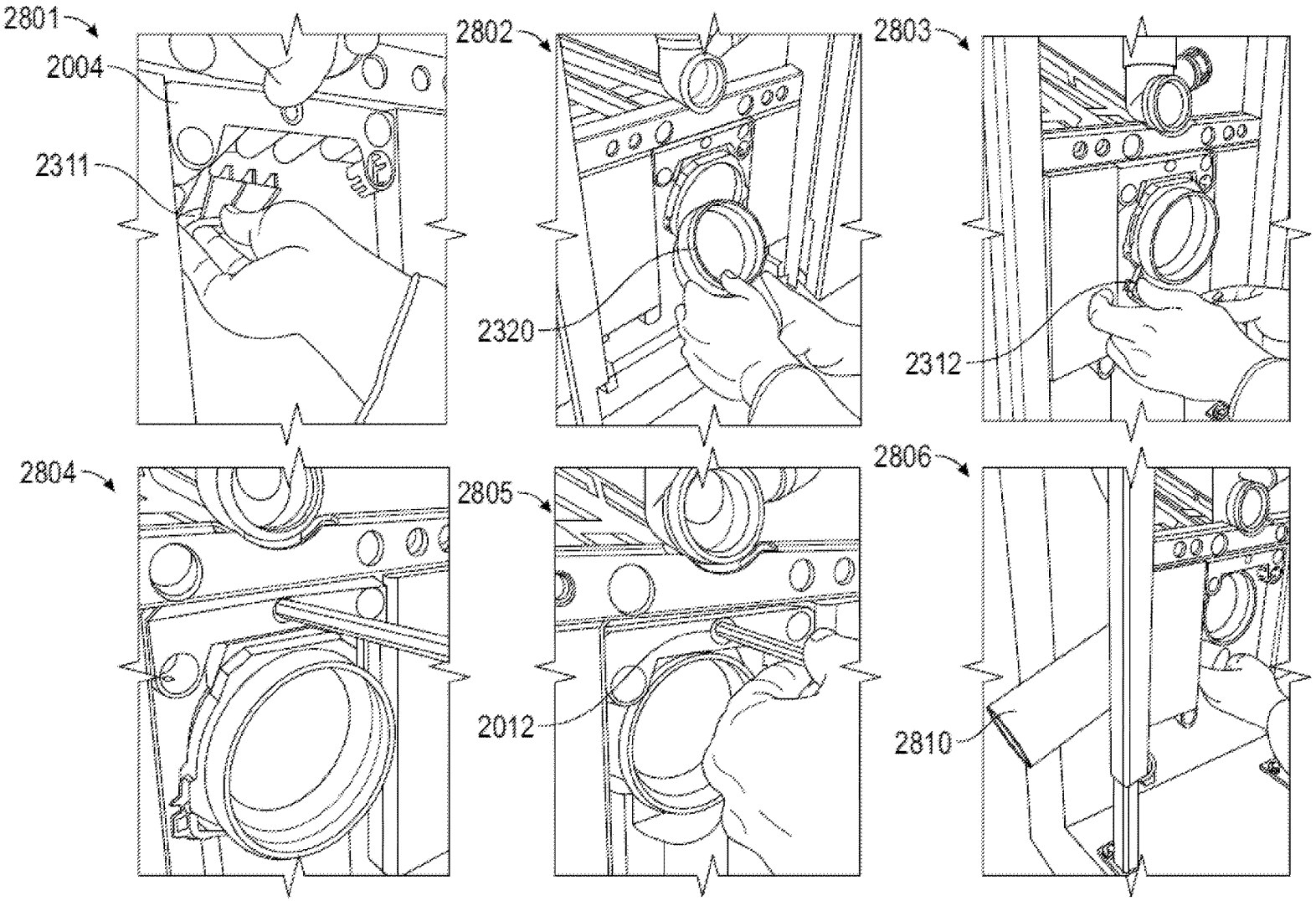
FIG. 28 illustrates various installation steps and adjustment steps when installing a discharge pipe 2320 according to some embodiments.
Figure 29:
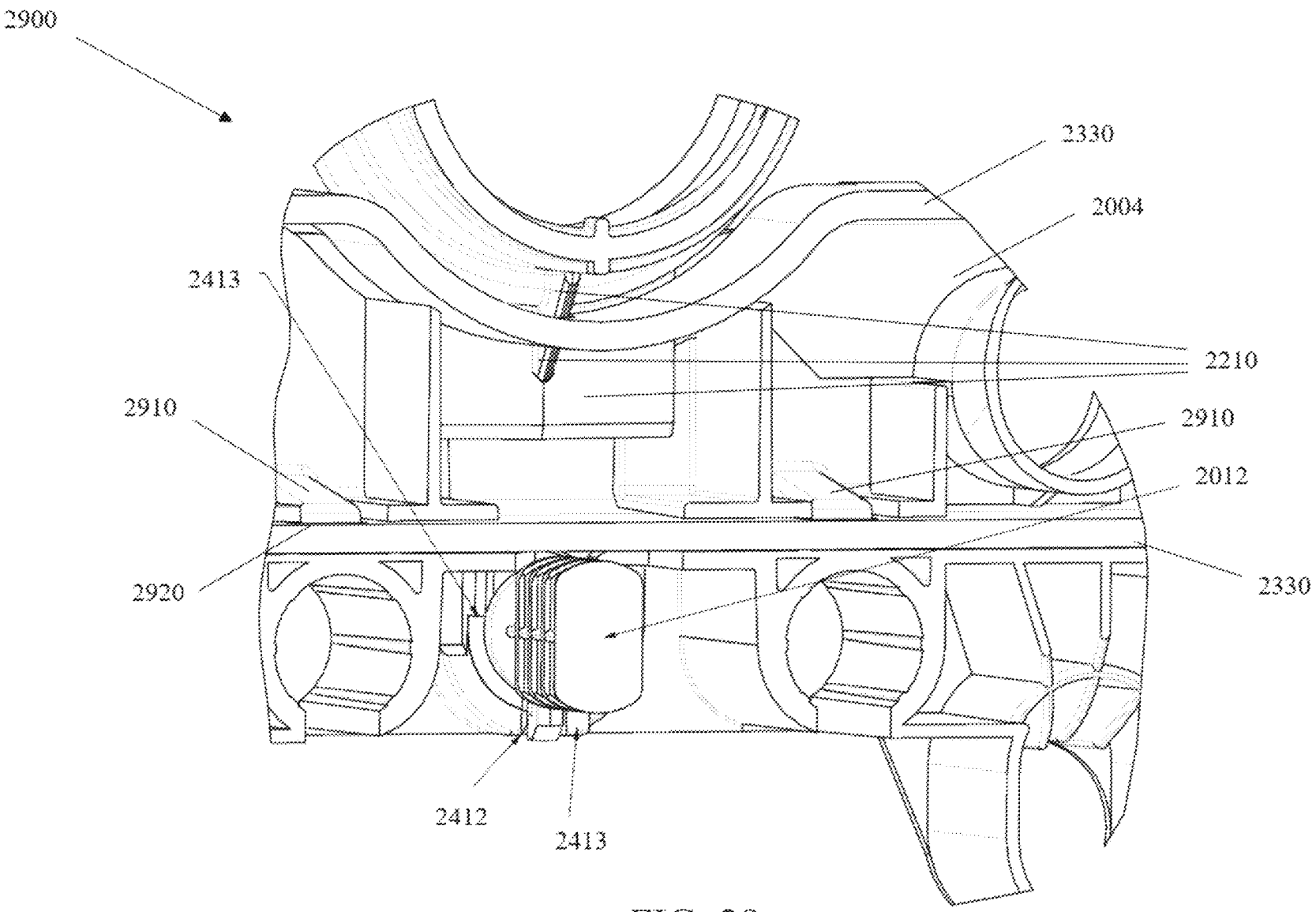
FIG. 29 illustrates a rear assembled isometric sectional view 2900 showing additional details of FIG. 22 according to some embodiments.

FIG. 28 illustrates various installation steps and adjustment steps when installing a discharge pipe 2320 according to some embodiments. In some embodiments, according to a method of assembly, in step 2801 an upper bracket 2311 is coupled to the piper fixer holder 2004. In some embodiments, in step 2802 the discharge pipe 2320 is inserted into the upper bracket 2311, and then the lower bracket 2312 secures the discharge pipe 2320 from axial movement. In some embodiments, step 2804 illustrates an unlocking step as previously described. In some embodiments, step 2804 shows the discharge pipe 2320 moved to a rearmost position and then locked in place by rotating the pipe fixer adjuster 2012. In some embodiments, step 2806 illustrates how the discharge pipe fixer 2010 is configured to enable the discharge pipe 2320 to rotate while being locked axially, enabling various connection angles to waste systems connections. FIG. 29 illustrates a rear assembled isometric sectional view 2900 showing additional details of FIG. 22 according to some embodiments.

Figure 30:
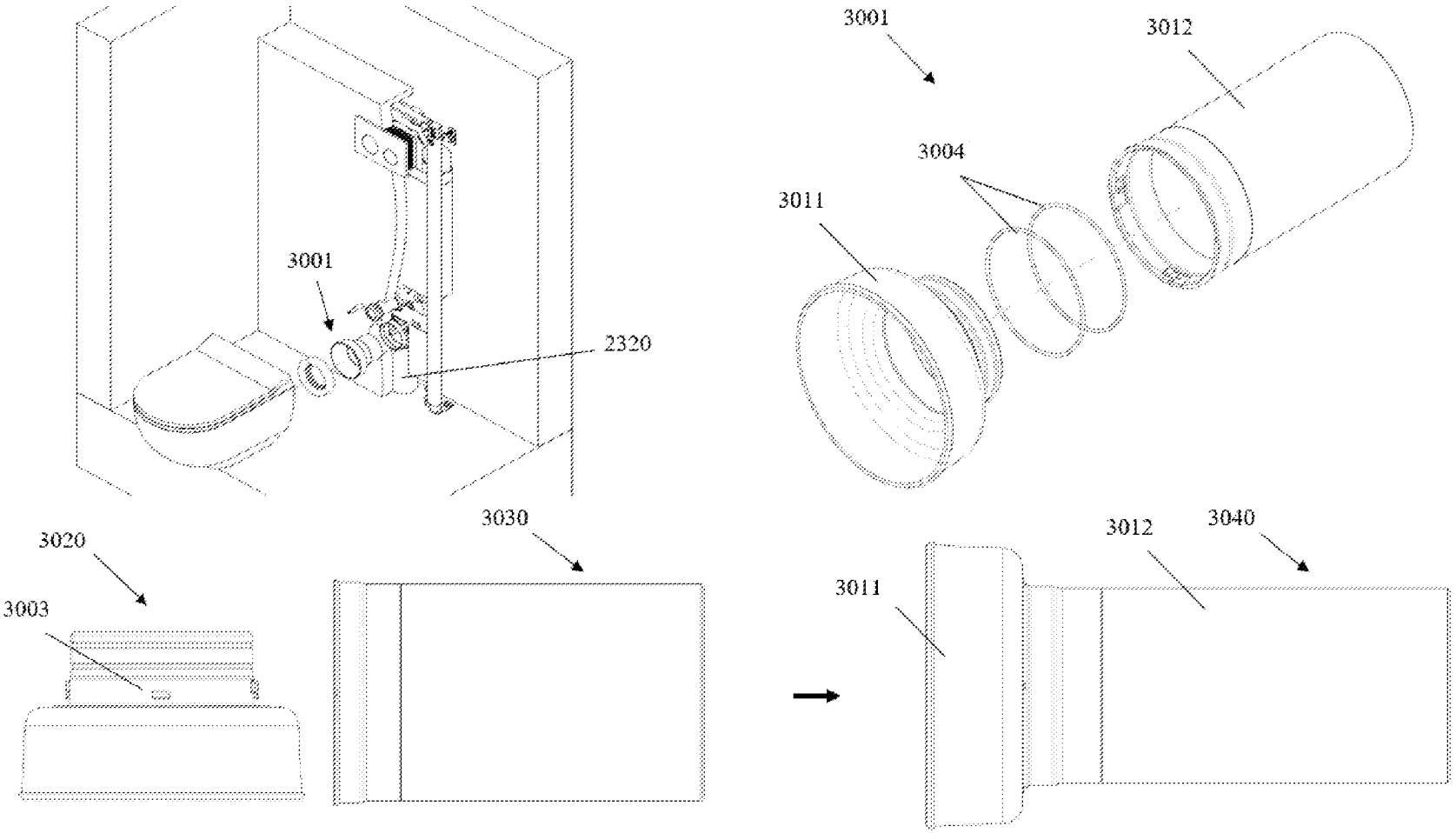
FIG. 30 shows details of the discharge adaptor 3001 which is configured to extend the discharge pipe 2320 and/or enable coupling to different size toilet 110 discharge connections according to some embodiments.
Figure 31:
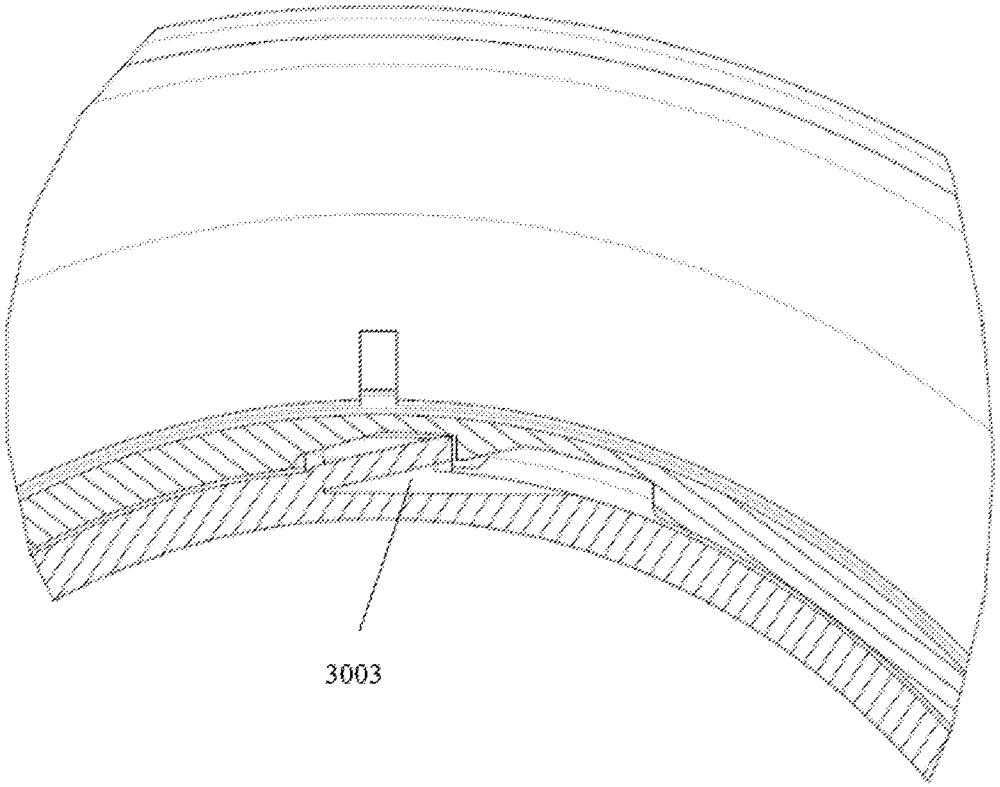
FIG. 31 shows further details of the bayonet lock 3003 according to some embodiments.
Figure 31:
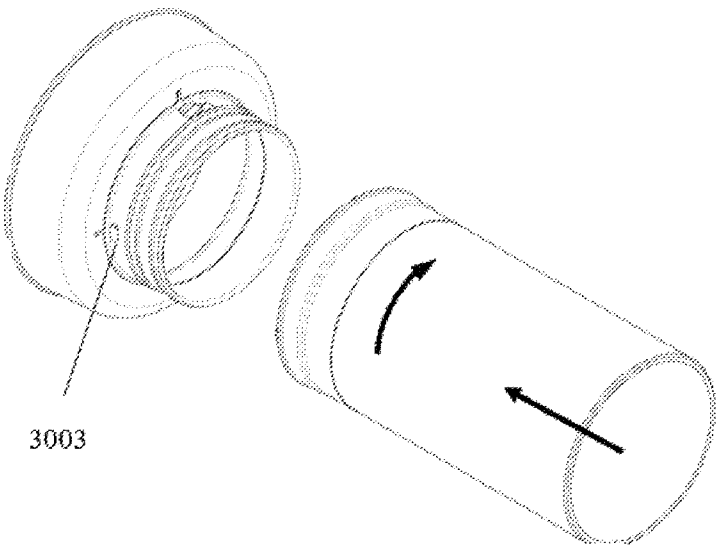

In some embodiments, a kit comprises one or more components described herein, such that any combination of components and/or all components comprise at least part of a kit. In some embodiments, the system, including a kit comprising one or more system components, comprise a discharge adaptor 3001. FIG. 30 shows details of the discharge adaptor 3001 which is configured to extend the discharge pipe 2320 and/or enable coupling to different size toilet 110 discharge connections according to some embodiments. In some embodiments, the discharge adaptor 3001 comprises a discharge extension inlet 3011 configured to couple to a discharge extension outlet 3012 using, as a non-limiting example, a bayonet lock 3003. In some embodiments, one or more seals 3004 prevent leakage between the discharge extension inlet 3011 and the discharge extension outlet 3012. In some embodiments, the discharge adaptor 3001 is configured to be separated into two sections 3020 and 3030 to conserve space inside the kit when packaged. In some embodiments, assembled view 3040 shows the two sections in their assembled configuration. FIG. 31 shows further details of the bayonet lock 3003 according to some embodiments.

Figure 32:
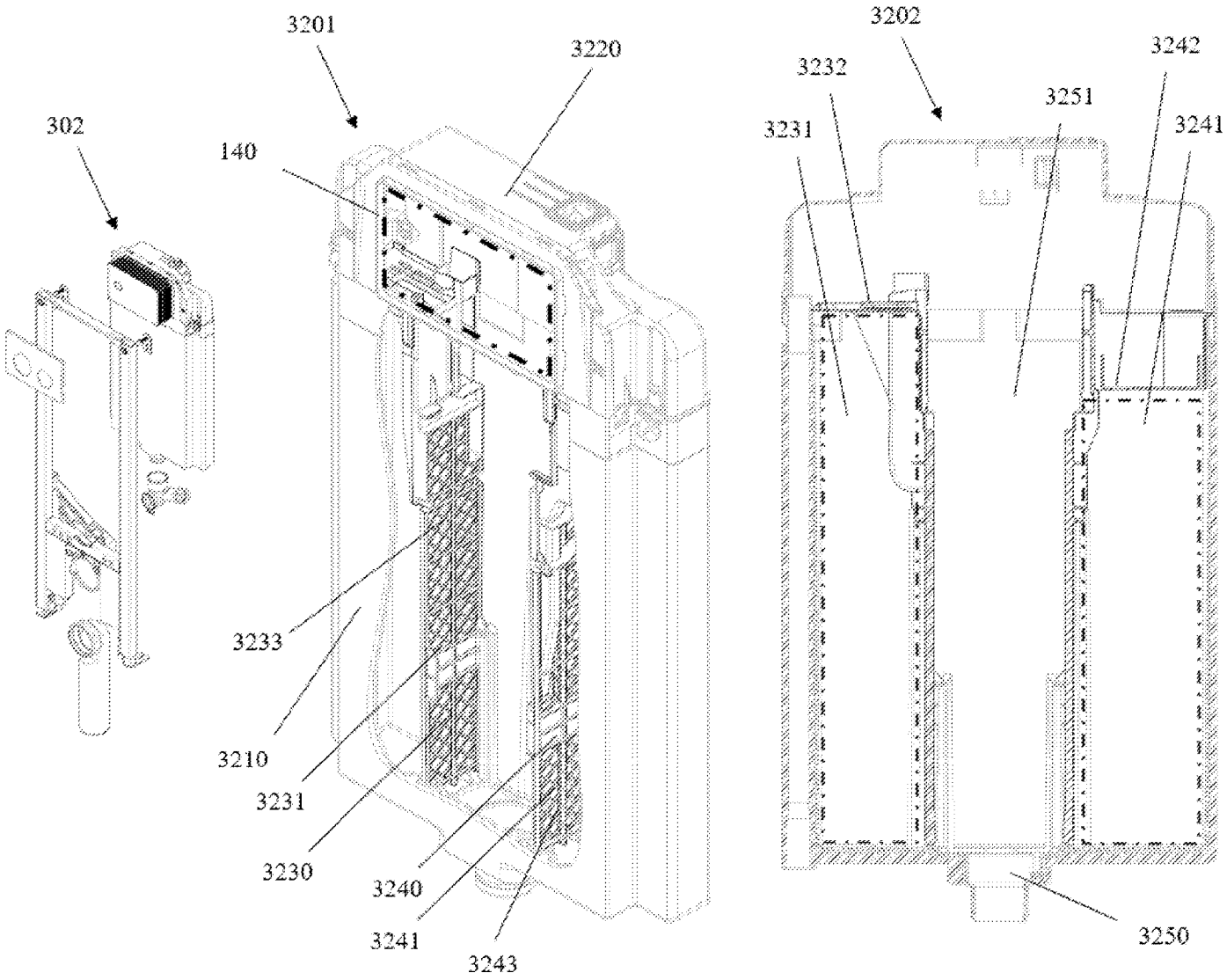
FIG. 32 shows and isometric sectional view 3201 and a side sectional view 3202 of one or more portions of the cistern assembly 302 according to some embodiments.

FIG. 32 shows and isometric sectional view 3201 and a side sectional view 3202 of one or more portions of the cistern assembly 302 according to some embodiments. In some embodiments, the cistern assembly 302 comprises a fluid tank 3210 and a tank lid 3220. In some embodiments, the tank lid 3220 comprises a maintenance window 140 which enables one or more unique features of the system 100. In some embodiments, the maintenance window 140 is configured to access to all adjustable features of the flush system 3410 and is further describe later.

In some embodiments, as shown in the isometric sectional view 3201, the cistern assembly 302 comprises a fill member 3230 and a dosing member 3240 configured to support a fluid supply assembly 3410 and a timing assembly which are further described later. In some embodiments, the fill member 3230 and the dosing member 3240 are configured to couple to an interior of the tank 3210. When positioned, in some embodiments, the fill member 3230 and the dosing member 3240 define a fill volume 3231, a dosing volume 3241, and a flush valve volume 3251 within the tank 3210 which are each separate compartments but are configured to enable fluid to flow freely in-between openings 3233, 3234 and/or out the tank outlet 3250. In some embodiments, the fill member 3230 and the dosing member 3240 are each configured to enable a fluid to flow therethrough while also configured to not allow one or more system components to pass therethrough in the event a component falls withing the flush valve space 3251. In some embodiments, this arrangement proves beneficial when installing the fluid supply assembly 3410 on the supply platform 3232 and/or the dosing assembly 6200 on the dosing platform 3242.

Figure 33:
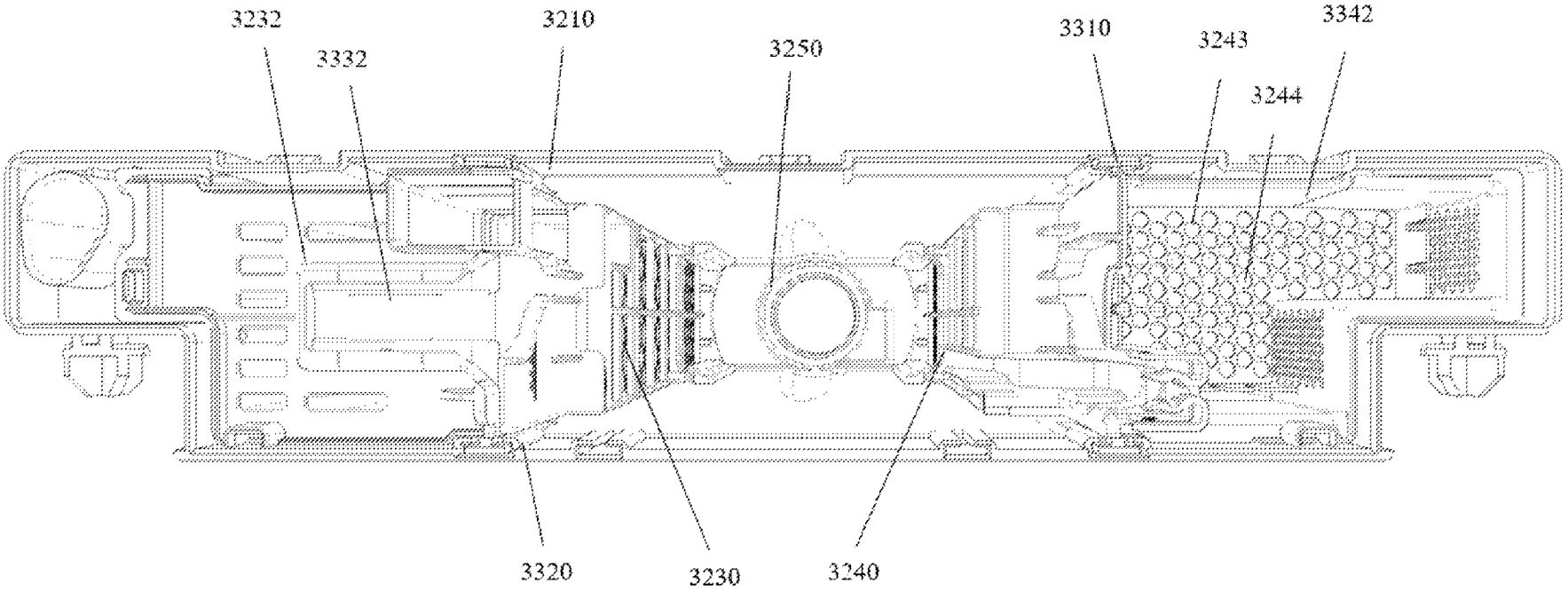
FIG. 33 shows a top view of the tank 3210 with the tank lid 3220 removed and the fill member 3230 and the dosing member 3240 installed according to some embodiments.

FIG. 33 shows a top view of the tank 3210 with the tank lid 3220 removed and the fill member 3230 and the dosing member 3240 installed according to some embodiments. In some embodiments, to secure one or more of the fill member 3230 and the dosing member 3240 in place, each may comprise one or more tabs 3310 that are in sliding engagement with one or more slots 3320 formed on an interior of the tank 3210. In some embodiments, the supply platform 3232 comprises a slotted recess 3332 configured to couple to a fluid supply tab to hold the fluid supply assembly 3410 in position. In some embodiments, the dosing platform 3242 is recessed into the tank 3210 interior such that the dosing assembly 6200 is contained by one or more side platform walls 3342 and at least one floor 3243. In some embodiments, the at least one floor 3243 comprises one or more openings 3244 configured to prevent a dose 6230 from falling therethrough while enabling a dissolved portion of the dose 3530 to diffuse into the fluid when the tank 3210 is full.

Figure 34:
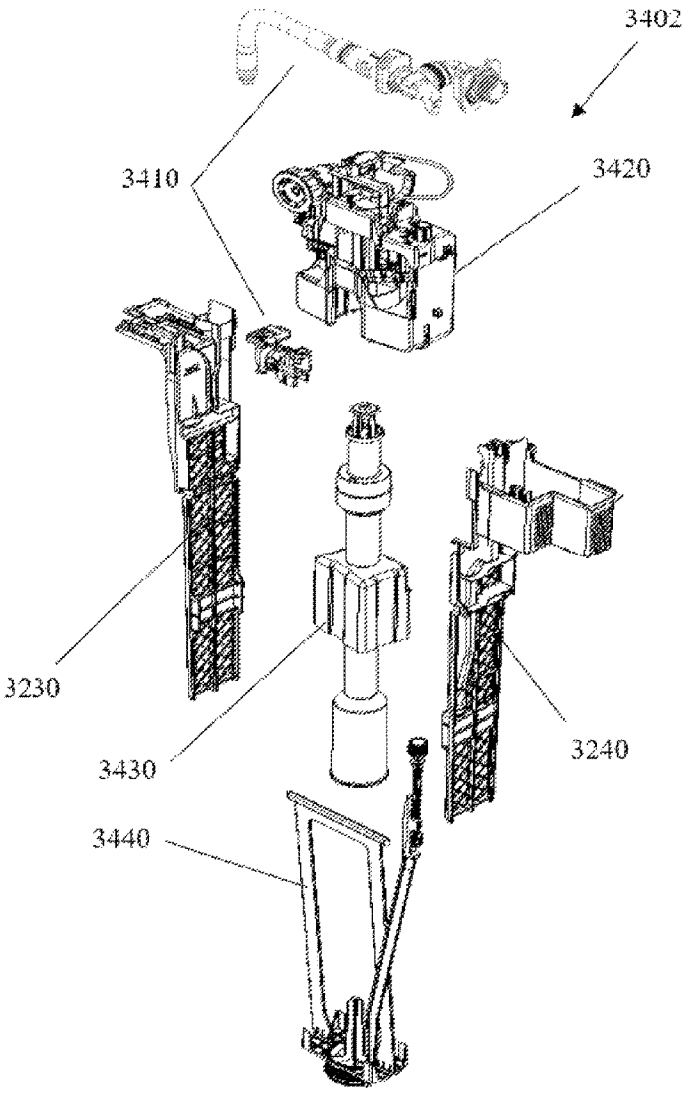
FIG. 34 shows one or more components of the cistern assembly 302 in an assembled view 3401 and an exploded view 3402 according to some embodiments.
Figure 34:
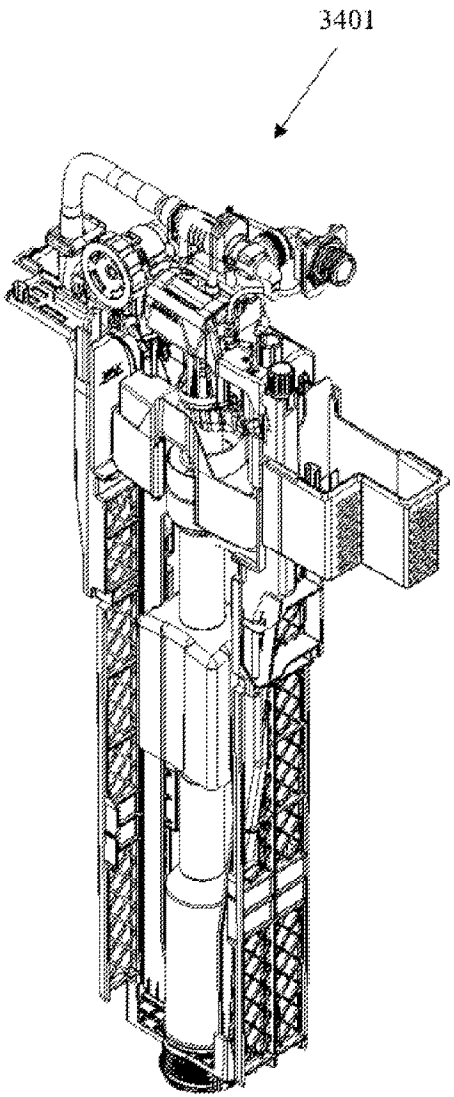

FIG. 34 shows one or more components of the cistern assembly 302 in an assembled view 3401 and an exploded view 3402 according to some embodiments. In some embodiments, the one or more components include a fluid supply assembly 3410, a flush valve assembly 3420, a flush tube 3430, a flowrate valve 3440, as well as the fill member 3230 and the dosing member 3240.

Figure 35:
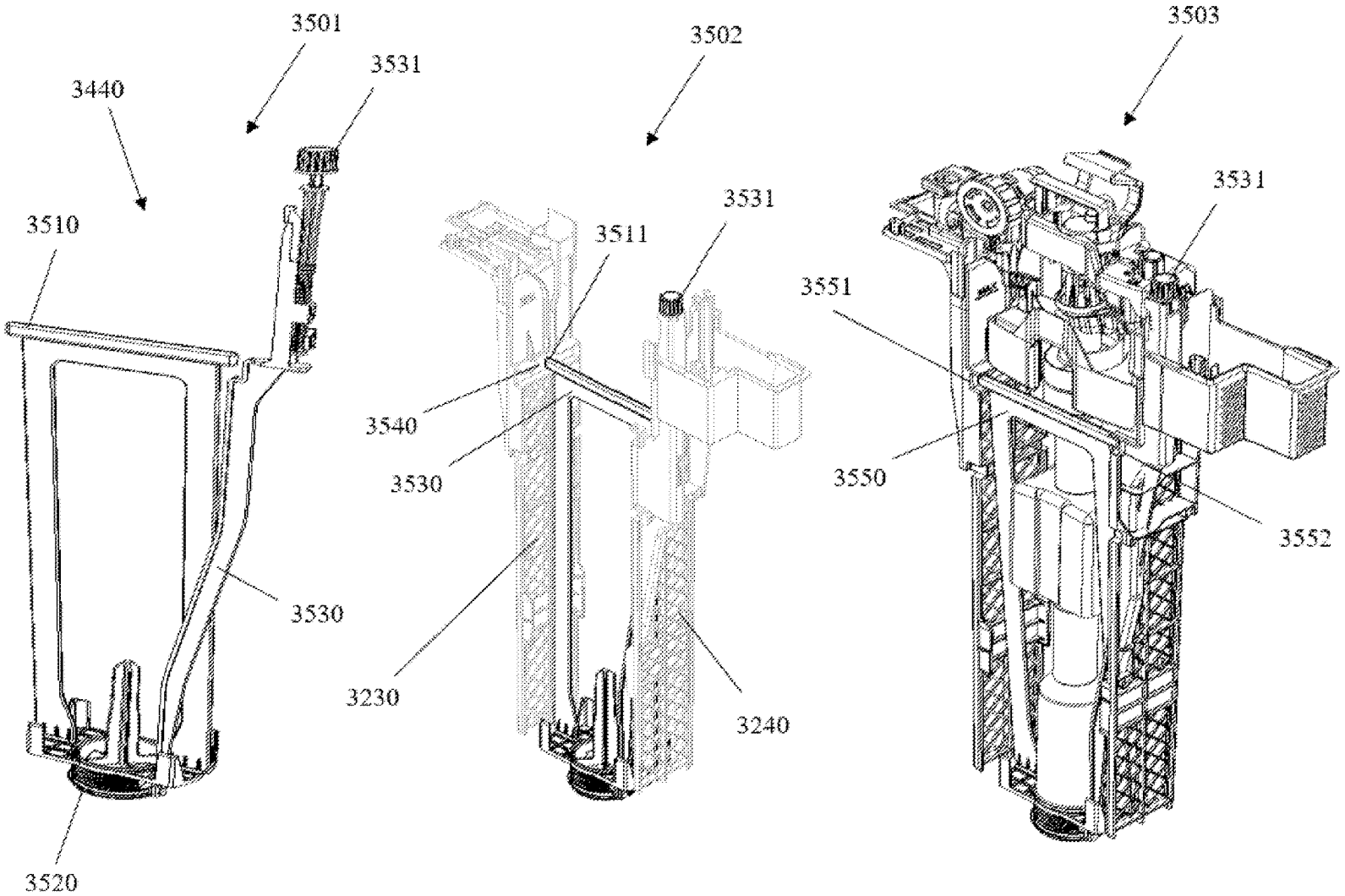
FIG. 35 illustrates flowrate valve installation steps according to some embodiments.

FIG. 35 illustrates flowrate valve installation steps according to some embodiments. In some embodiments, isolated view 3501 shows the flowrate valve 3440 comprises a flexible handle 3510, a valve seat 3520, and a valve adjusting arm 3530 including a valve adjuster 3531. Advantageously, in some embodiments, the flexible handle 3510 is configured to bend to enable the flowrate valve 3440 to fit through the maintenance window 140 (best shown in FIG. 39) during installation and/or maintenance eliminating the need to disassemble the entire structure to install and/or change out the flowrate valve 3440. As shown in view 3502, in some embodiments, a top side portion 3511 of the flexible handle 3510 is configured to slide between an opening 3540 in a side of one or more of the fill member 3230 and the dosing member 3240. In some embodiments, the flowrate valve 3440 valve seat 3520 is configured to removably snap fit into the tank outlet 3250. As shown in view 3503, once installed the flexible handle 3510 is configured to pivot upon an axis proximate the valve seat 3520 such that the flexible handle 3510 moves to a forward position 3550 and is locked in place between one or more grooves 3551 and 3552. In some embodiments, the one or more grooves 3551 and 3552 are configured to provide continuous downward force to aid in creating a leak-tight seal with the tank outlet 3250.

Figure 36:
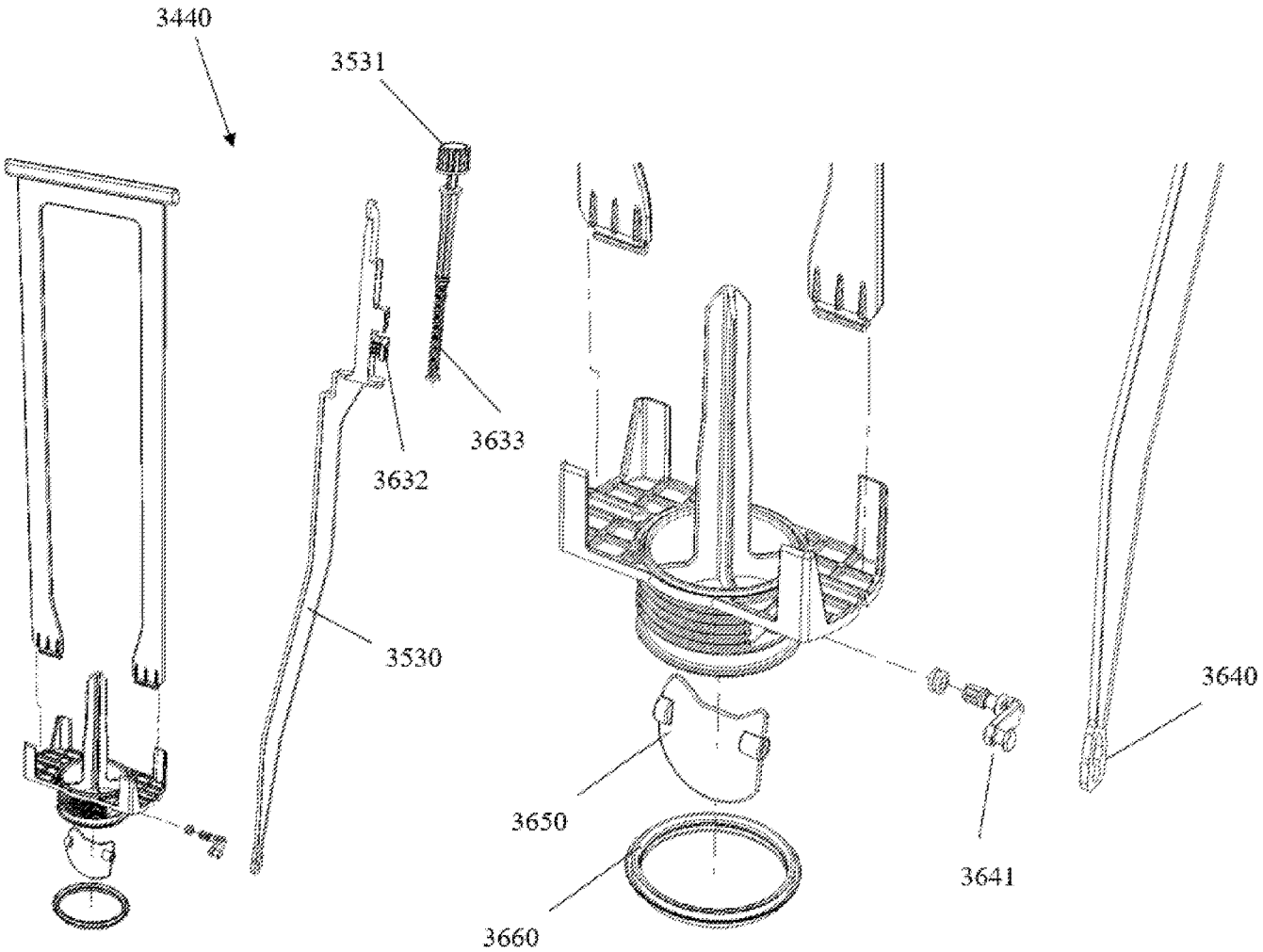
FIG. 36 shows further details of the flowrate valve 3440 according to some embodiments.

FIG. 36 shows further details of the flowrate valve 3440 according to some embodiments. In some embodiments, in an installed position 3502 the dosing member 3240 is configured to couple to the adjusting arm 3530, preventing movement of the valve adjuster 3531 while enabling vertical movement of the adjusting arm 3530. In some embodiments, rotation of the valve adjuster 3531 causes adjuster threads 3633 to engage with arm threads 3632 to move the adjusting arm 3530 up or down. A lower end 3640 of the adjusting arm 3530 engages with a valve lever 3641 configured to translate downward motion of the adjusting arm 3530 to rotational motion to change the angle of the butterfly valve 3650 relative to the tank outlet 3250 and/or seal 3660.

Figure 37:
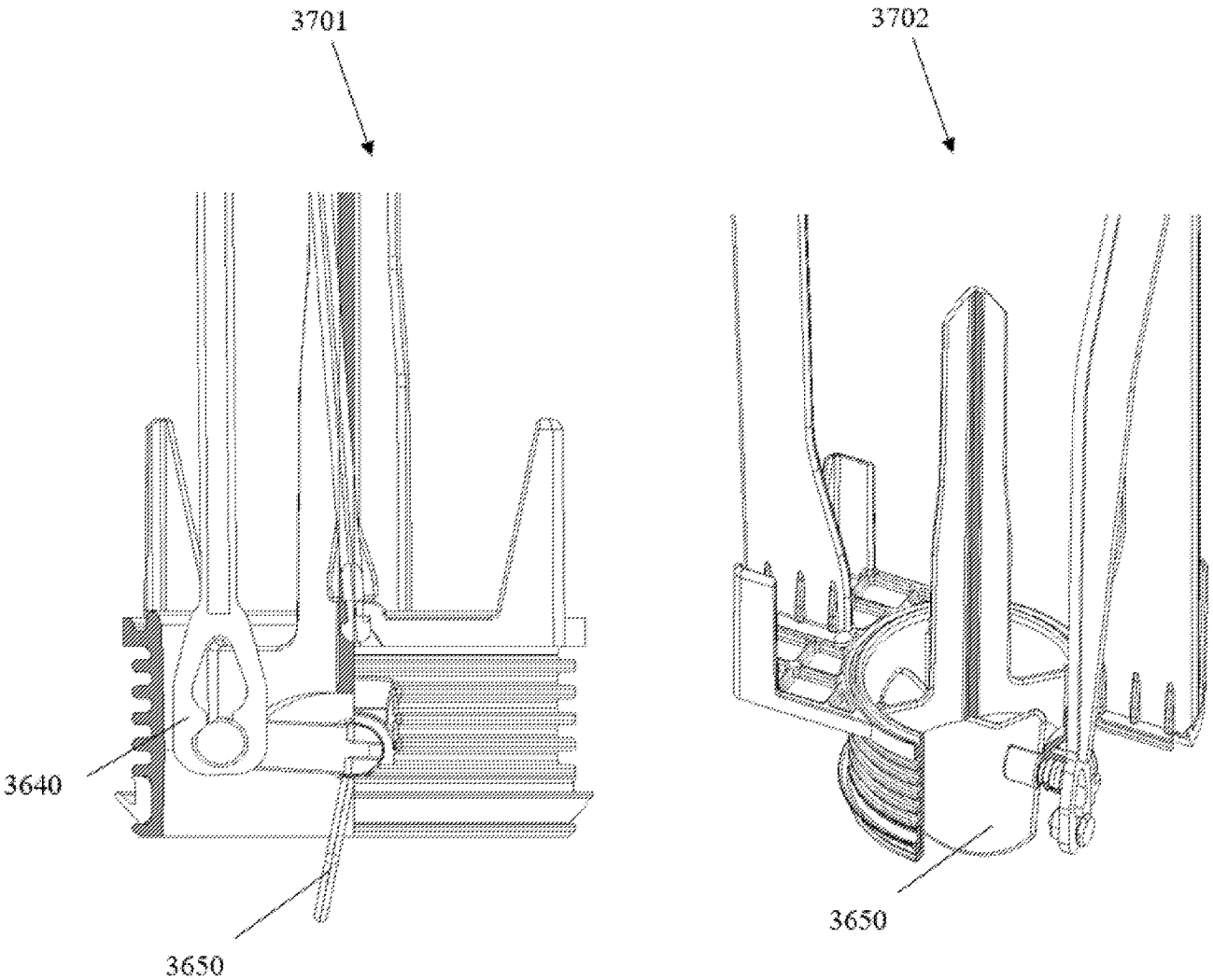
FIG. 37 shows a side sectional view 3701 and an isometric sectional view 3702 of the butterfly valve 3650 in a maximum flowrate position.
Figure 38:
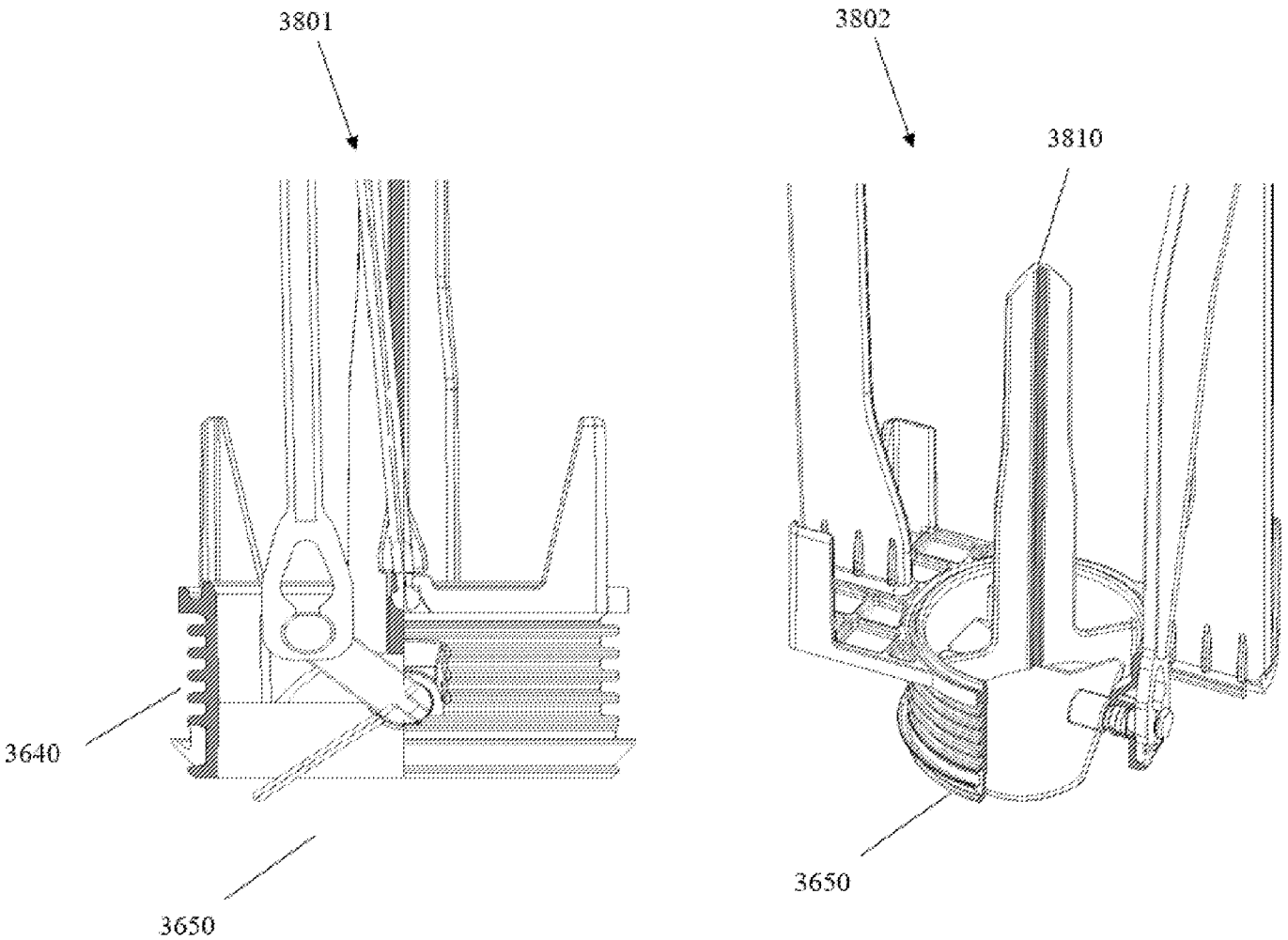
FIG. 38 shows a side sectional view 3801 and an isometric sectional view 3802 of the butterfly valve 3650 in a minimum flowrate position.

FIG. 37 shows a side sectional view 3701 and an isometric sectional view 3702 of the butterfly valve 3650 in a maximum flowrate position. FIG. 38 shows a side sectional view 3801 and an isometric sectional view 3802 of the butterfly valve 3650 in a minimum flowrate position. In some embodiments, the flowrate valve 3440 comprises a flush tube guide 3810 configured to direct the flush tube 3430 to a seated position.

Figure 39:
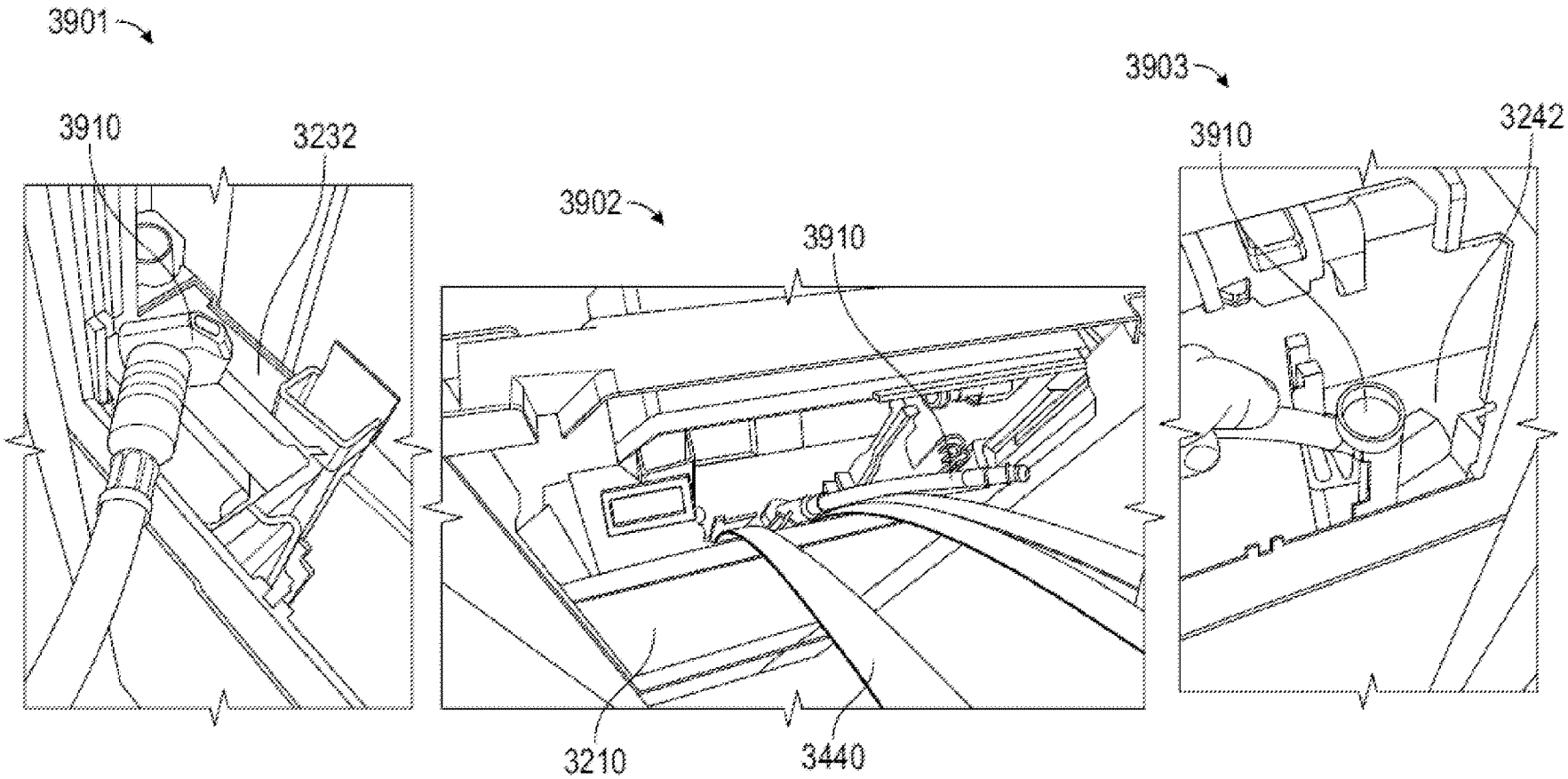
FIG. 39 illustrates a method of use of the flowrate valve 3440 that includes retrieval of objects 3910 that fall into the fluid tank 3210.

FIG. 39 illustrates a method of use of the flowrate valve 3440 that includes retrieval of objects 3910 that fall into the fluid tank 3210. In this non-limiting example, the object 3910 is a portion of the fluid supply assembly 3410 that was accidentally dropped during installation according to some embodiments. In some embodiments, the flowrate valve 3440 is configured to lift one or more objects from the bottom of the tank by lifting at least a portion of the flexible handle 3510 through the maintenance window 140 until the object can be reached. In some embodiments, the fill member 3230 and the dosing member 3240 are configured to prevent the object from falling into the fill volume 3231 and/or dosing volume 3241 while the object is being retrieved. In some embodiments, view 3901 shows how the supply platform 3232 is configured to prevent objects 3910 from falling into the fill volume 3231 (bottom of fluid tank 3210). In some embodiments, view 3903 shows how the dosing platform 3232 is configured to prevent objects 3910 from falling into the dosing volume 3241 (bottom of fluid tank 3210). In some embodiments, the object 3910 is greater than or equal to 1 millimeter (mm).

Figure 40:
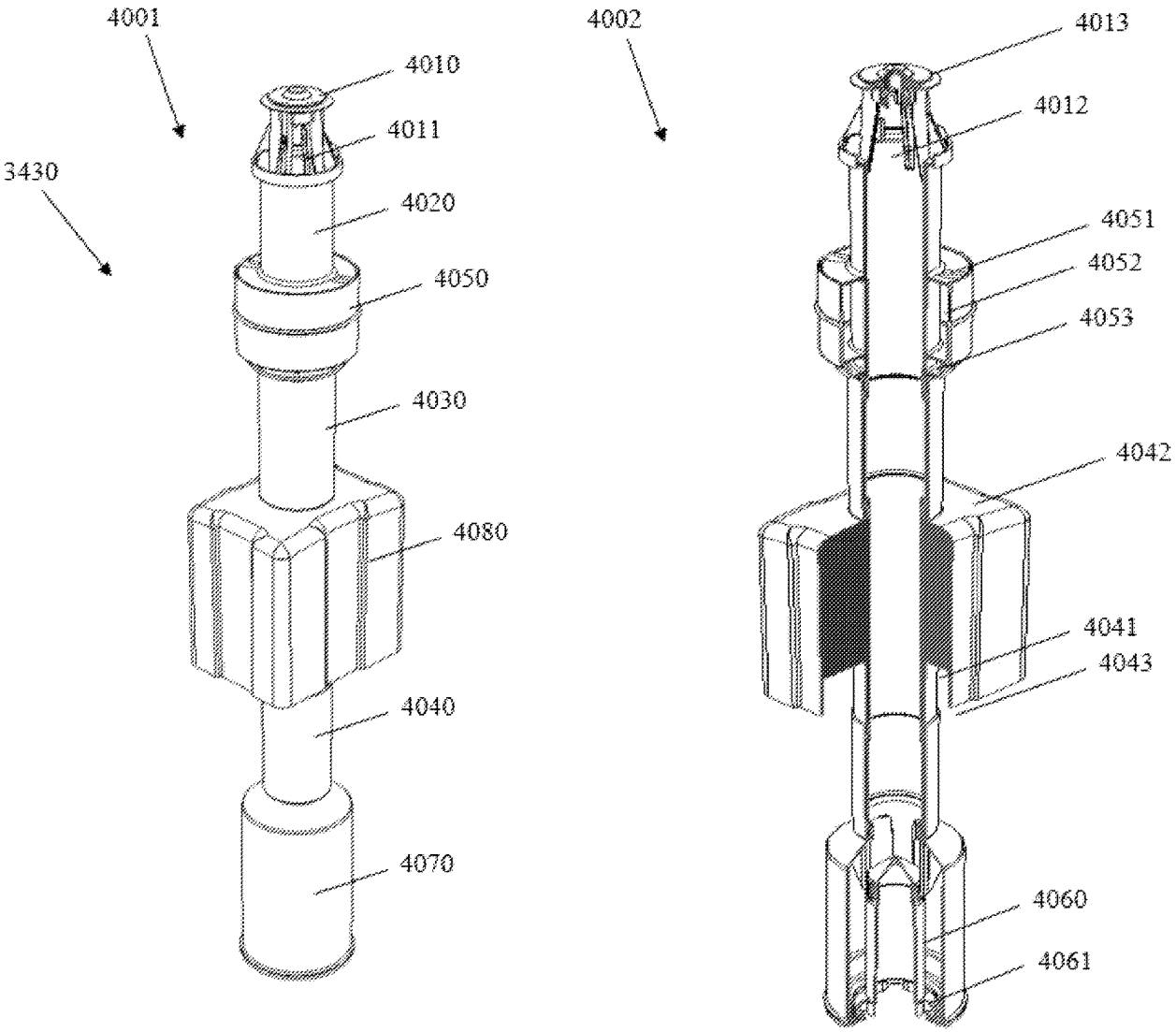
FIG. 40 depicts an isometric view 4001 and a sectional isometric view 4002 of flush tube 3430 according to some embodiment.

FIG. 40 depicts an isometric view 4001 and a sectional isometric view 4002 of flush tube 3430 according to some embodiment. In some embodiments, flush tube 3430 comprises one or more of a vacuum cap 4010, one or more flexible tubes 4020, 4030, 4040, a ballast tank 4050, a flush float 4060, and a flush cover 4070.

In some embodiments, the vacuum cap 4010 comprises one or more openings 4011 configured to enable fluid to flow through to a hollow portion 4012 in the event of an overflow excursion due to a failure of one or more component parts. In some embodiments, one or more flexible tubes 4020, 4030, 4040 are configured to bend to enable insertion of the flush tube 3430 through the maintenance window 140 during assembly and/or maintenance. In some embodiments, one or more flexible tubes 4020, 4030, 4040 are ridged tubes.

In some embodiments, the ballast tank 4050 is configured to enable fluid to flow through one or more openings 4051 into a ballast hollow portion 4052 where it is at least partially blocked from draining by ballast floor 4053. In some embodiments, as the fluid in the tank drops, the ballast 4050 is configured to add weight to the flush tube 3430 to assist in forcing the flush cover 4070 against the valve seat 3520 thereby preventing further fluid discharge.

In some embodiments, the flush float 4060 comprises a substantially float hollow portion 4041 which is sealed by a top surface 4042 and open at a bottom portion 4043 such that a pocket of air is formed in the hollow portion when the flush float 4060 is surrounded by fluid. In some embodiments, the flush float 4060 is configured to add buoyancy to aid in lifting the flush tube 3430 upon an initial activation of the flush fork 5150 against a bottom portion of the vacuum cap 4010 with enough force to overcome the head pressure sealing the flush cover 4070 to the valve seat 3520.

Figure 41:
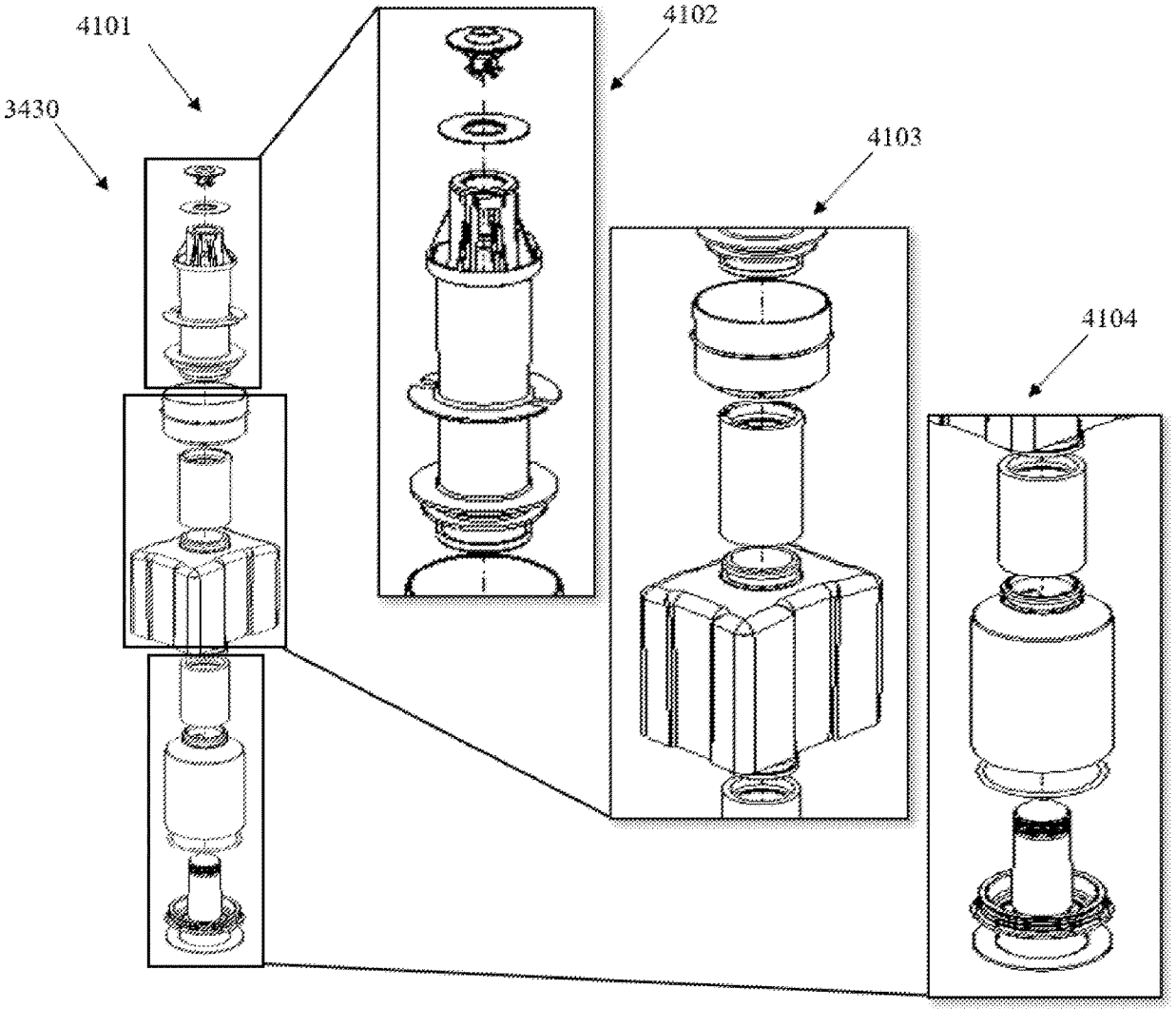
FIG. 41 shows an exploded view 4101 and zoomed sections 4102, 4103, and 4104 of the flush tube 3440 according to some embodiments.

Advantageously, the flush float 4060 is configured to provide enough buoyancy to lift the flush tube 3430 to a maximum position without continuous contact with the flush fork 5150. In some embodiments, the flush float 4060 is configured to provide enough upward force to lift the flush tube off the flush fork 5150 after the flush fork 5150 initially breaks the seal between the flush cover 4070 and the valve seat 3520. In some embodiments, the flush float 4060 is configured to provide enough upward force to lift the flush tube 3430 off the flush fork 5150 and engage the vacuum assembly such that the flush tube 3430 is held in place by the vacuum assembly. FIG. 41 shows an exploded view 4101 and zoomed sections 4102, 4103, and 4104 of the flush tube 3430 according to some embodiments.

Figure 42:
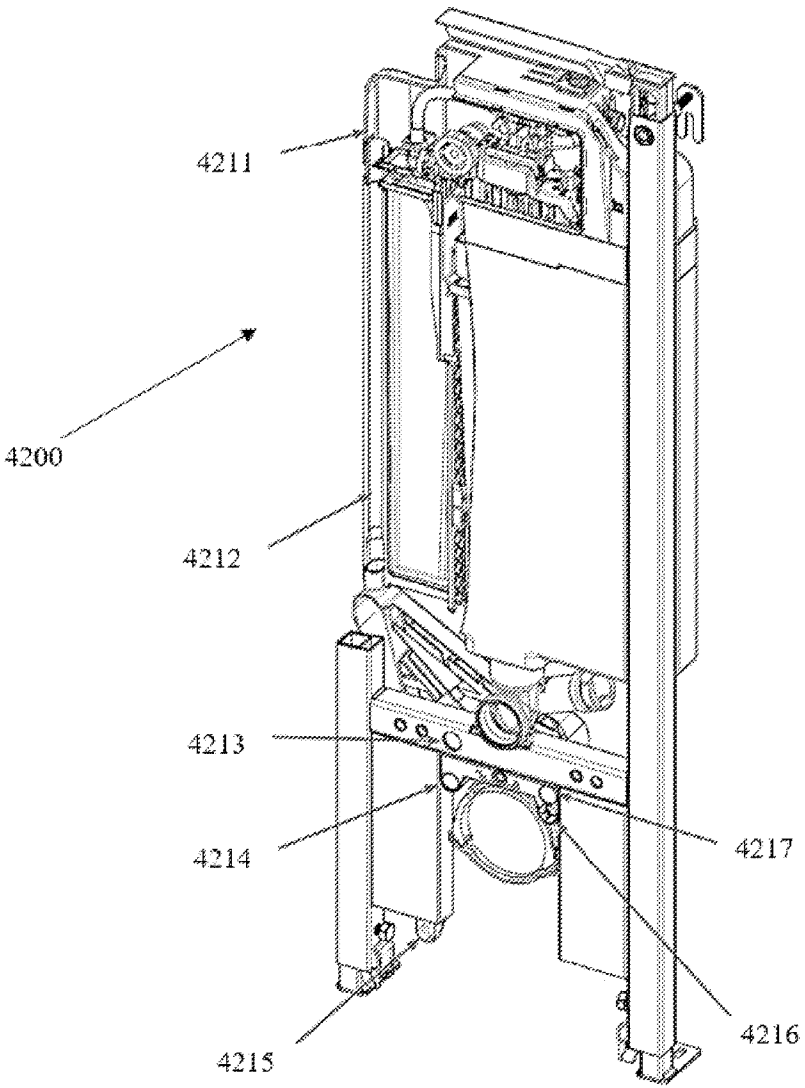
FIG. 42 shows an assembled sectional view 4200 depicting various auxiliary connections enabled by the system 100 according to some embodiments.

FIG. 42 shows an assembled sectional view 4200 depicting various auxiliary connections enabled by the system 100 according to some embodiments. In some embodiments, the system 100 comprises a fluid conduit guide channel 4211 located inside the cistern assembly 302 configured to enable a fluid conduit to pass through an internal guide channel 4212 after installation. In some embodiments, the system 100 further comprises one or more fluid connections 4213, 4214, and 4215 configured to support various fluid conduits. In some embodiments, the system 100 comprises an Internet of Things (IoT) connection 4217 configured to house one or more data transfer cables allowing the system to be integrated with a smart toilet and/or one or more controllers for actuating various features such as automatic actuation plates. In some embodiments, the system comprises an electrical power connection 4216 enabling electrical power to be delivered to one or more system components.

Figure 43:
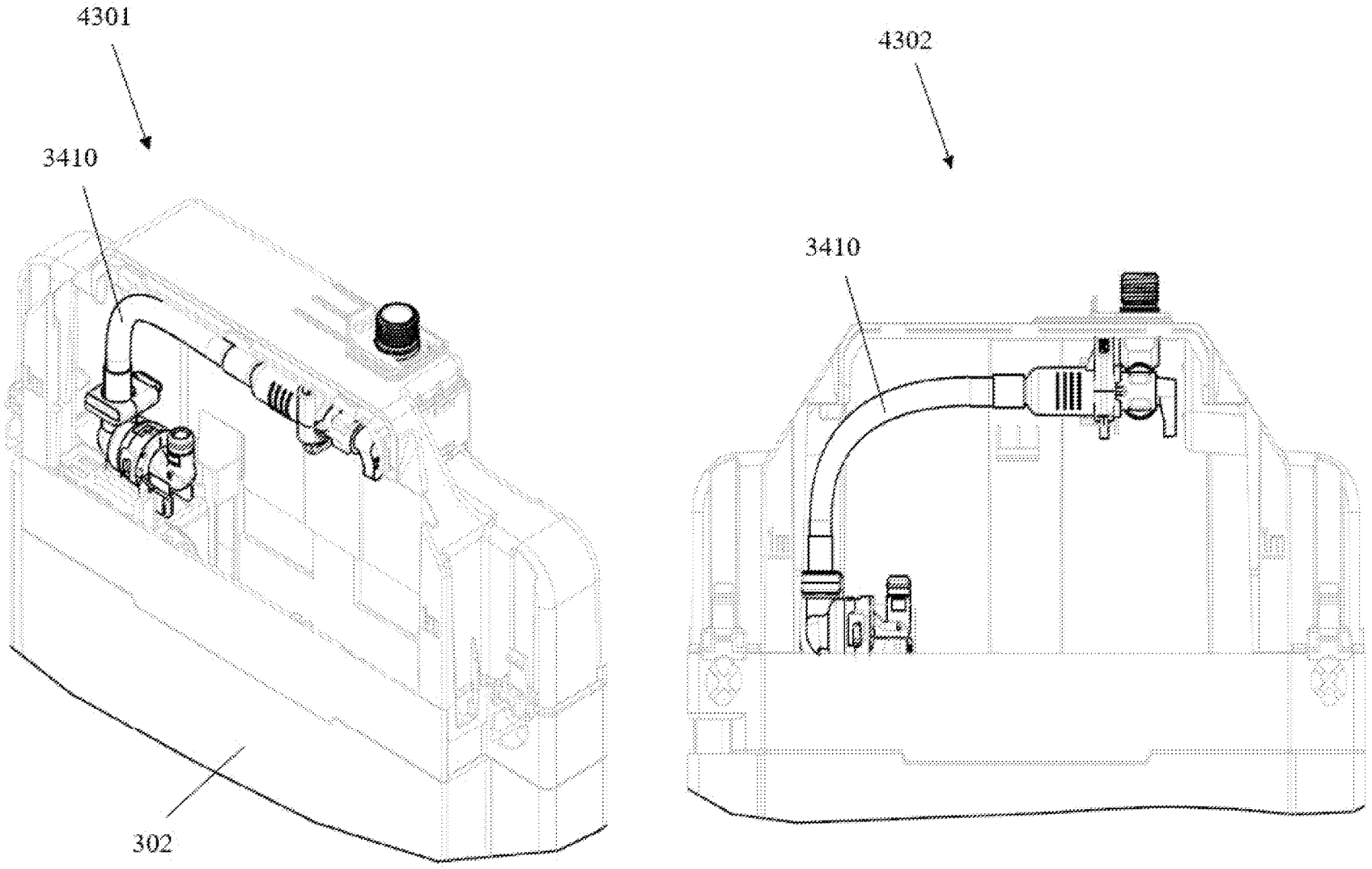
FIG. 43 illustrates an isometric view 4301 and a front view 4302 of the fluid supply assembly 3410 installed withing the cistern assembly 302 according to some embodiments.

FIG. 43 illustrates an isometric view 4301 and a front view 4302 of the fluid supply assembly 3410 installed withing the cistern assembly 302 according to some embodiments.

Figure 44:
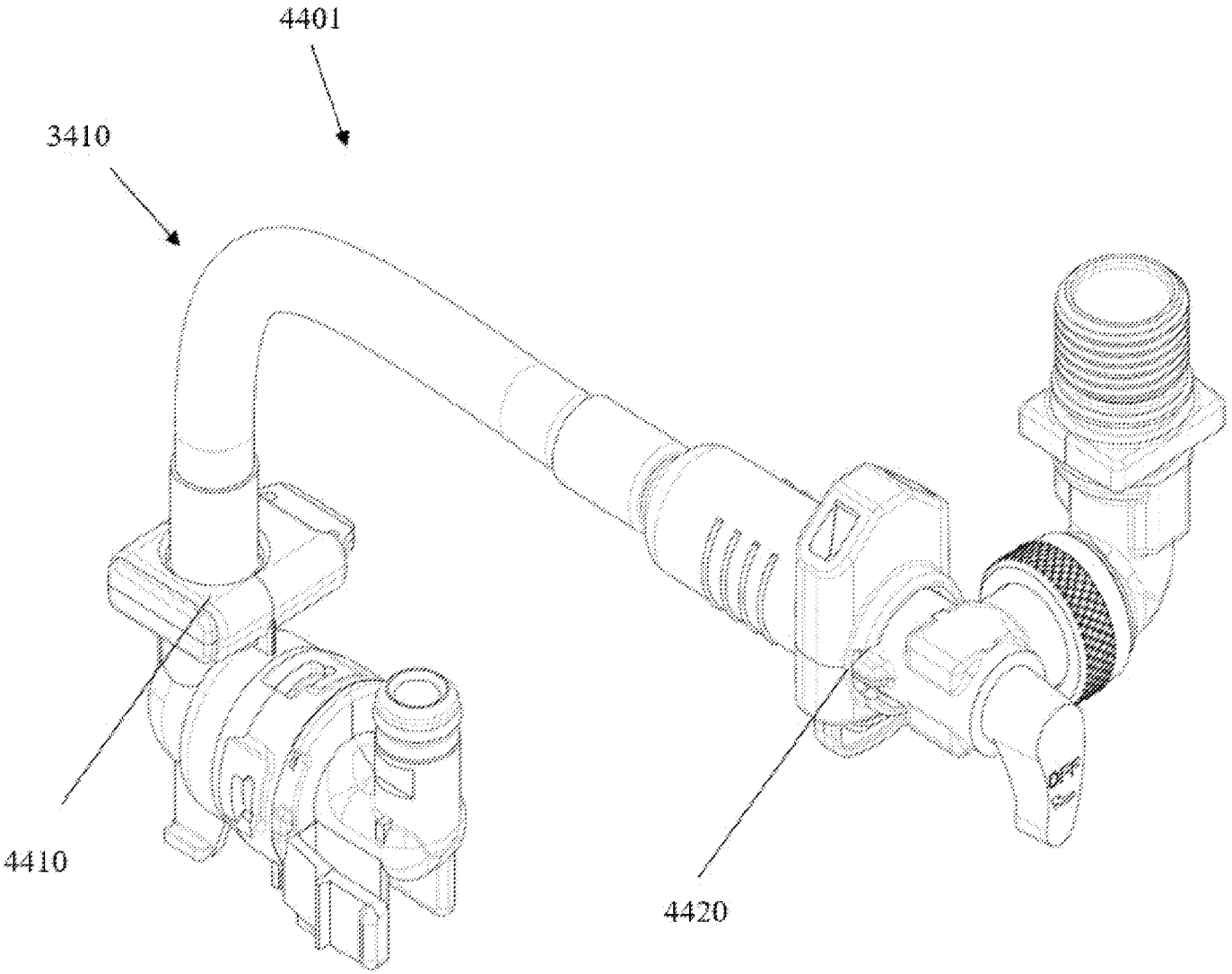
FIG. 44 shows an assembled isolated view 4401 of the fluid supply assembly 3410 including a manifold quick connect system 4410 and a filter housing quick connect system 4420, which may also be referred to a as manifold connect system 4410 and a housing connect system 4420 according to some embodiments.

FIG. 44 shows an assembled isolated view 4401 of the fluid supply assembly 3410 including a manifold quick connect system 4410 and a filter housing quick connect system 4420, which may also be referred to a as manifold connect system 4410 and a housing connect system 4420 according to some embodiments.

Figure 45:
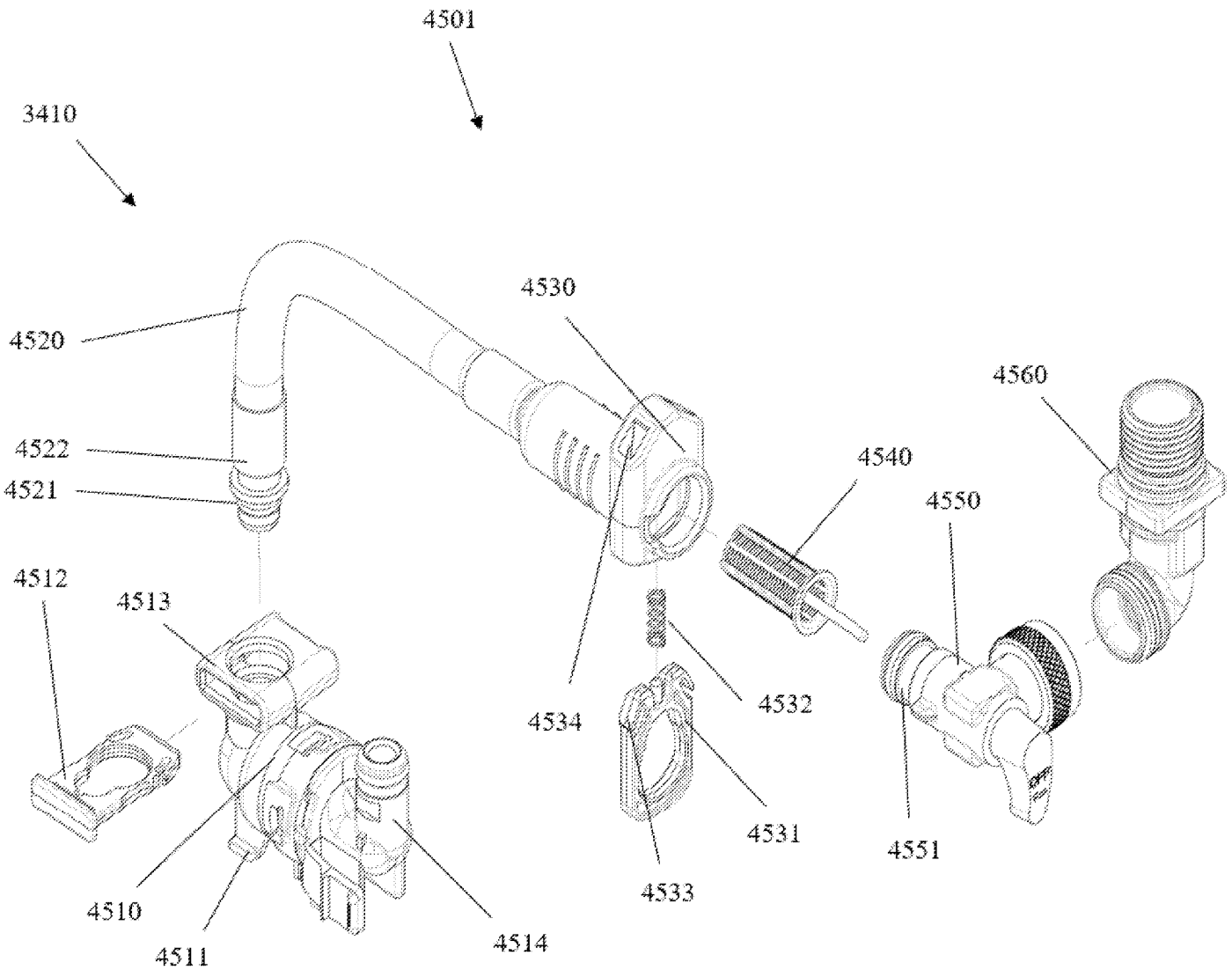
FIG. 45 shows as exploded view 4501 of isolated view 4401 according to some embodiments.

FIG. 45 shows as exploded view 4501 of isolated view 4401 according to some embodiments. In some embodiments, the fluid supply assembly 3410 includes manifold 4510, a flex hose 4520, a filter housing 4530, a filter 4540, a stop valve 4550, and an inlet shank 4560. In some embodiments, the manifold 4510 includes one or more tabs 4511 configured to couple to one or more slots on the supply platform 3232 to secure the manifold 4510 in place. In some embodiments, the manifold fill valve outlet 4514 is configured to couple to a bottom portion of the fill valve assembly 5110 and enable fluid delivery thereto. In some embodiments, the manifold 4510 is configured to couple to the flex hose 4520 by engaging a manifold lock 4512 with one or more grooves 4521 at a first end 4522 of the flex hose 4520 while the manifold lock 4512 is inserted into the manifold lock housing 4513.

In some embodiments, filter housing 4530 comprises a similar structure where the filter housing 4530 (which in this non-limiting example is integral to flex hose 4520) is configured to couple to the stop valve 4550 engaging a filter housing lock 4531 with one or more grooves 4551 on the stop valve 4550. In some embodiments, the filter housing quick connect system 4420 comprises a spring 4532 which forces the filter housing lock 4531 away from the filter housing 4530 when flexible tabs 4533 are depressed through housing slots 4534.

In some embodiments, the manifold lock is configured to be pulled by hand force to disengage a manifold locking portion 4512 on the manifold lock 4511 such that the first end 4521 can be pulled through the manifold lock housing 4513 of the manifold lock 4511. In some embodiments, the maintenance window 140 is configured to enable disassembly of one or more portions of the fluid supply assembly 3410 without disassembling one or more other portions of the system 100 other than the flush panel.

Figure 46:
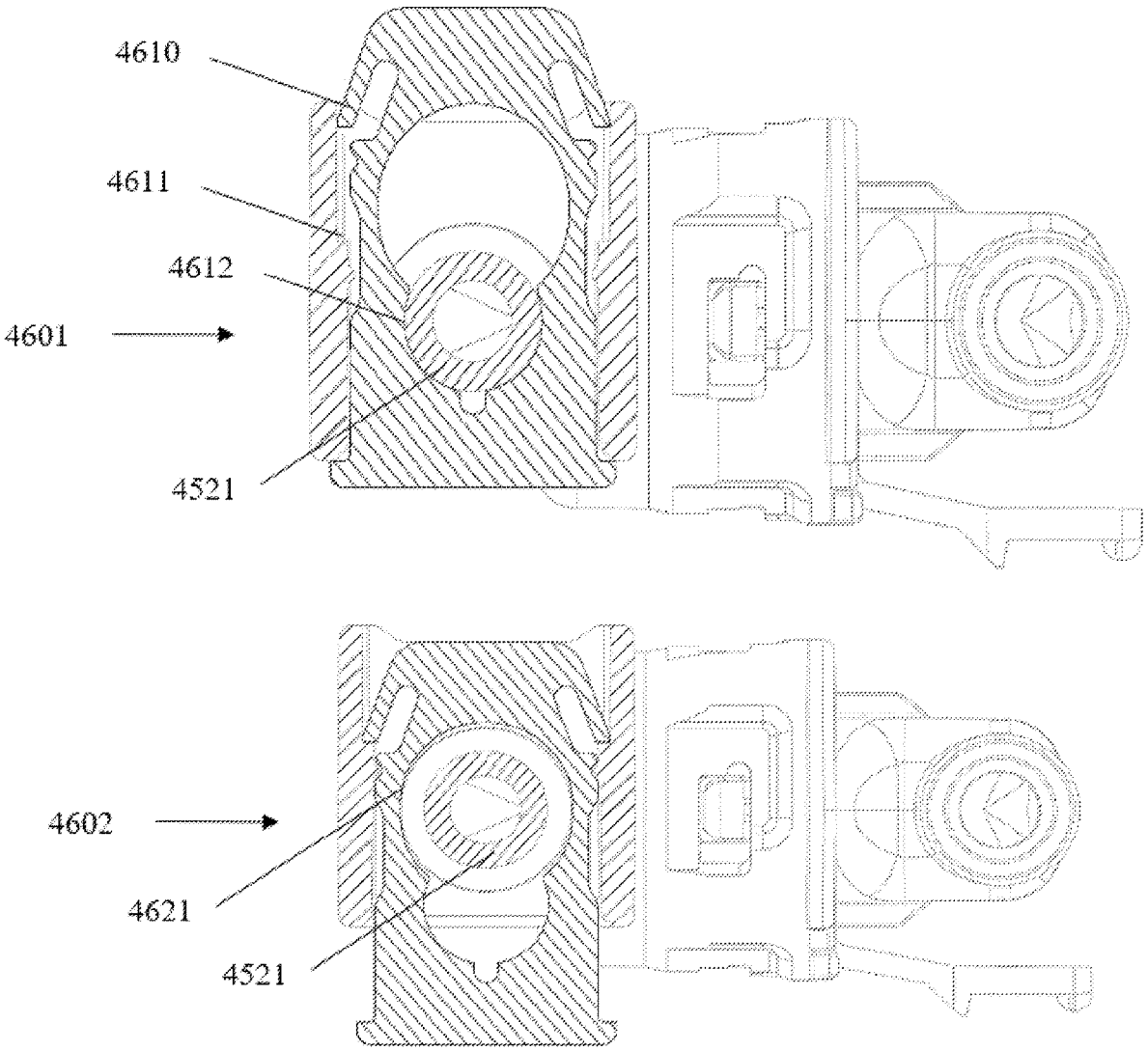
FIG. 46 shows the manifold quick connect system 4410 in a locked position 4601 and an unlocked position 4602 according to some embodiments.

FIG. 46 shows the manifold quick connect system 4410 in a locked position 4601 and an unlocked position 4602 according to some embodiments. In some embodiments, the manifold locking portion 4512 comprises one or more manifold locking tabs 4610 configured to interfere with one or more manifold tab seats 4611 to prevent complete removal of the manifold locking portion 4512 when in an unlocked position 4602. In some embodiments, in a locked position 4601 the manifold locking portion 4512 includes an engaging opening 4612 configured to couple the first end 4521 to the manifold lock 4511. In some embodiments, in an unlocked position 4601 the manifold locking portion 4512 includes a disengaging opening 4621 configured to uncouple the first end 4521 to the manifold lock 4511. In some embodiments, the manifold locking portion 4512 can be inserted into and/or removed from the manifold lock housing 4513 by depressing the one or more manifold locking tabs 4610.

Figure 47:
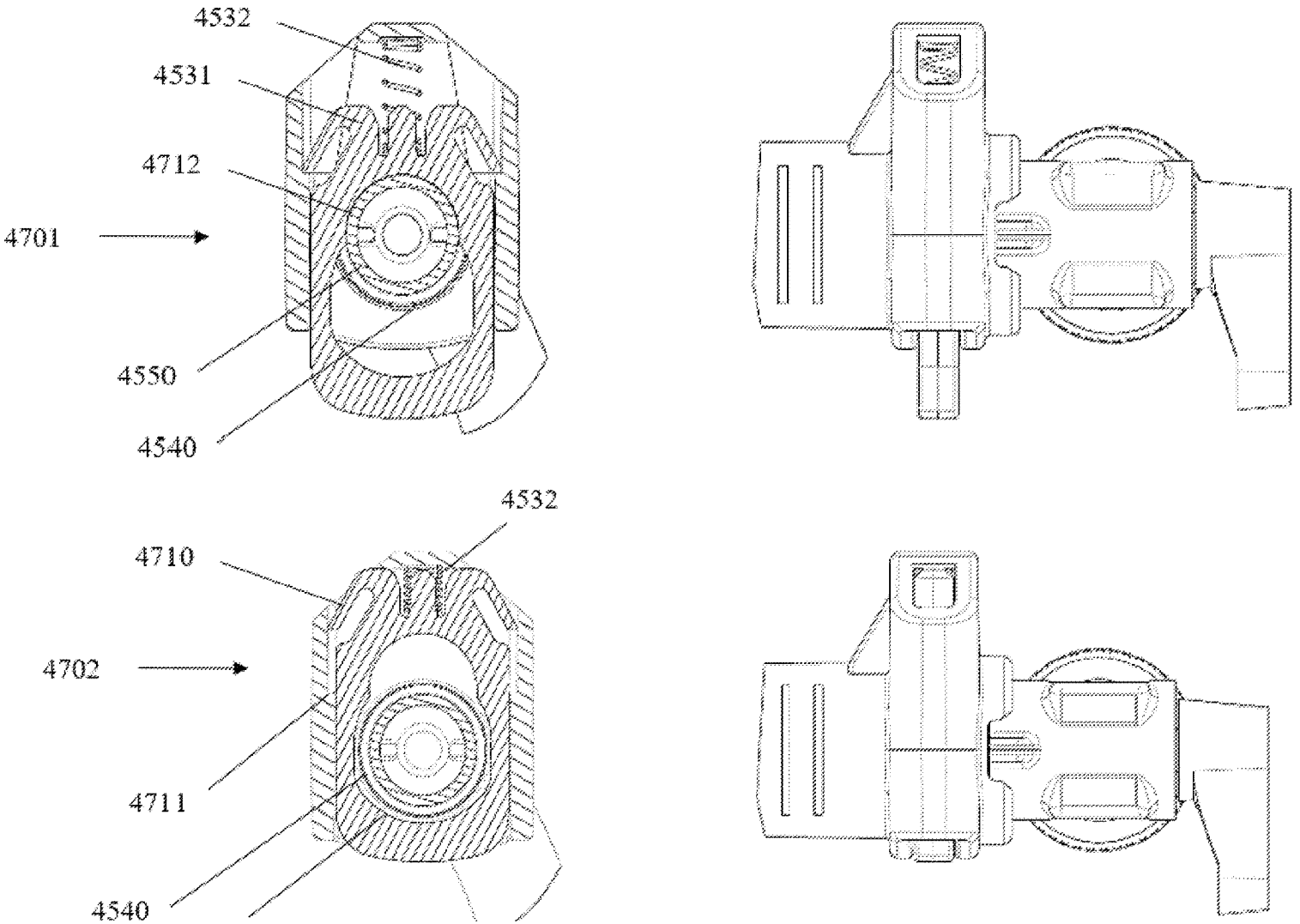
FIG. 47 shows the filter housing quick connect system 4420 in a locked position 4701 and an unlocked position 4702 according to some embodiments.

FIG. 47 shows the filter housing quick connect system 4420 in a locked position 4701 and an unlocked position 4702 according to some embodiments. In some embodiments, the filter housing lock 4531 comprises one or more housing locking tabs 4710 configured to interfere with one or more housing tab seats 4711 to prevent complete removal of the filter housing lock 4531 when the stop valve 4550 is removed. In some embodiments, in a locked position 4701 the filter housing lock 4531 includes an engaging opening 4712 configured to couple the one or more grooves 4551 to the filter housing 4530. In some embodiments, in an unlocked position 4702 the filter housing lock 4531 includes a disengaging opening 4721 configured to enable the one or more grooves 4551 to pass therethrough. In some embodiments, the filter housing lock 4531 is configured to be inserted into and/or removed from the filter housing 4530 by depressing the one or more housing locking tabs 4710.

Advantageously, the spring 4532 is configured to bias the filter housing lock 4531 in a locked position 4701 to prevent the filter 4540 from falling out of the filter housing 4530 when the filter housing quick connect system 4420 is decoupled from the stop valve 4550. In some embodiments, a diameter of the disengaging opening 4721 is less than a diameter of at least a portion of the filter 4540 to prevent the filter 4540 from falling out of the filter housing 4530 when the filter housing quick connect system 4420 is decoupled from the stop valve 4550 and the filter 4540 resides within the filter housing 4530.

Figure 48:
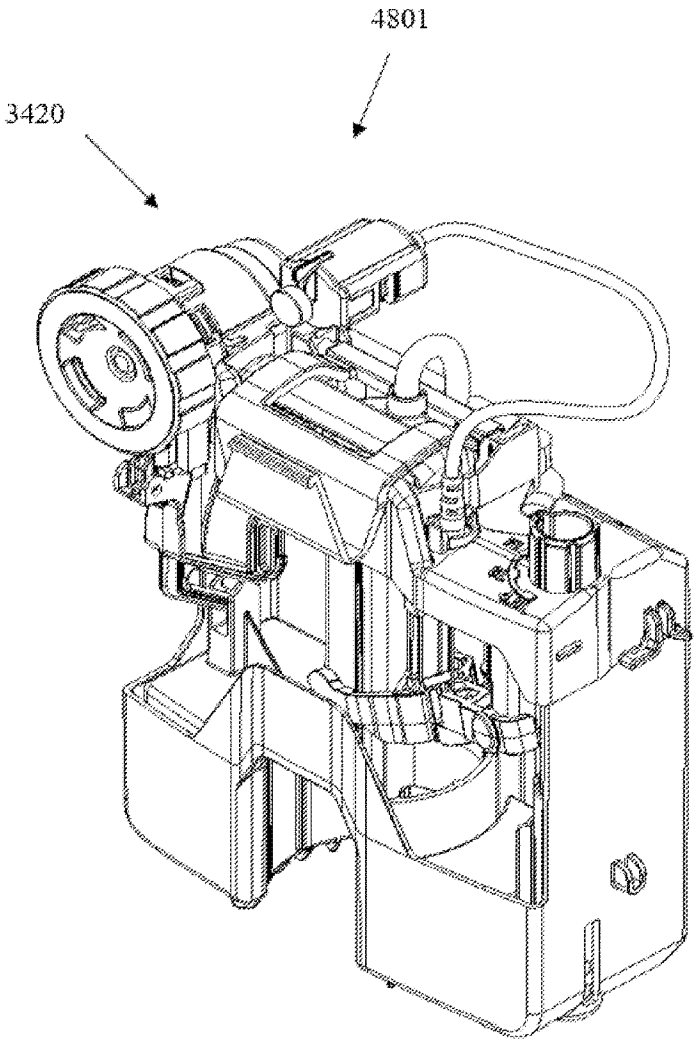
FIG. 48 shows zoomed view 4801 of the flush valve assembly 3420 according to some embodiments.
Figure 48:
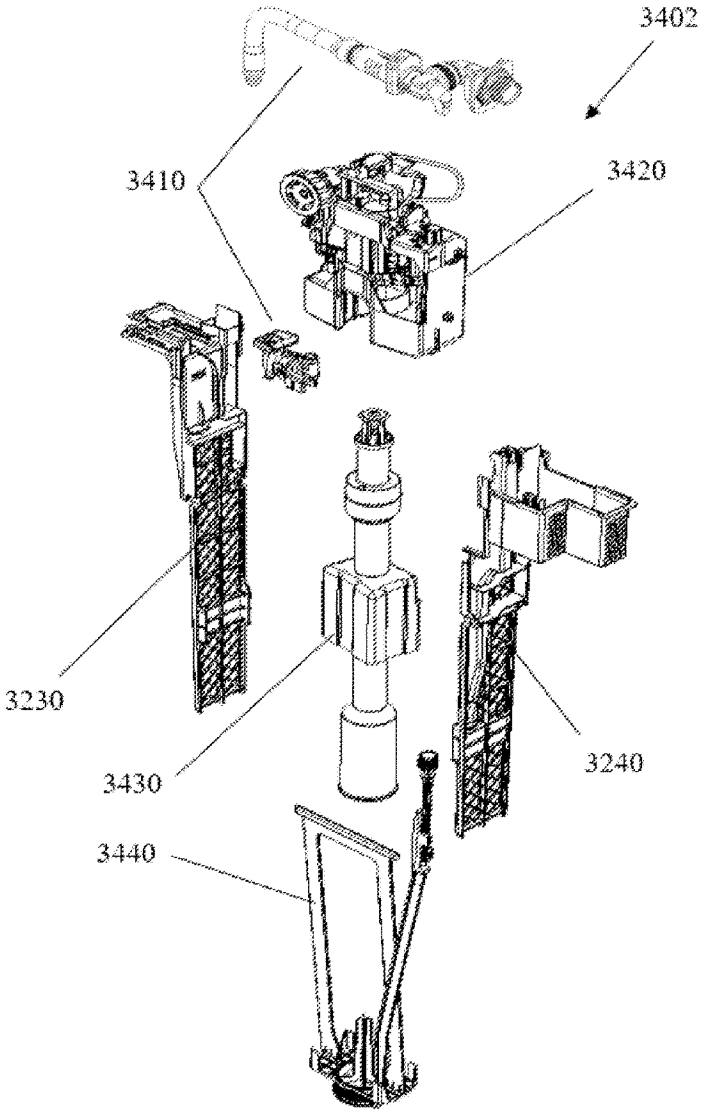
Figure 49:
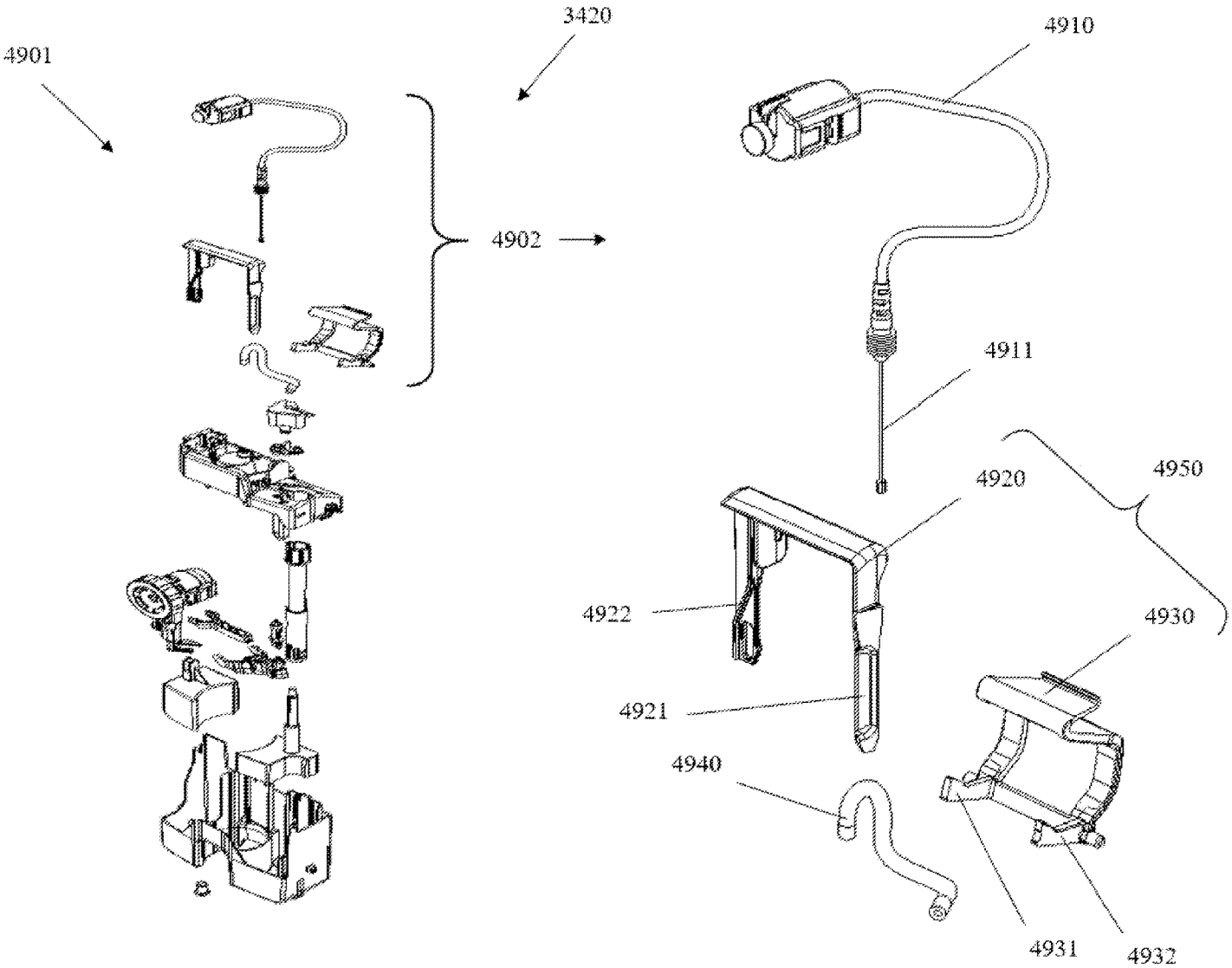
FIG. 49 illustrates an exploded view 4901 of the flush valve assembly 3420 and a zoomed view of a first portion 4902 of the exploded view 4901 according to some embodiments.

FIG. 48 shows zoomed view 4801 of the flush valve assembly 3420 according to some embodiments. FIG. 49 illustrates an exploded view 4901 of the flush valve assembly 3420 and a zoomed view of a first portion 4902 of the exploded view 4901 according to some embodiments. In some embodiments, the flush valve assembly 3420 comprises one or more of a cable assembly 4910 assembly including an activation cable 4911, a fork widener 4920, a locking lever 4930, and a vacuum tube 4940. In some embodiments, a first cam 4931 is configured to move the fork widener 4920 down and a second cam is configured to move the fork widener up.

Figure 50:
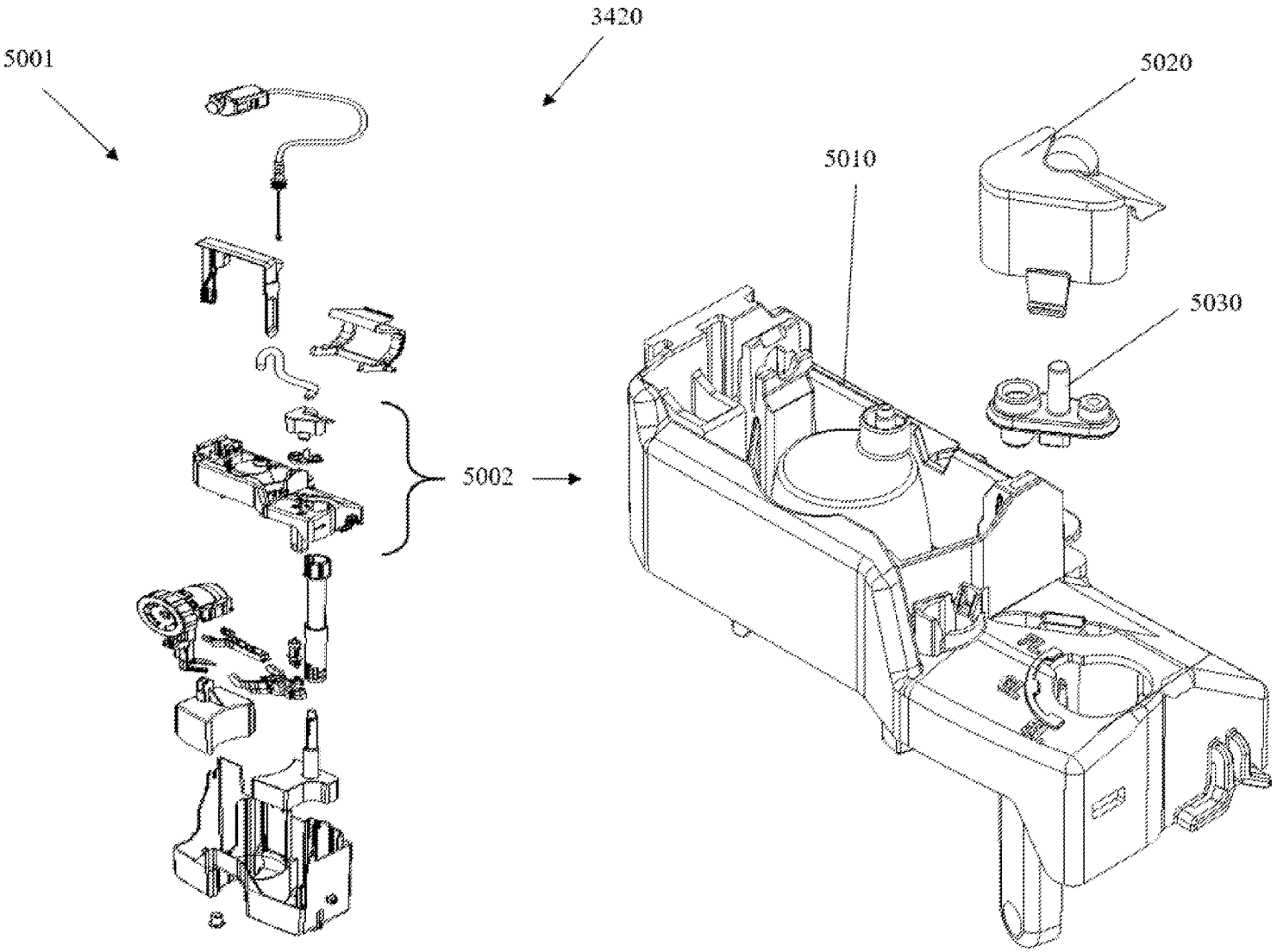
FIG. 50 illustrates an exploded view 5001 of the flush valve assembly 3420 and a zoomed view of a first portion 5002 of the exploded view 5001 according to some embodiments.

FIG. 50 illustrates an exploded view 5001 of the flush valve assembly 3420 and a zoomed view of a first portion 5002 of the exploded view 5001 according to some embodiments. In some embodiments, the flush valve assembly 3420 comprises one or more of a vacuum assembly 5010, a diverter valve cover 5020, and a diverter valve 5030.

Figure 51:
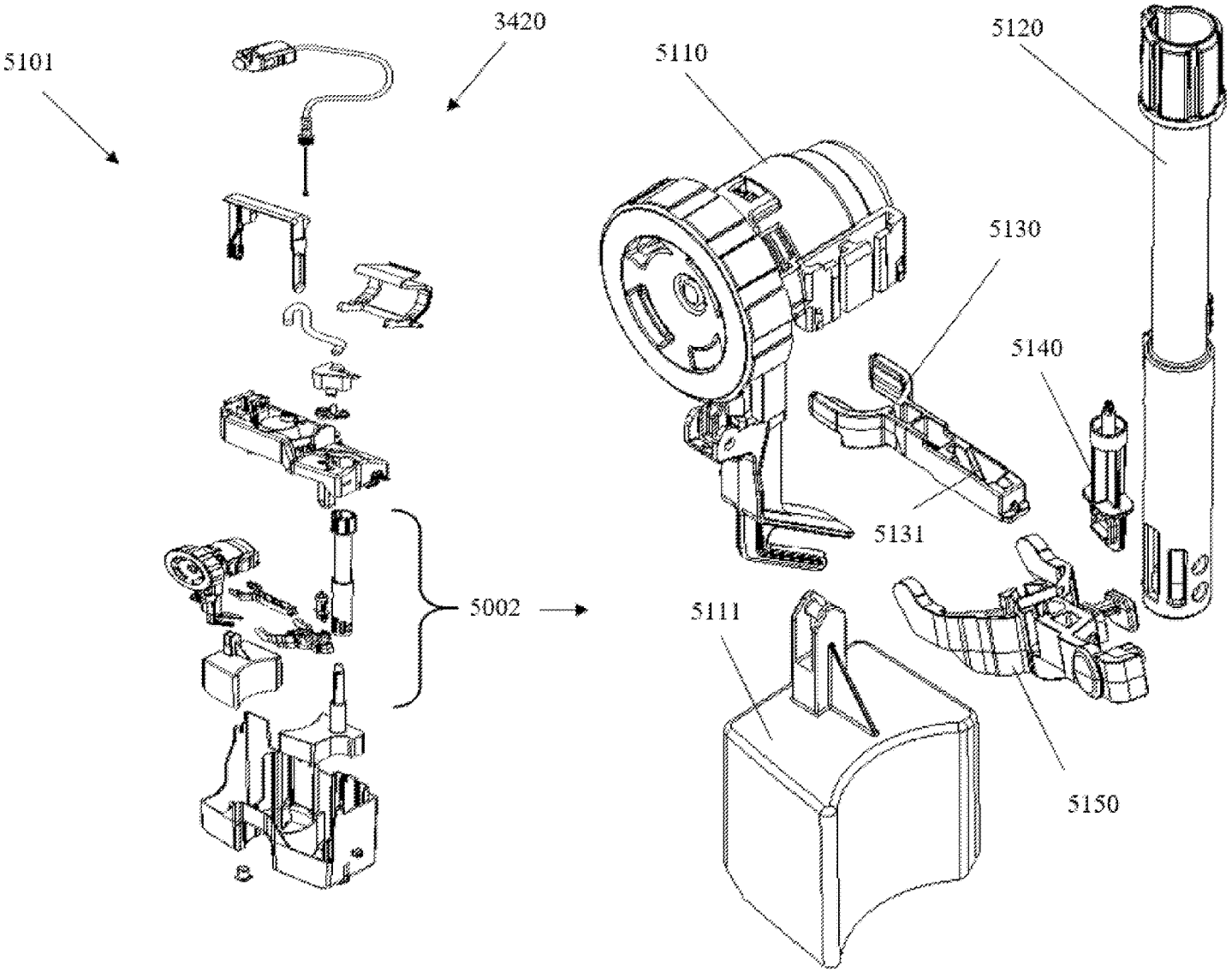
FIG. 51 illustrates an exploded view 5101 of the flush valve assembly 3420 and a zoomed view of a first portion 5102 of the exploded view 5101 according to some embodiments.

FIG. 51 illustrates an exploded view 5101 of the flush valve assembly 3420 and a zoomed view of a first portion 5102 of the exploded view 5101 according to some embodiments. In some embodiments, the flush valve assembly 3420 comprises one or more of a fill valve assembly 5110, a flush timer 5120, a valve assembly lock 5130, a fork piston 5140, and a flush fork 5150.

Figure 52:
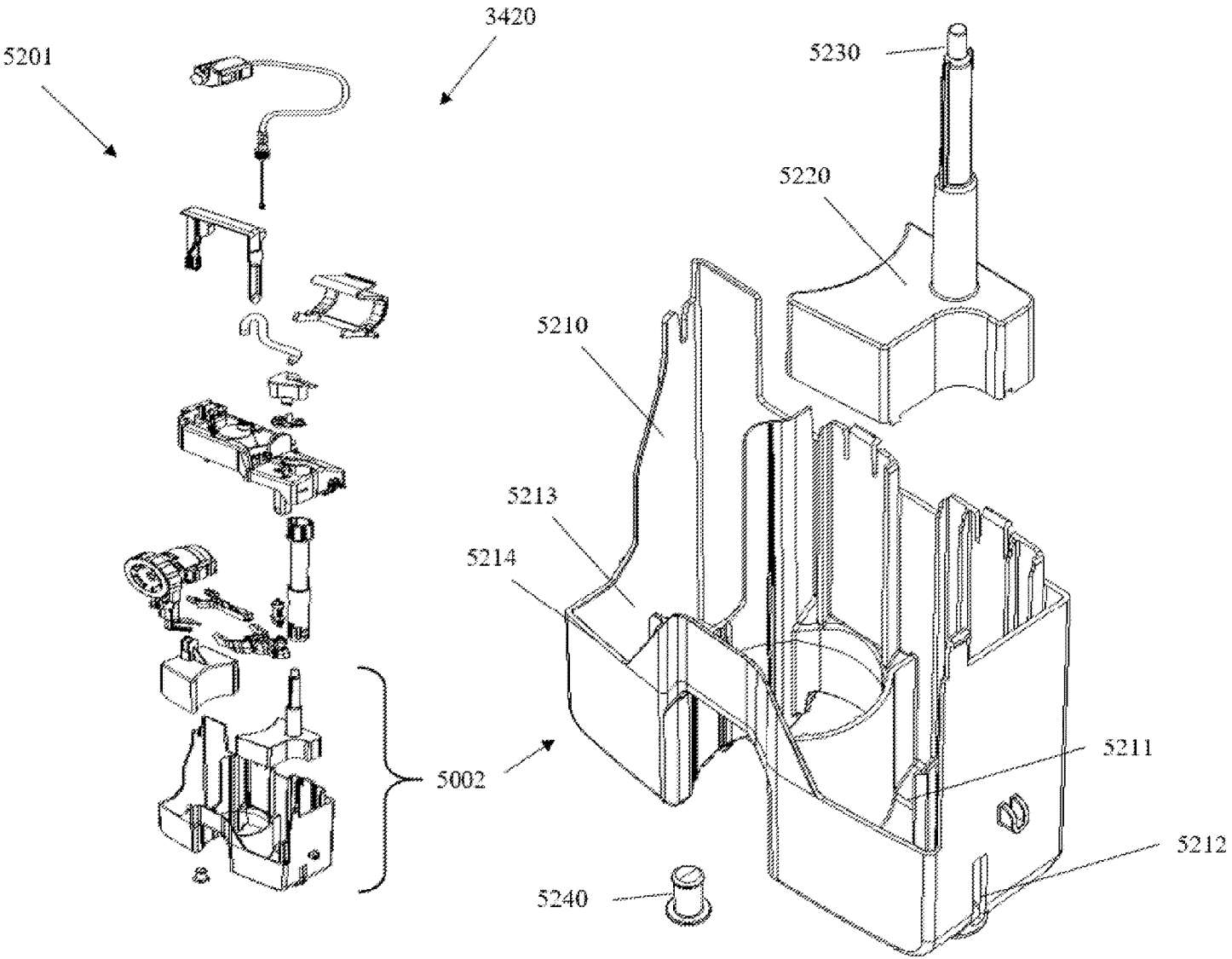
FIG. 52 illustrates an exploded view 5201 of the flush valve assembly 3420 and a zoomed view of a first portion 5202 of the exploded view 5201 according to some embodiments.

FIG. 52 illustrates an exploded view 5201 of the flush valve assembly 3420 and a zoomed view of a first portion 5202 of the exploded view 5201 according to some embodiments. In some embodiments, the flush valve assembly 3420 comprises a fill valve housing 5210, a fill fluid compartment 5213, a spill edge 5214 a timing float 5220, a timing piston 5230, and a drain poppet 5240. In some embodiments, the drain poppet is configured to enable fluid to drain from the drain housing 5210 when a fluid level drops below the drain poppet 5240.

Figure 53:
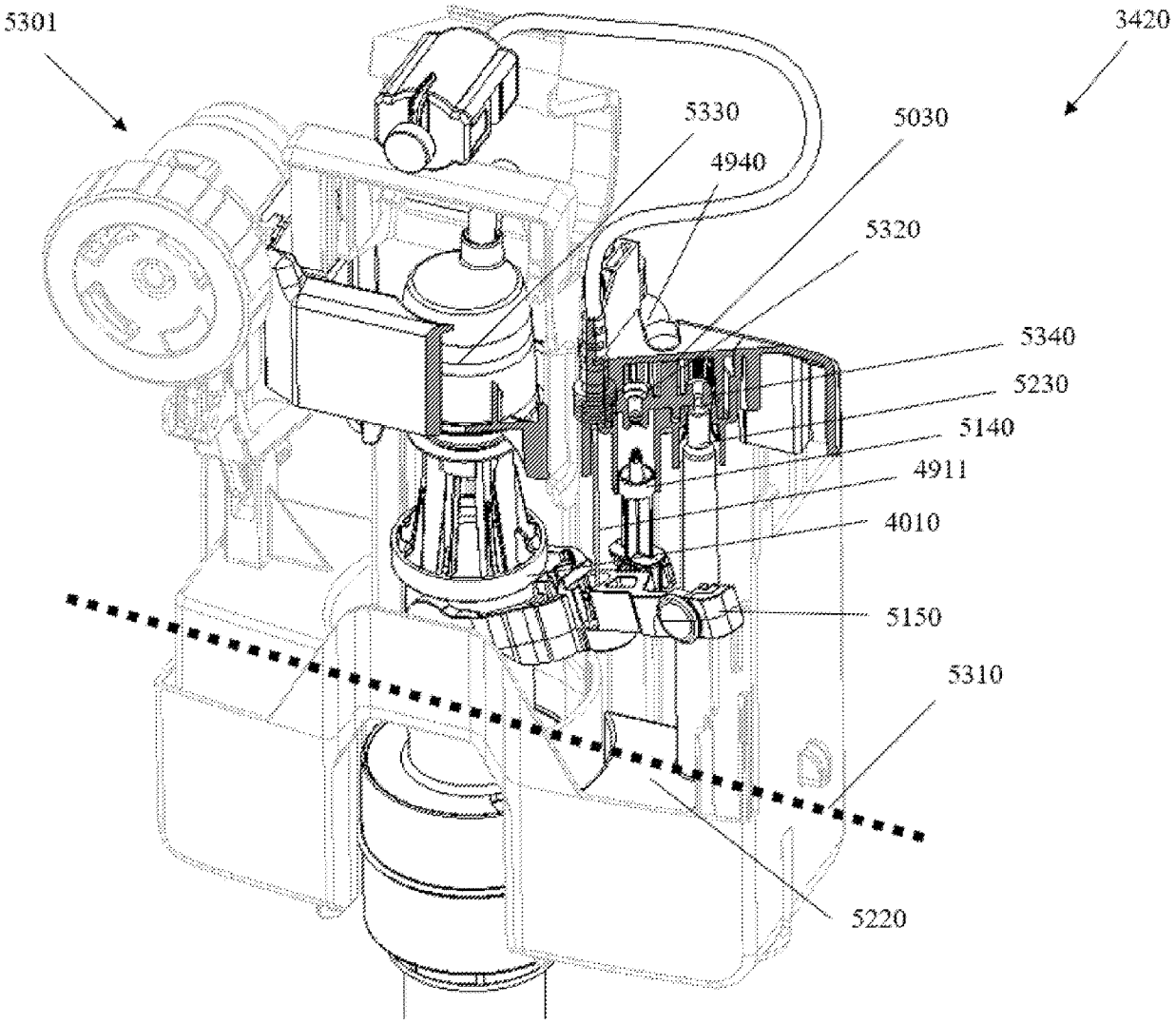
FIG. 53 shows a section view 5301 of the flush valve assembly 3420 where the activation cable 4911 has not been actuated and the fluid line 5310 is at its maximum level according to some embodiments.

FIG. 53 shows a section view 5301 of the flush valve assembly 3420 where the activation cable 4911 has not been actuated and the fluid line 5310 is at its maximum level according to some embodiments. The flush fork 5150 is at its lowermost position, however in some embodiments tension force caused by the activation spring keeps the flush fork 5150 in contact with a bottom portion of the vacuum cap 4010. In some embodiments, the fork piston 5140 which is coupled to the flush fork 5150 is separated from a fork piston seal 5320 on the diverter valve 5030. In some embodiments, the diverter valve 5030 is coupled to the vacuum cap housing 5330 by vacuum tube 4940. In some embodiments, the timing piston 5230 is engaged with the timing seal 5340 on the diverter valve 5030 as it is configured to be lifted by buoyancy force by the timing float 5220 when the fluid level 5310 is at its maximum. However, there is no vacuum formed in the vacuum assembly 5010 as the fork piston seal 5320 is exposed to atmosphere.

Figure 54:
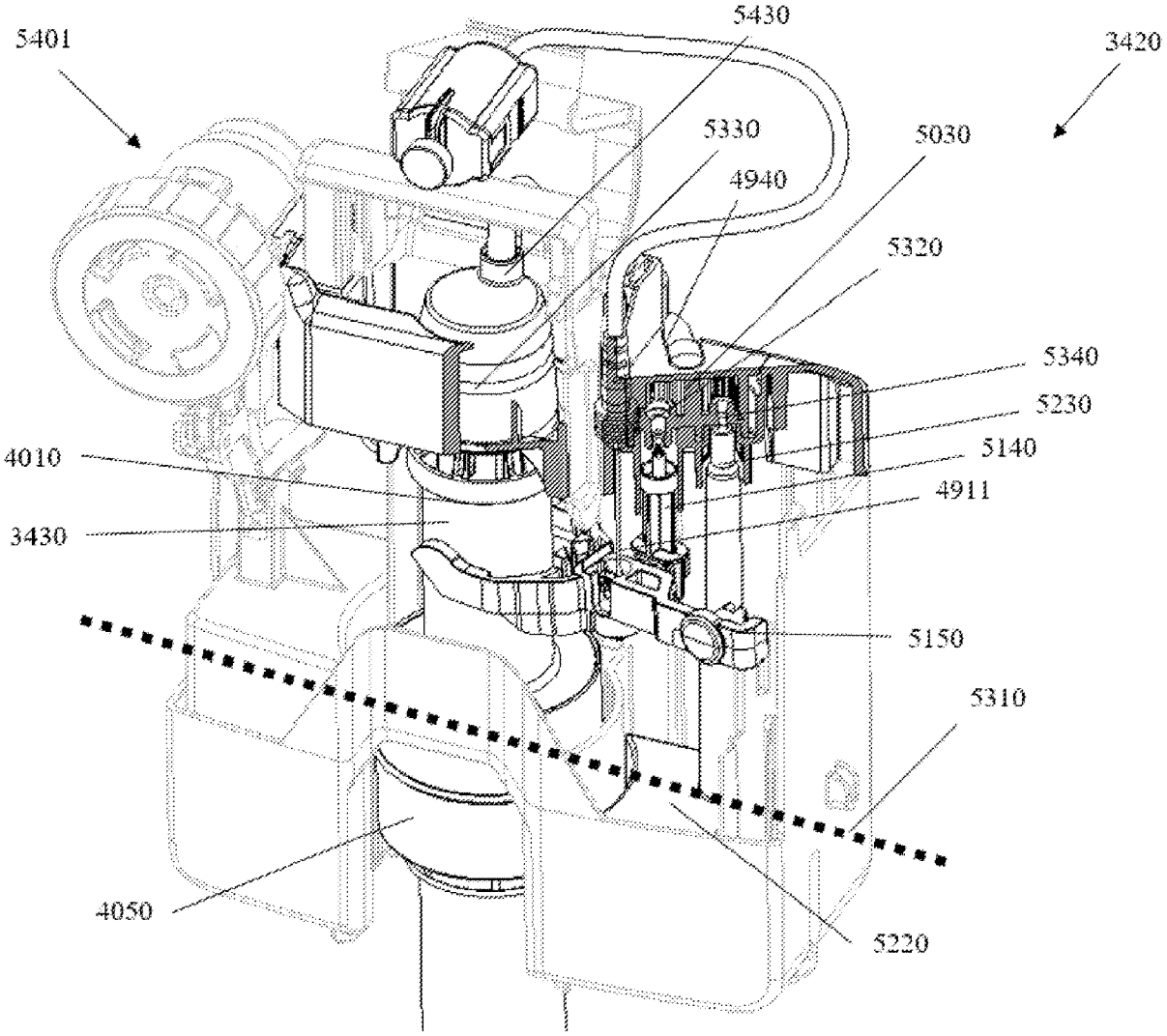
FIG. 54 shows a section view 5401 of the flush valve assembly 3420 where the activation cable 4911 has been partially actuated and the fluid line 5410 is still at its maximum level according to some embodiments.

FIG. 54 shows a section view 5401 of the flush valve assembly 3420 where the activation cable 4911 has been partially actuated and the fluid line 5410 is still at its maximum level according to some embodiments. In some embodiments, the flush fork 5150 has lifted the flush tube 3430 off the valve seat 3520 and the buoyancy force caused by one or more of flush float 4060, flush cover 4070, and/or hollow portion 4012 has lifted the flush tube 3430 up and away from flush fork 5150 to where the cap seal 4013 seals the vacuum cap opening 5430 from atmosphere.

In some embodiments, the fork piston 5140 which is coupled to the flush fork 5150 is separated from a fork piston seal 5320 on the diverter valve 5030. In some embodiments, the timing piston 5230 is still engaged with the timing seal 5340 on the diverter valve 5030 because fluid level 5310 is still at its maximum at the beginning of the flush cycle. However, there is still no vacuum formed in the vacuum assembly 5010 as the fork piston seal 5320 is exposed to atmosphere as the fork piston has not been lifted to its full position. In some embodiments, as the weight of the fluid inside the ballast tank 4050 in addition to the weight of the flush tube 3430 above the fluid line overcomes the buoyance force of the flush float 4060, the flush tube 3430 will lower and the flush cover 4070 will engage against the valve seat 3520 leaving a preset amount of fluid within the fluid tank 3210. In some embodiments, the volume of fluid in the fluid tank 3210 after a partial flush is approximately half the initial volume of fluid (e.g., 3.5 liters in a 7 liter tank).

Figure 55:
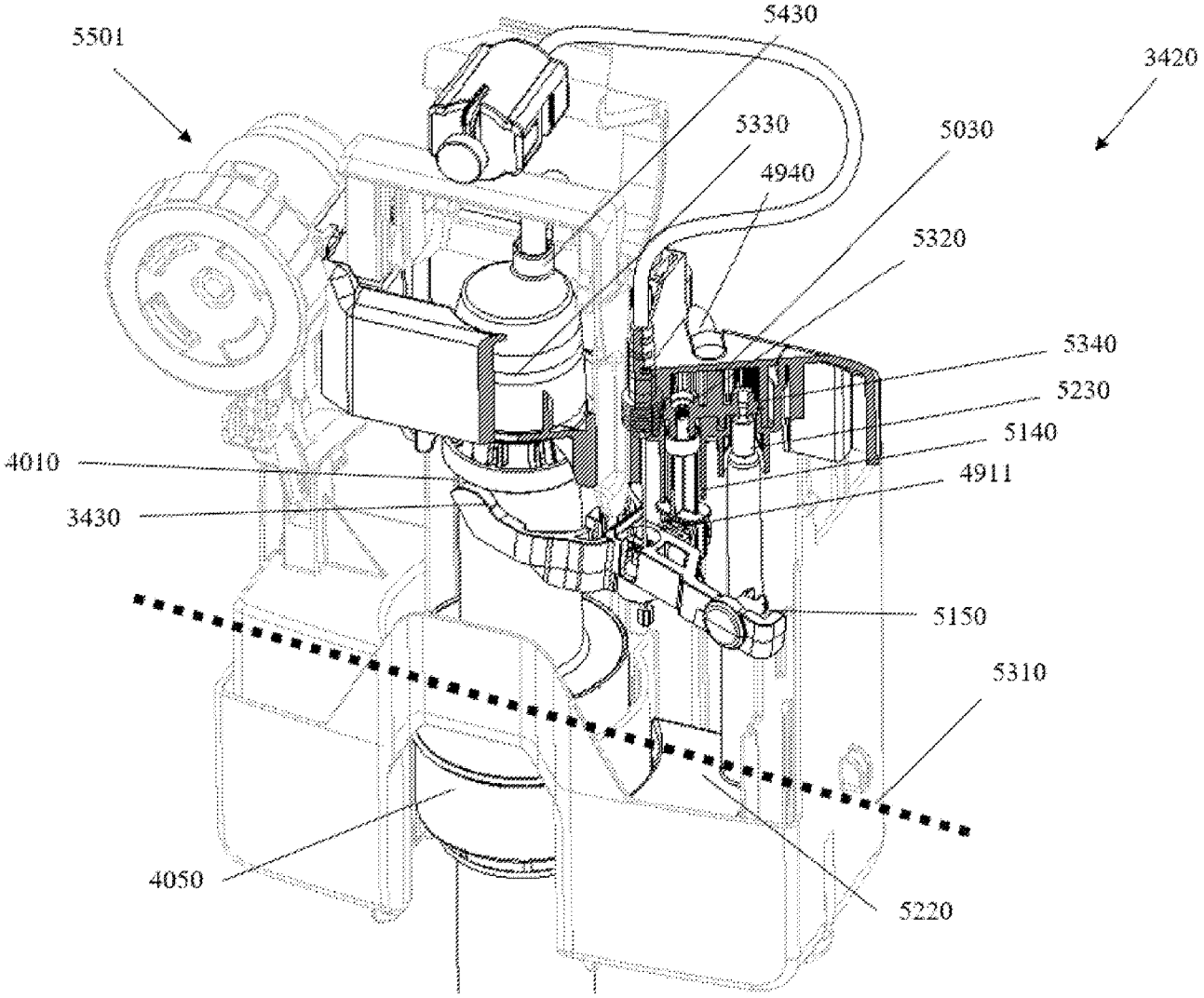
FIG. 55 shows a section view 5501 of the flush valve assembly 3420 where the activation cable 4911 has been fully actuated and the fluid line 5410 is still at its maximum level according to some embodiments.

FIG. 55 shows a section view 5501 of the flush valve assembly 3420 where the activation cable 4911 has been fully actuated and the fluid line 5410 is still at its maximum level according to some embodiments. In some embodiments, the flush fork 5150 has lifted the flush tube 3430 off the valve seat 3520 and the buoyancy force caused by one or more of flush float 4060, flush cover 4070, and/or hollow portion 4012 has lifted the flush tube 3430 up to where the cap seal 4013 seals the vacuum cap opening 5430 from atmosphere. While the flush fork 5150 is shown in contact with a bottom portion of the vacuum cap 4010, it is the buoyance force that lifts the flush tube 3430 into its max position. In some embodiments, during full flush activation, the flush fork 5150 only needs to be raised to its maximum position to engage the fork piston 5140 with the fork piston seal 5320. In some embodiments, during a full flush actuation one end of the vacuum assembly 5010 is sealed by both the fork piston 5140 and the timing piston 5230 while the other end is sealed by the cap seal 4013. In some embodiments, this configuration, the vacuum created in vacuum assembly 5010 prevents the cap seal 4013 from disengaging from the vacuum cap housing 5330, holding the flush tube in its maximum position until the vacuum is broken by the timing piston 5230 as further described below.

Figure 56:
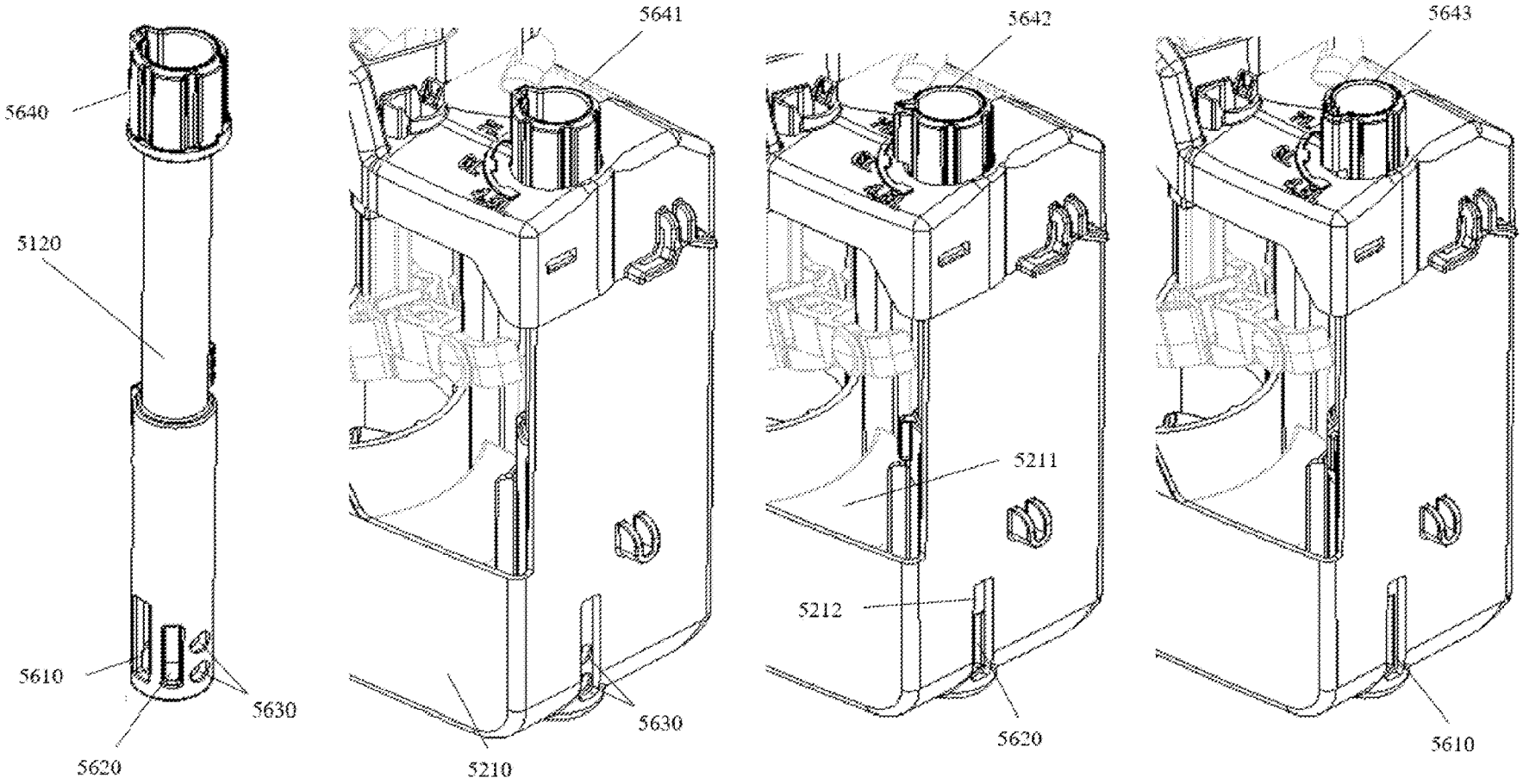
FIG. 56 illustrates the timing mechanism to control when the timing piston 5230 disengages from the timing seal 5340 according to some embodiments.

FIG. 56 illustrates the timing mechanism to control when the timing piston 5230 disengages from the timing seal 5340 according to some embodiments. In some embodiments, when the fluid level is at its maximum, the fill valve housing 5210 is configured to enable the fluid to at least partially fill its internal volume. In some embodiments, the fluid compartment 5211 is configured to only allow fluid trapped in the timing compartment 5211 through one or more timing discharges 5212. In some embodiments, in order for the fluid to flow out a timing discharge 5212 it must first flow through flush timer 5120. In some embodiments, flush timer 5120 comprises one or more timing openings 5610, 5620, and 5630 that each comprise a different area and therefore allow the fluid to exit the timing discharge 5212 at a different flowrate. In the non-limiting example shown, the flush timer 5120 is configured to enable three different flowrates each corresponding to a different final fluid level in the fluid tank 3210 by rotating the timing knob 5640 to one or more positions 5641, 5642, and 5643. In some embodiments, a first position 5641 corresponds to a 4.5 liter discharge. In some embodiments, a second position 5642 corresponds to a 6 liter discharge. In some embodiments, a second position 5642 corresponds to a 7 liter discharge. In some embodiments, a timing opening comprises a gap that increases linearly around a portion of the flush timer 5120 enabling a continuously variable discharge rate as the timing knob 5640 is rotated. Advantageously, the maintenance window 140 is configured to enable the timing knob 5640 to be accessed as well as one or more other adjustable components.

In some embodiments, as the fluid level in the fluid tank 3210 drops, enough fluid is discharged from the timing compartment 5211 to enable the timing piston 5230 to disengage from the timing seal 5340 breaking the vacuum and allowing the flush tube 3430 to fall and seat as previously described.

Figure 57:
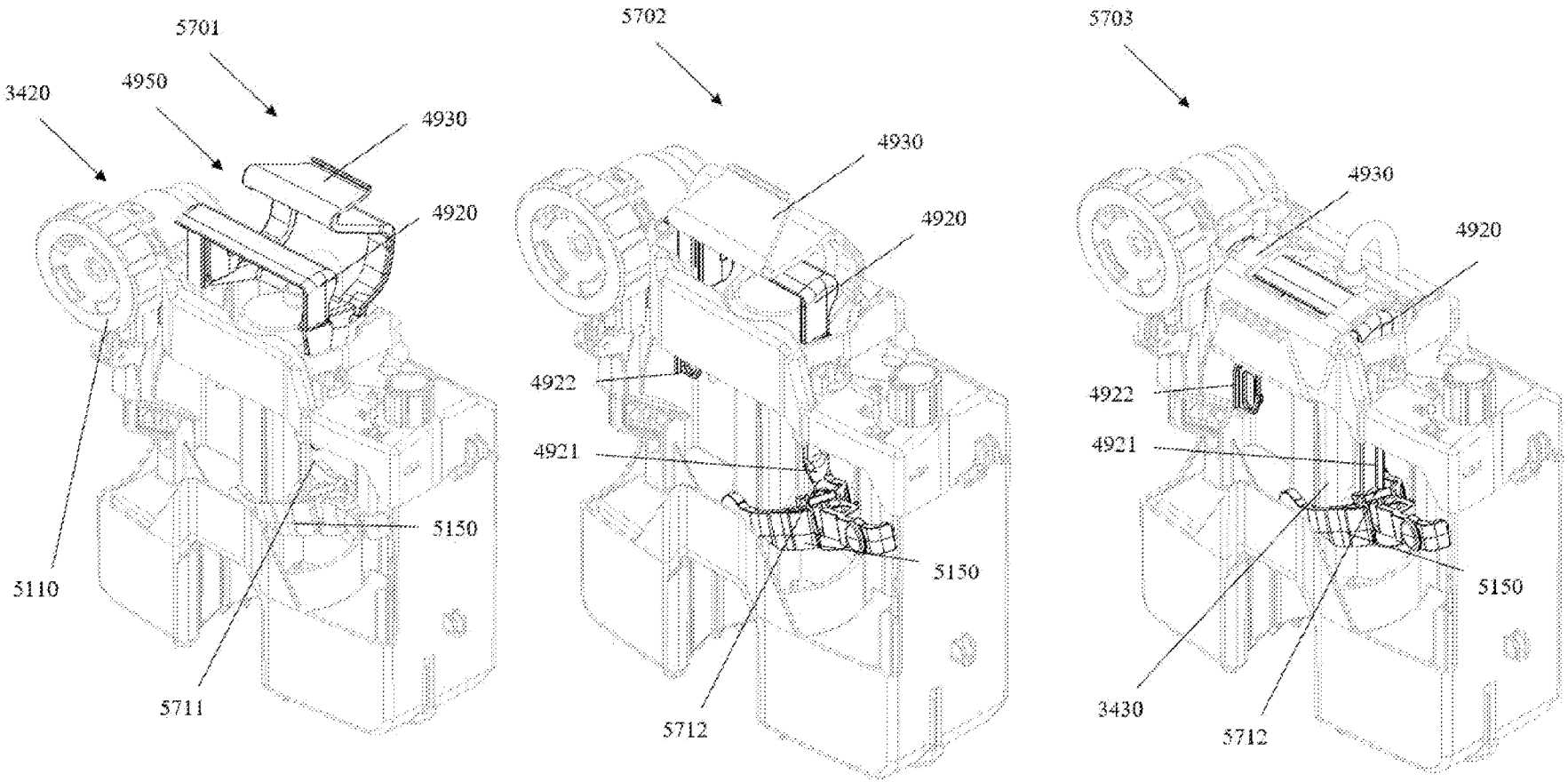
FIG. 57 depicts various stages of an engagement assembly 4950 according to some embodiments.

FIG. 57 depicts various stages of an engagement assembly 4950 according to some embodiments. In some embodiments, the engagement assembly 4950 is configured to widen the flush fork 5150 to where the flush assembly can be installed and or removed. In some embodiments, the engagement assembly 4950 is configured to lock the fill valve assembly 5110 in a secured position.

In some embodiments, view 5701 shows the fork widener 4920 in a locked position which is configured to provide a gap 5711 between the fork spreader 4921 and the flush fork 5150. In some embodiments, the locking lever 4930 is configured to couple to the tank lid 3220 in the locked position securing the flush valve assembly 3420 in place. In some embodiments, view 5702 shows a first disassembly step where the locking lever 4930 is rotated against the fork widener 4920 forcing the fork spreader 4921 against the flush fork 5150. As shown in view 5703, in some embodiments, continued rotation of the locking lever 4930 cause the fork spreader to engage the flush fork 5150 spreading the fork arms wide enough form the flush valve assembly 3420 to be lifted past the flush tube 3430 thereby enabling removal of the flush valve assembly 3420 while the flush tube 3430 remains installed.

Figure 58:
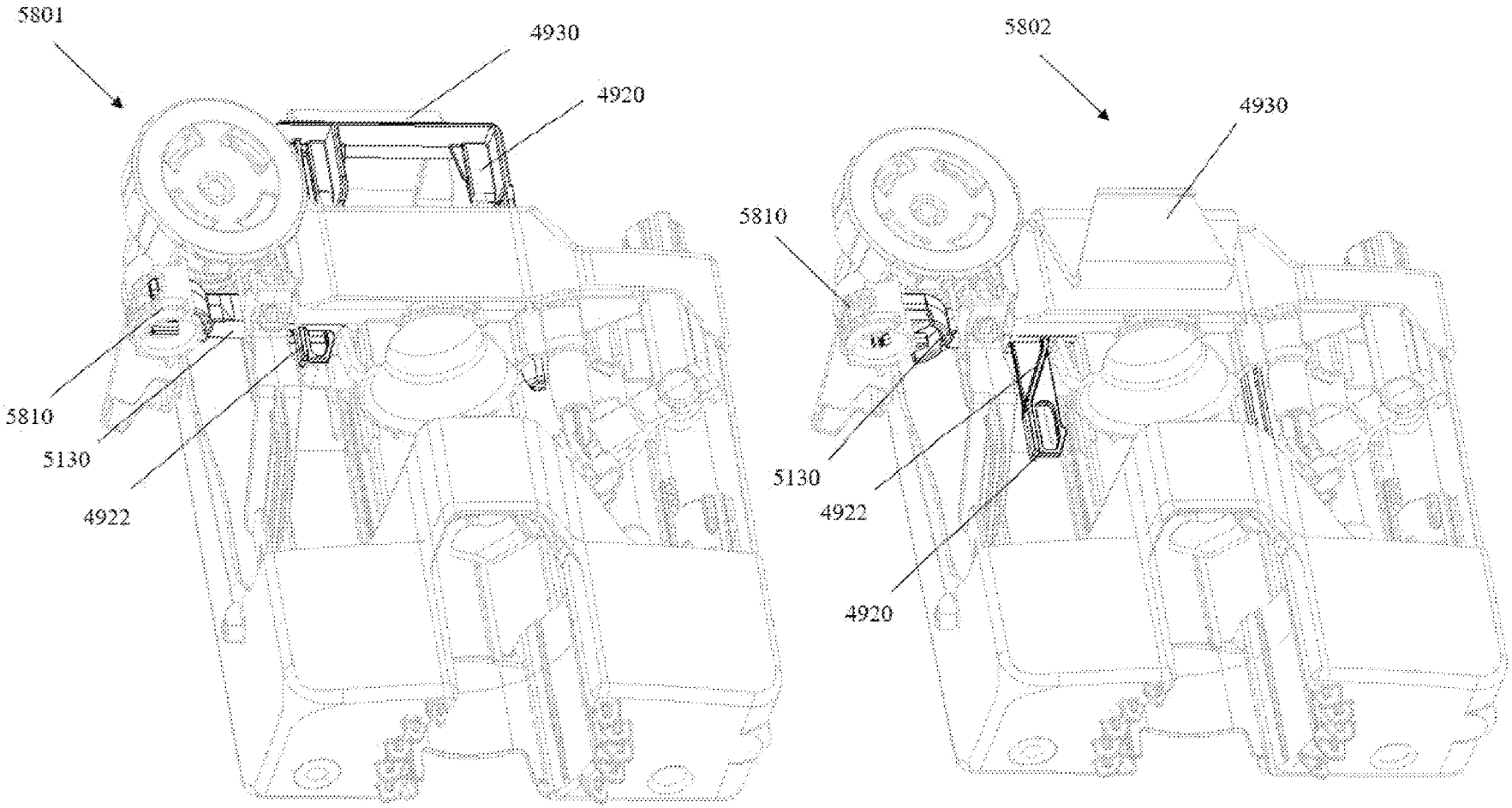
FIG. 58 depicts a locked bottom isometric view 5801 and an unlocked 5802 bottom isometric view 5802 of the flush valve assembly 3420 according to some embodiments.

FIG. 58 depicts a locked bottom isometric view 5801 and an unlocked 5802 bottom isometric view 5802 of the flush valve assembly 3420 according to some embodiments. In some embodiments, the fork widener comprises a linear cam 4922 configured to engage a corresponding linear follower 5131 on valve assembly lock 5130. In some embodiments, in a locked position 5801 the linear cam 4922 is configured to engage the valve assembly lock 5130 against a lock interface 5810 and maintain the valve assembly lock in position. In some embodiments, as the locking lever 4930 is moved down the linear follower 5131 follows the linear cam 4922 which causes the valve assembly lock 5130 to retract, thereby allowing removal of the fill valve assembly through the maintenance window 140. In some embodiments, movement of the fork widener 4920 down cause both a spreading of the flush fork 5150 and movement of the valve assembly lock 5130 simultaneously.

Figure 59:
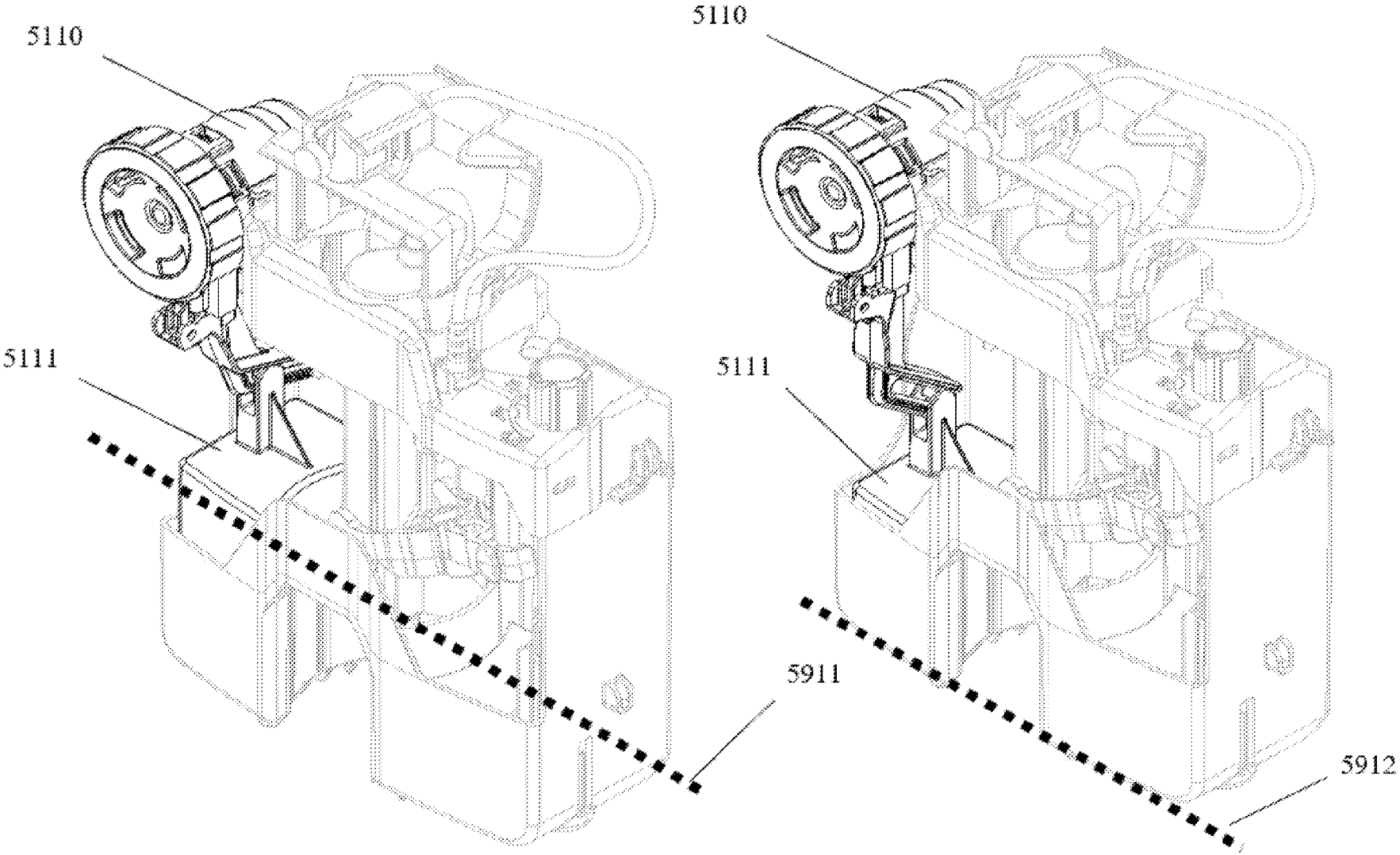
FIG. 59 shows the fill float 5111 of the fill valve assembly 5110 in various positions in relation to fluid levels 5911, 5912 according to some embodiments.

FIG. 59 shows the fill float 5111 of the fill valve assembly 5110 in various positions in relation to fluid levels 5911, 5912 according to some embodiments. In some embodiments, when at maximum fluid level 5911 the fill float 5111 is configured to raise and prevent the flow of fluid into fluid tank 3210. In some embodiments, when the fluid level 5912 is below the fill float 5111 is configured to lower and opening the fill valve assembly 5110 releasing fluid into fluid tank 3210.

Figure 60:
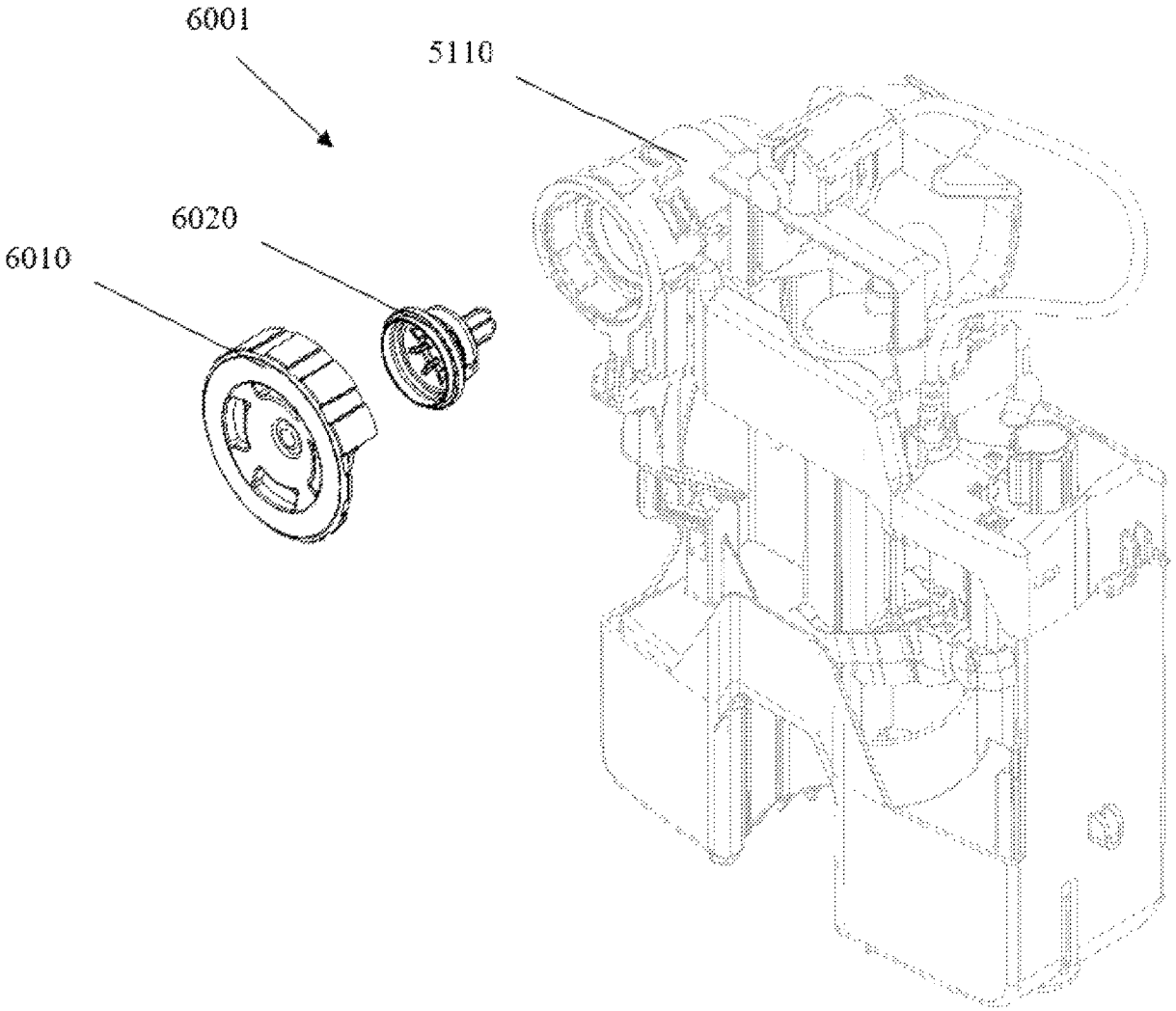
FIG. 60 shows an exploded view 6001 of a portion of the fill valve assembly 5110 according to some embodiments.

FIG. 60 shows an exploded view 6001 of a portion of the fill valve assembly 5110 according to some embodiments. In some embodiments, the maintenance window 140 is configured to enable removal of a service cap 6010 for removal and/or replacement of fill valve seal 6020.

Figure 61:
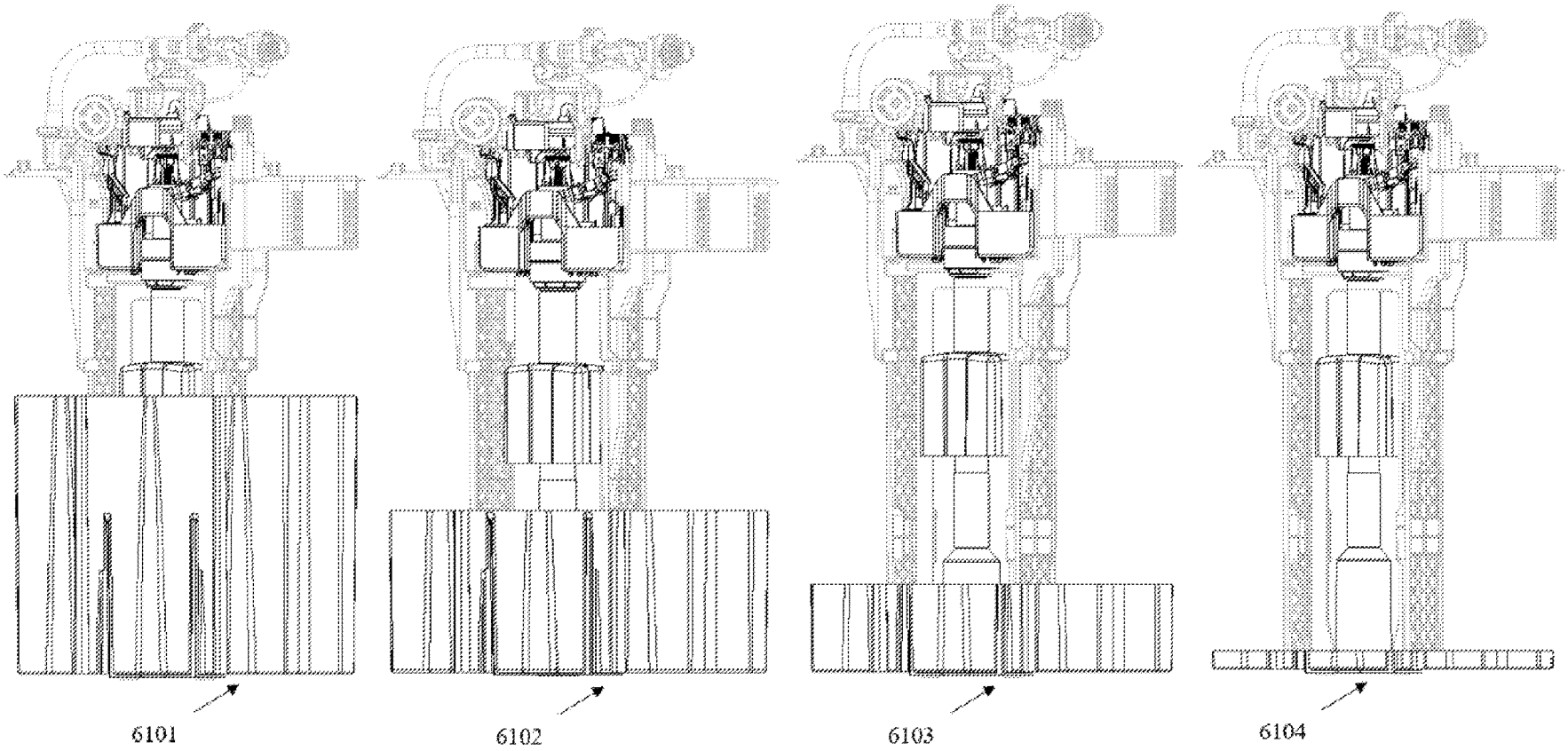
FIG. 61 depicts various fluid level heights 6101-6104 for different flush configurations according to some embodiments.

FIG. 61 depicts various fluid level heights 6101-6104 for different flush configurations according to some embodiments. In some embodiments, fluid level 6101 is a non-limiting example of a partial 3 liter flush. In some embodiments, fluid level 6102 is a non-limiting example of a timed 4 liter full flush. In some embodiments, fluid level 6103 is a non-limiting example of a timed 6 liter full flush. In some embodiments, fluid level 6104 is a non-limiting example of a timed 7 liter full flush.

Figure 62:
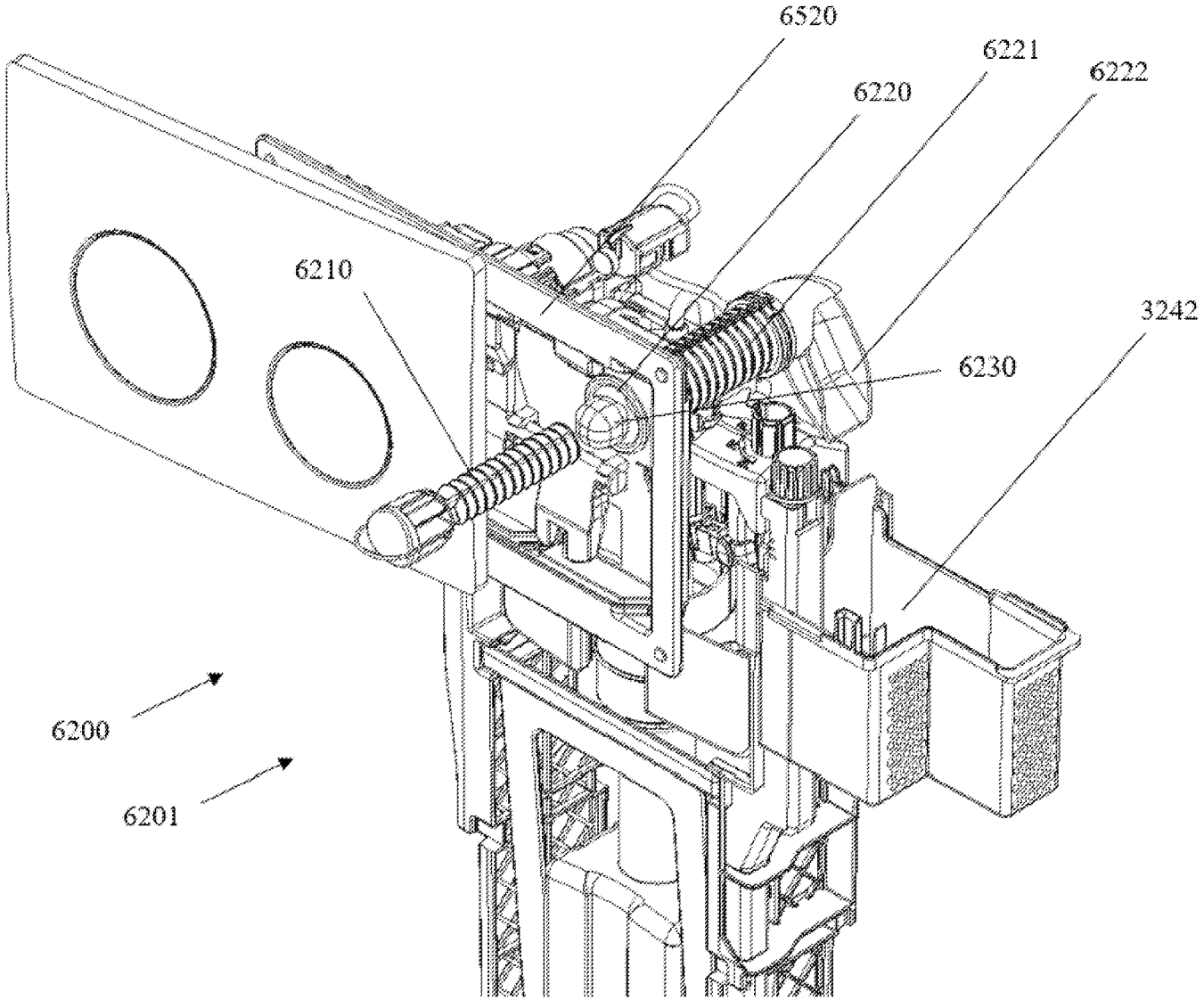
FIG. 62 shows a front view 6200 of a dosing assembly 6201 according to some embodiments.

FIG. 62 shows a front view 6200 of a dosing assembly 6201 according to some embodiments. In some embodiments, the dosing assembly 6200 comprises one or more of a dosing plug 6210, a dosing port 6220, a dosing shaft 6221, a dosing ramp 6222, and a dosing platform 3242 coupled to an activation panel 6520. In some embodiments, the dosing port 6220 is configured to enable a dose 6230 to be inserted therethrough. In some embodiments, the dosing plug 6210 is configured to push one or more doses 6230 through the dosing shaft 6222 to where each of the one or more doses 6230 fall down the dosing ramp 6222 and into the dosing platform 3242.

Figure 63:
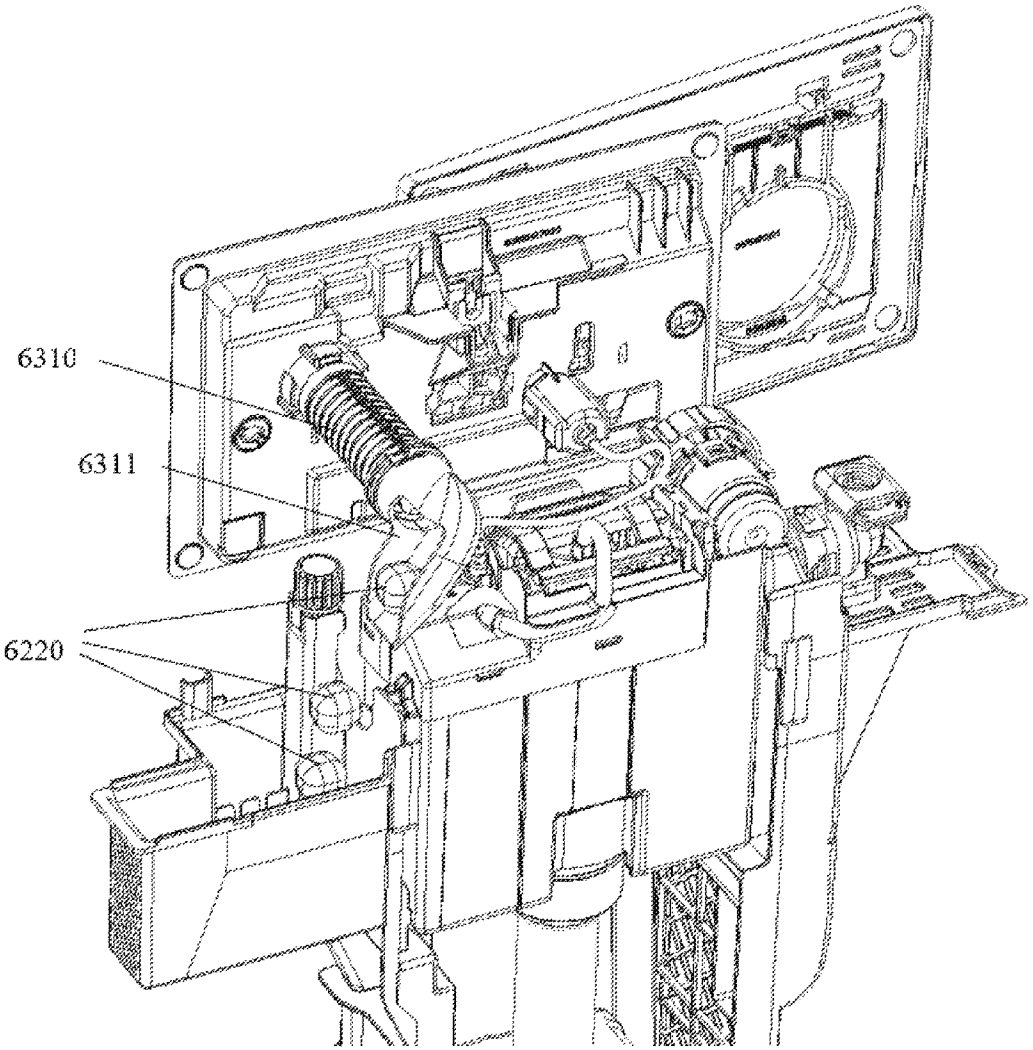
FIG. 63 shows a rear view 6300 of the dosing assembly 6201 according to some embodiments.

FIG. 63 shows a rear view 6300 of the dosing assembly 6201 according to some embodiments. In some embodiments, the dosing platform 3242 comprises one or more opening in one or more walls and/or the floor which fluid to enter the dosing platform 3242 and dissolve the one or more doses 6220. In some embodiments, the one or more openings are configured to enable a dissolved portion of one or more doses 6220 to diffuse through the fluid tank 3210.

Figure 64:
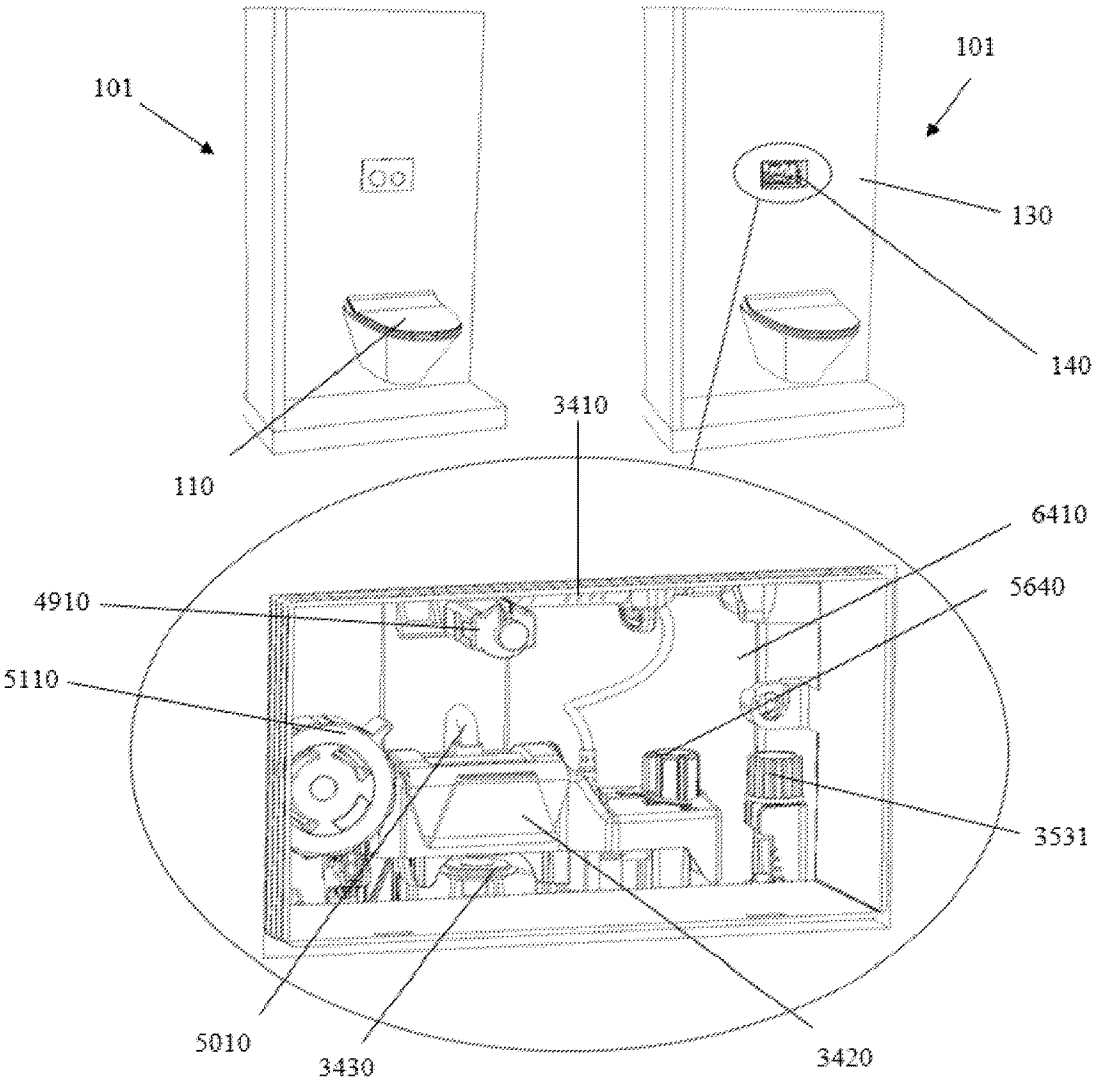
FIG. 64 illustrates the various system 100 components accessible through the maintenance window 140.

FIG. 64 illustrates the various system 100 components accessible through the maintenance window 140. In some embodiments, various system 100 components include one or more of an actuator (cable) assembly 4910, a fill valve assembly 5110, a vacuum assembly, a flush valve assembly 3420, a flush tube 3430, a fluid supply assembly 3410, and a dosing assembly access 6410. In some embodiments, access to one or more components of one or more assemblies through the maintenance window eliminates the need to remove a wall 130 to access serviceable parts of the system 100.

Figure 65:
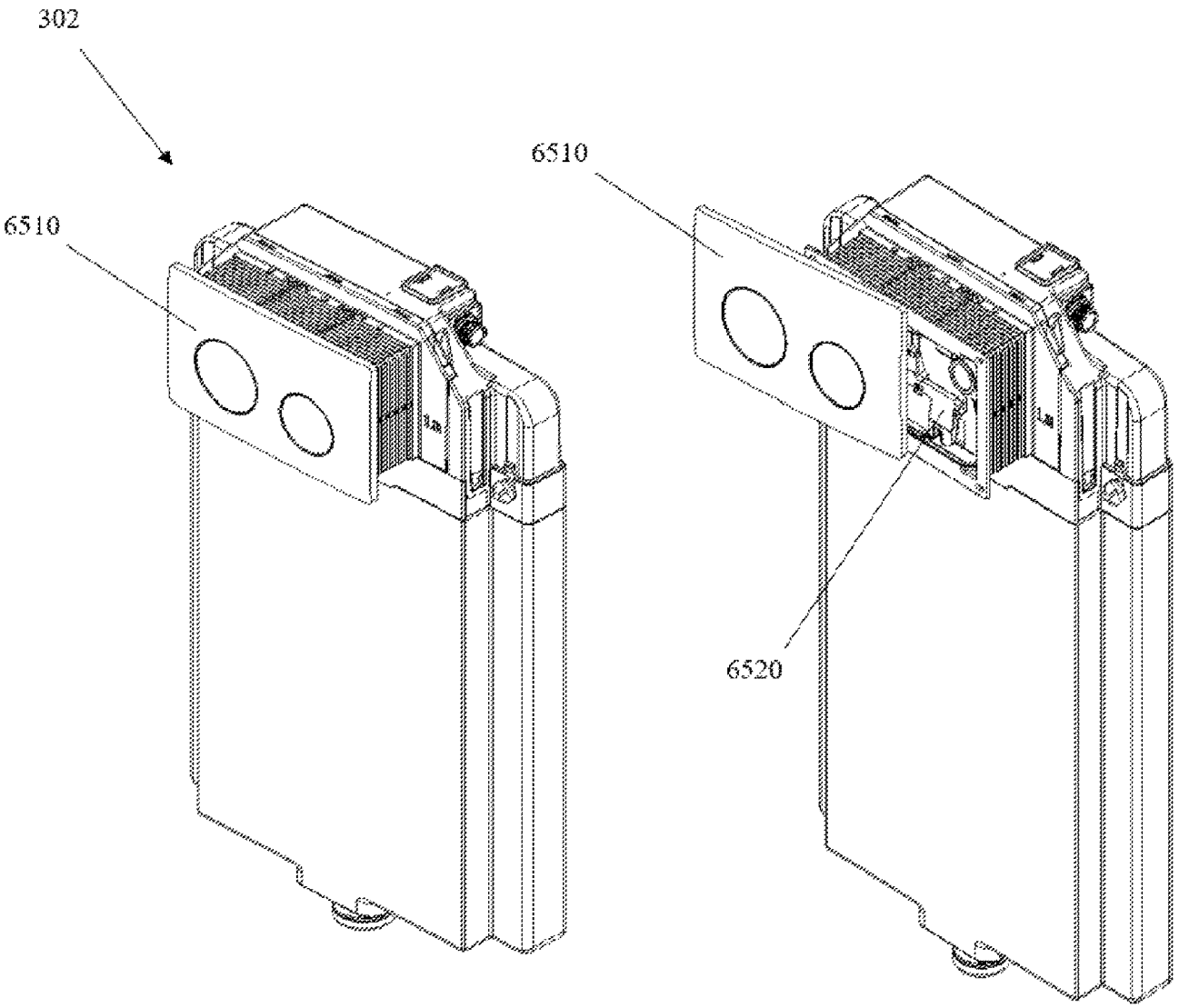
FIG. 65 shows the cistern assembly 302 including a flush plate 6510 and an actuation panel 6520 according to some embodiments.
Figure 66:
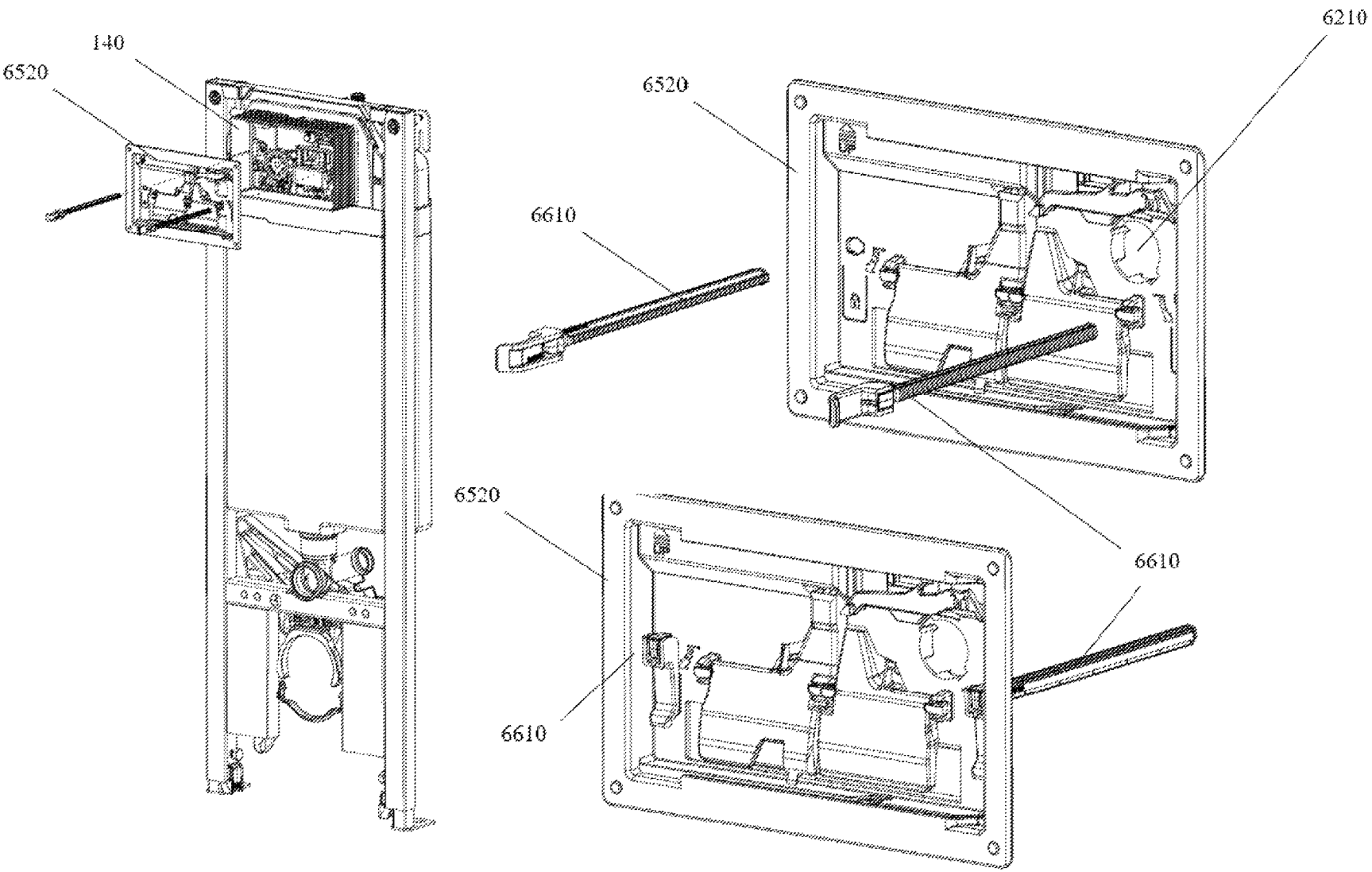
FIG. 66 illustrates how the actuation panel 6520 is configured to couple to the maintenance window 140 by inserting one or more panel fasteners 6610 through the actuation panel according to some embodiments.
Figure 67:
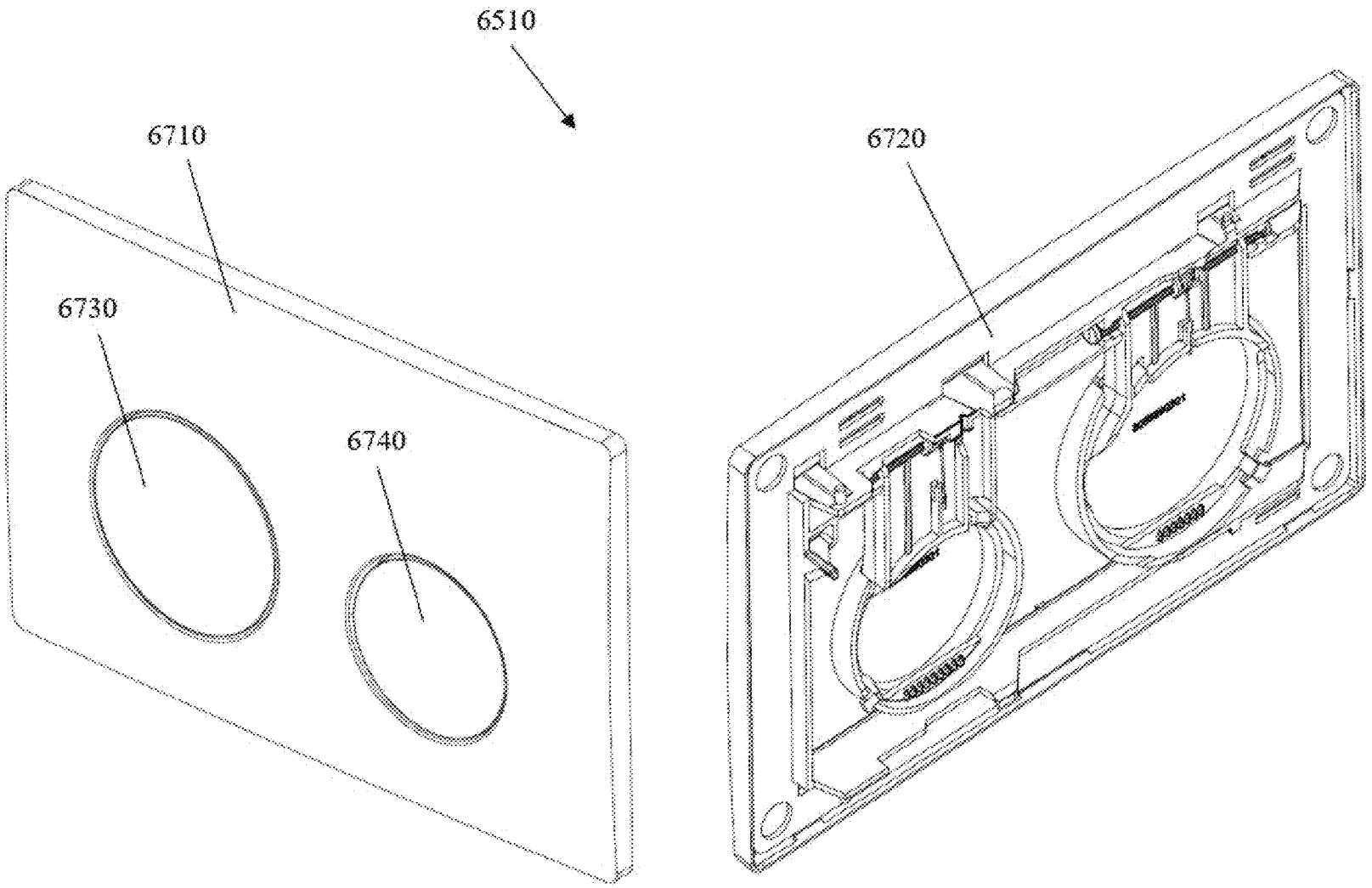
FIG. 67 shows a front side 6710 and a back side 6720 of the flush plate 6510. In some embodiments, the flush plate includes a full flush button 6730 and/or a partial flush button 6740.

FIG. 65 shows the cistern assembly 302 including a flush plate 6510 and an actuation panel 6520 according to some embodiments. In some embodiments, the flush plate 6510 is configured to couple to the actuation panel 6520 by snap fit as a non-limiting example. FIG. 66 illustrates how the actuation panel 6520 is configured to couple to the maintenance window 140 by inserting one or more panel fasteners 6610 through the actuation panel according to some embodiments. In some embodiments, the one or more panel fasteners 6610 engage one or more grooves inside the tank lid 3220 by rotating the panel fastener 6610 by 90°. FIG. 67 shows a front side 6710 and a back side 6720 of the flush plate 6510. In some embodiments, the flush plate includes a full flush button 6730 and/or a partial flush button 6740.

Figure 68:
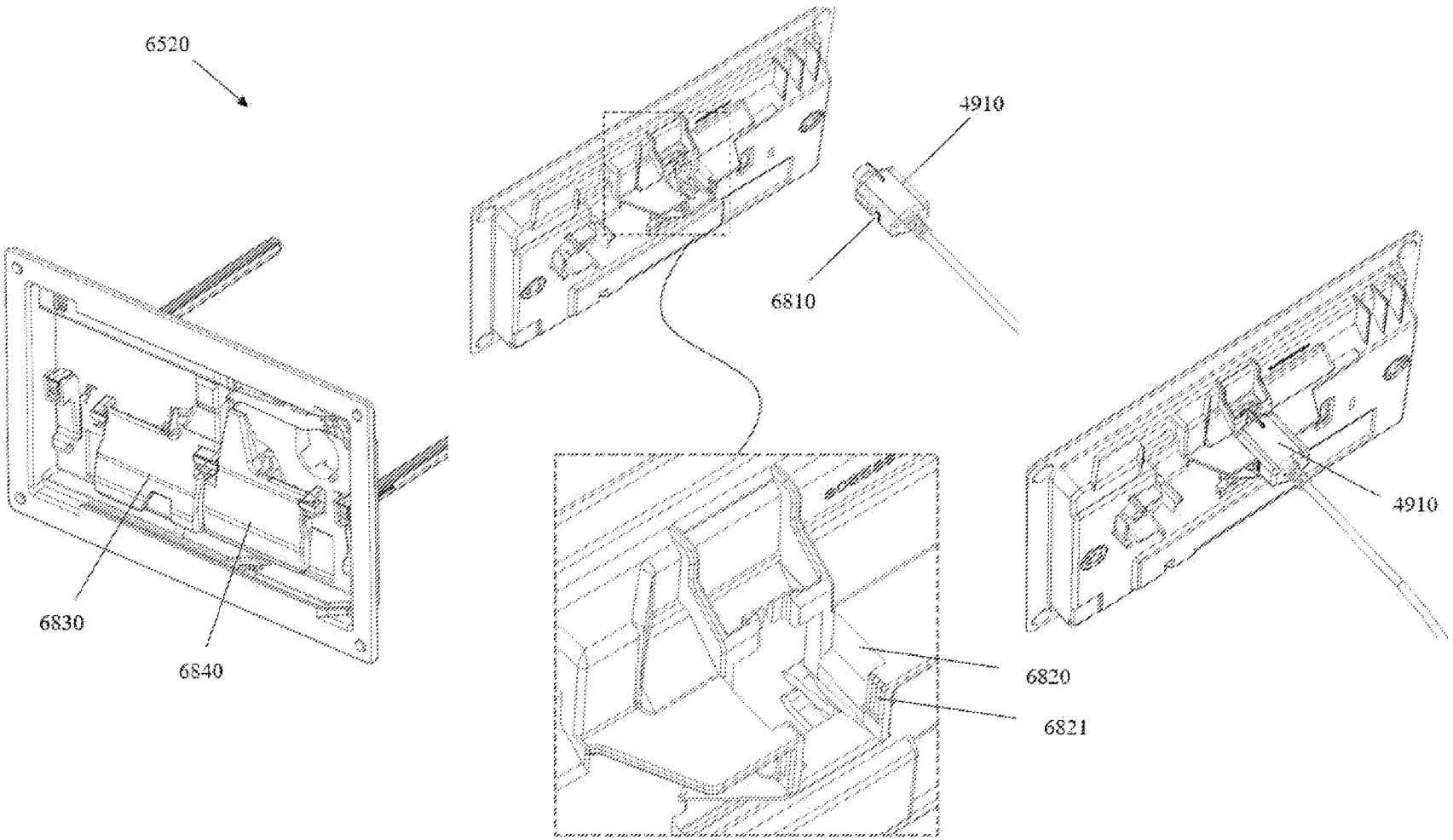
FIG. 68 depicts various views of the actuation panel 6520 according to some embodiments.

FIG. 68 depicts various views of the actuation panel 6520 according to some embodiments. In some embodiments, the actuation panel comprises a full flush actuator 6830 and/or a partial flush actuator 6840. In some embodiments, the cable assembly 4910 is configured to be actuated by the full flush actuator 6830, where the partial flush actuator 6840 is configured to move the full flush actuator 6830 approximately halfway. In some embodiments, the cable slot 6810 is configured to couple to a cable coupling 6820 comprising one or more coupling teeth 6821 that engage a position adjuster 6940 as further described herein.

Figure 69:
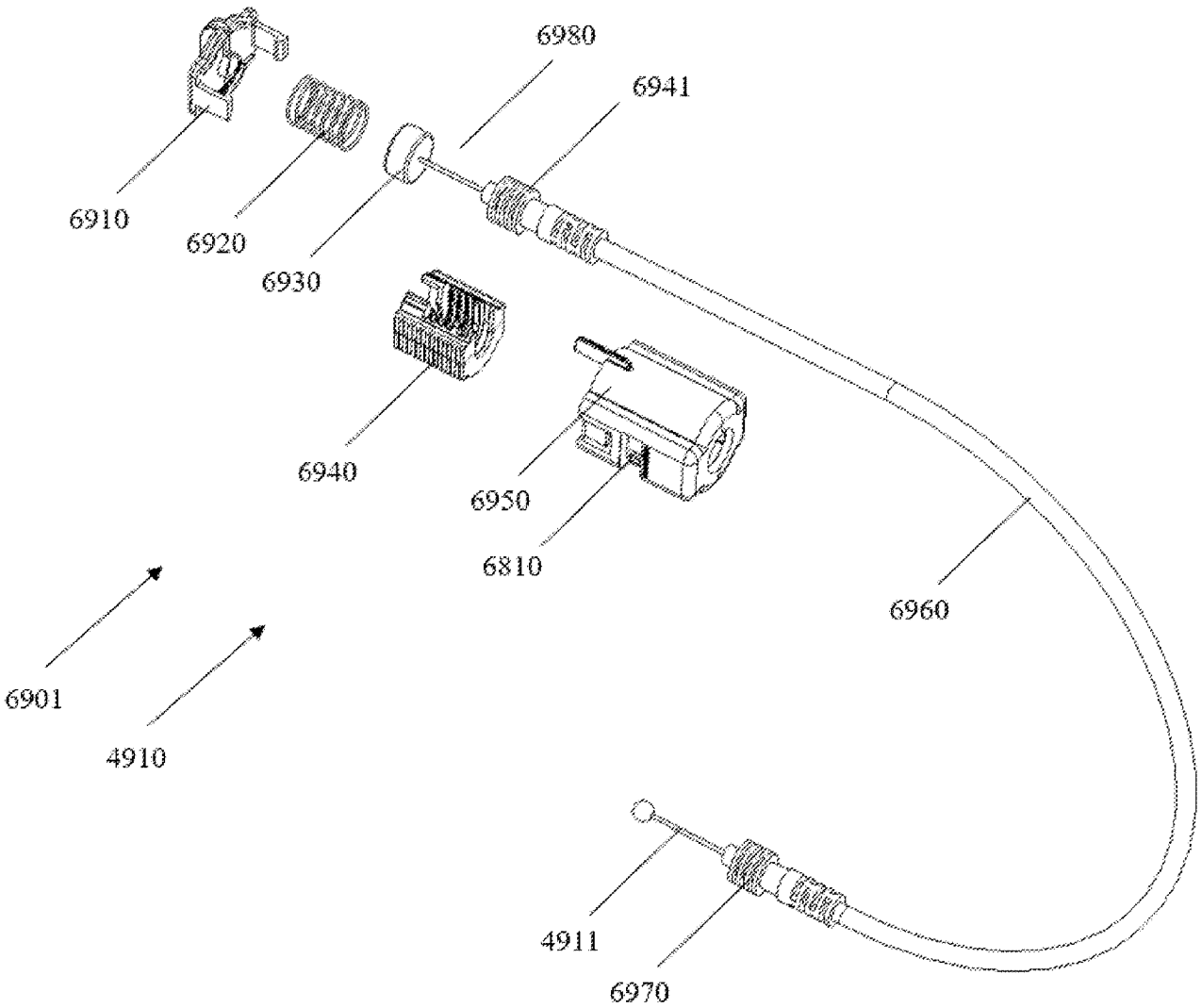
FIG. 69 shows an exploded view 6901 of the cable assembly 4910 according to some embodiments.

FIG. 69 shows an exploded view 6901 of the cable assembly 4910 according to some embodiments. In some embodiments, the cable assembly comprises one or more of a cable coupler cover 6910, a cable spring 6920, a cable coupler 6930, a position adjuster 6940, an adjuster housing 6950, a coupling slot 6810, a cable sheath 6960, a fork coupling 6970, and an activation cable 4911.

Figure 70:
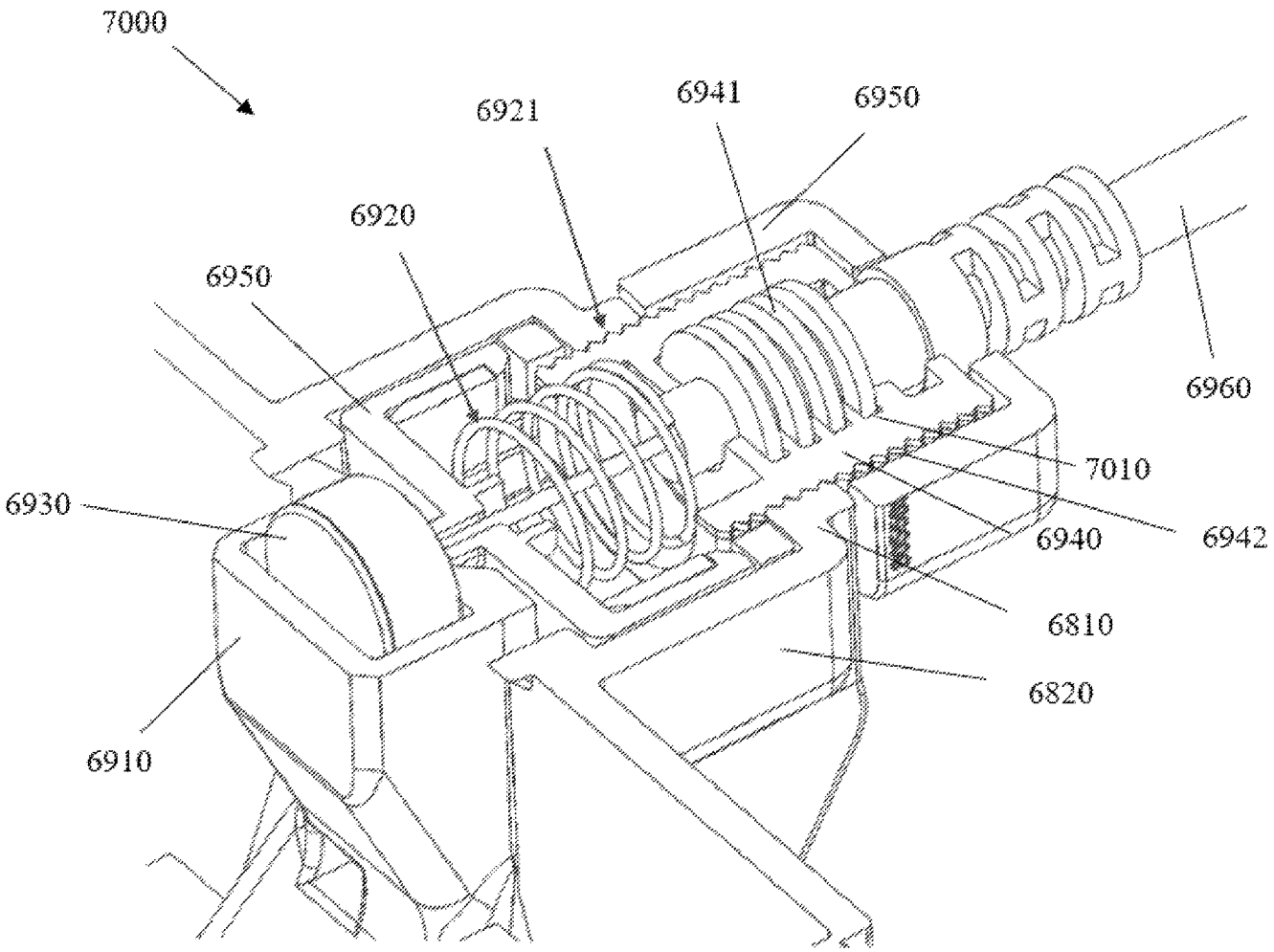
FIG. 70 illustrates the cable assembly 4910 coupled to the cable coupling 6820 in an assembled view 7000 according to some embodiments.

FIG. 70 illustrates the cable assembly 4910 coupled to the cable coupler interface 6820 in an assembled view 7000 according to some embodiments. In some embodiments, before the adjuster housing 6950 is placed into the cable coupler interface 6820, adjustments can be made to compensate for any production tolerance to ensure the flush fork 5150 remains in constant contact with the vacuum cap 4010. In some embodiments, the adjuster housing 6950 is configured to enable the position adjuster 6940 to axially slide along its interior. In some embodiments, the position adjuster 6940 is configured to couple the positioner coupling 6941 by engaging one or more slots 7010 inside the position adjuster 6940. In some embodiments, this in turn locks the cable sheath 6960 to the position adjuster 6940. In some embodiments, due to variation in manufacturing tolerances, a distance 6980 between the cable coupler 6930 and the positioner coupling 6941 may be too long or too short to properly engage the cable coupler interface 6820. However, in some embodiments, the sliding action of the position adjuster 6940 enables the positioner coupling 6941 to move backward or forward such that when it is in the correct alignment, the adjuster housing 6950 can be inserted into the cable coupler interface 6820. In some embodiments, once inserted, one or more position teeth 6942 on the position adjuster 6940 engage with one or more coupling teeth 6821 and lock the cable sheath 6960 into position.

Figure 71:
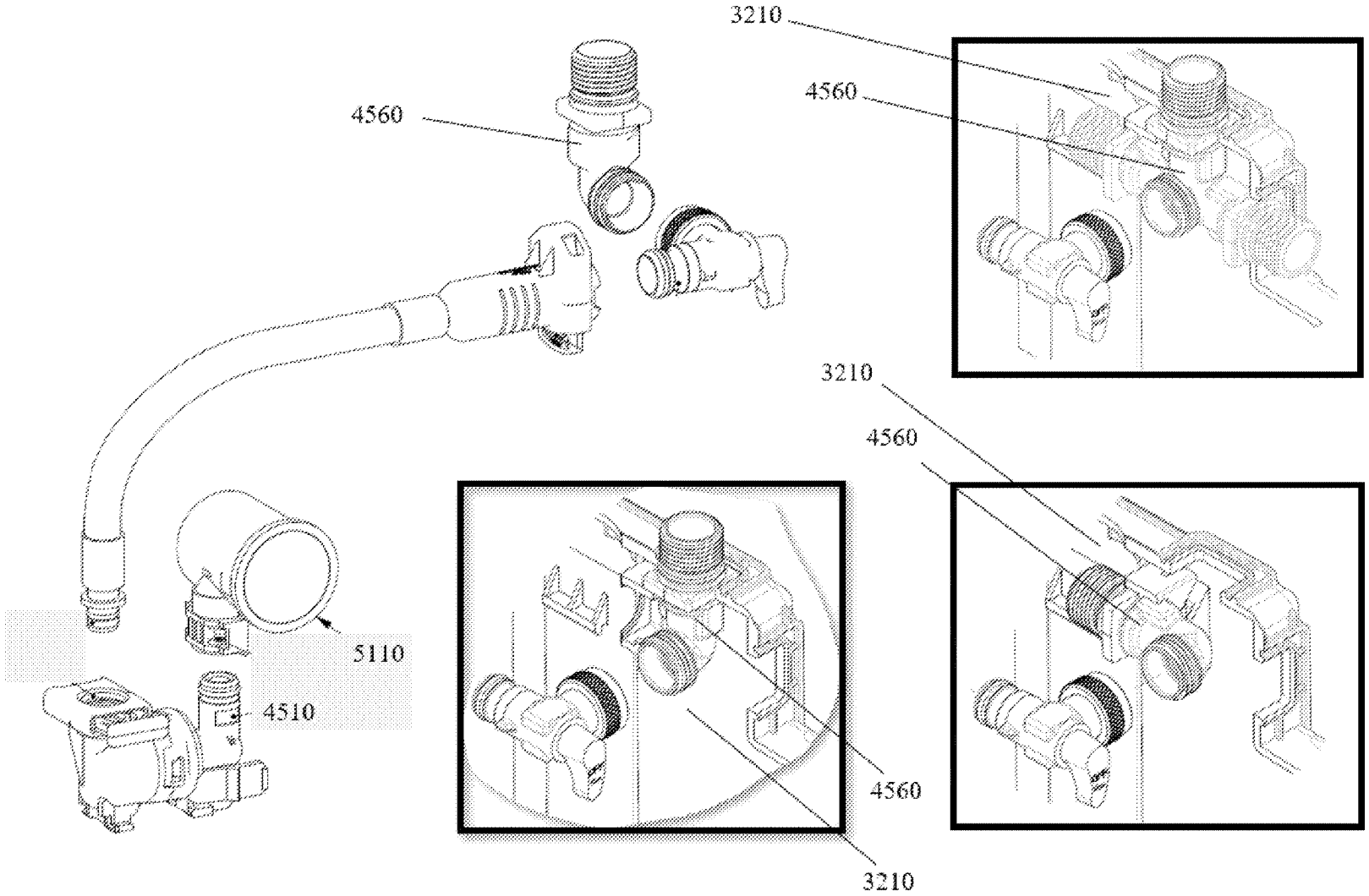
FIG. 71 shows the fill valve assembly 5110 connecting to the manifold 4510, as well as various installation angles for the inlet shank 4560 to connect to the tank 3210 according to some embodiments.

FIG. 71 shows the fill valve assembly 5110 connecting to the manifold 4510, as well as various installation angles for the inlet shank 4560 to connect to the tank 3210 according to some embodiments.

Figure 72:
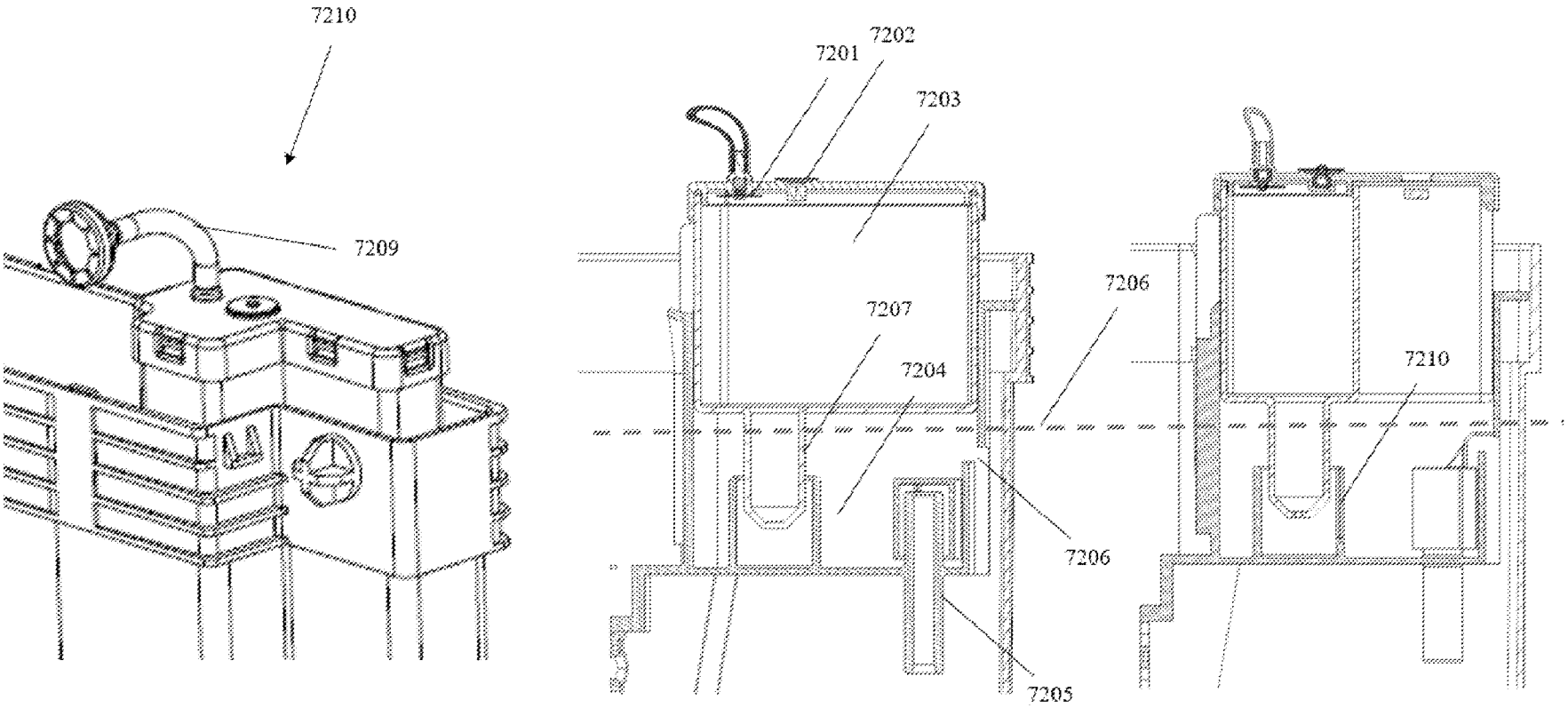
FIG. 72 illustrates a cleaning module system 7210 according to some embodiments.

FIG. 72 illustrates a cleaning module system 7210 according to some embodiments. In some embodiments, the cleaning module system 7210 is configured to be used with or without the dosing assembly 6201. In some embodiments, the cleaning module system 7210 is configured to automatically supply a controlled dose of cleaning chemicals to a toilet system for cleaning purposes, using the available energy from fluid fall and rise in the tank 3210. In some embodiments, cleaning module system 7210 is configured to meter cleaning solution such as a surfactant at a set rate to a toilet reservoir to provide a diluted solution for cleaning purposes.

In some embodiments, a refill funnel 7209 is used as an interface to enable the filling of cleaning liquid from an external container to the dispenser reservoir 7203. In some embodiments, check valve 7201 will open inward to allow for cleaning liquid to flow inside the reservoir 7203 while check valve 7202 will also open outward to allow air inside the reservoir 7203 to be vented. In some embodiments, the cleaning module system 7210 is configured to enable liquid from the reservoir 7203 to drip down through the adjustable dosing nozzle 7207 under gravity force and stop until the reservoir 7210 in the bottom housing 7204 is full. In some embodiments, when the toilet tank is filling up, fluid level in the tank will reach the tank water level 7206 and then overflow in and flood the bottom housing 7204 through an opening 7206 on the side wall of the housing 7204.

In some embodiments, the fresh fluid will mix with the concentration solution in the reservoir 7210. In some embodiments, when the tank level drops below the siphon device 7205 due to a flush, a siphon action will start to siphon out all the mixed solution inside the bottom housing 7204. In some embodiments, the rest of the liquid inside the reservoir 7210 will be drained out through a small bleed hole at its side wall. In some embodiments, the concentration liquid from the reservoir 7203 then starts to drip down and refill the small reservoir 7210 in the bottom housing 7204 again. In some embodiments, the same cycle repeats when the tank water is refilled back to the tank water level 7206.

In some embodiments, the cleaning module system 7210 includes indicator configured to enable a user to monitor the liquid inside the reservoir 7203 during filling and usage. In some embodiments, a simple floating stick is used inside an enclosed structure extended from the top wall of the reservoir 7203 that will indicate its position corresponding to the liquid level. In some embodiments, cleaning module system 7210 provides the advantage of needing no extra power for precision dosing.

Figure 73:
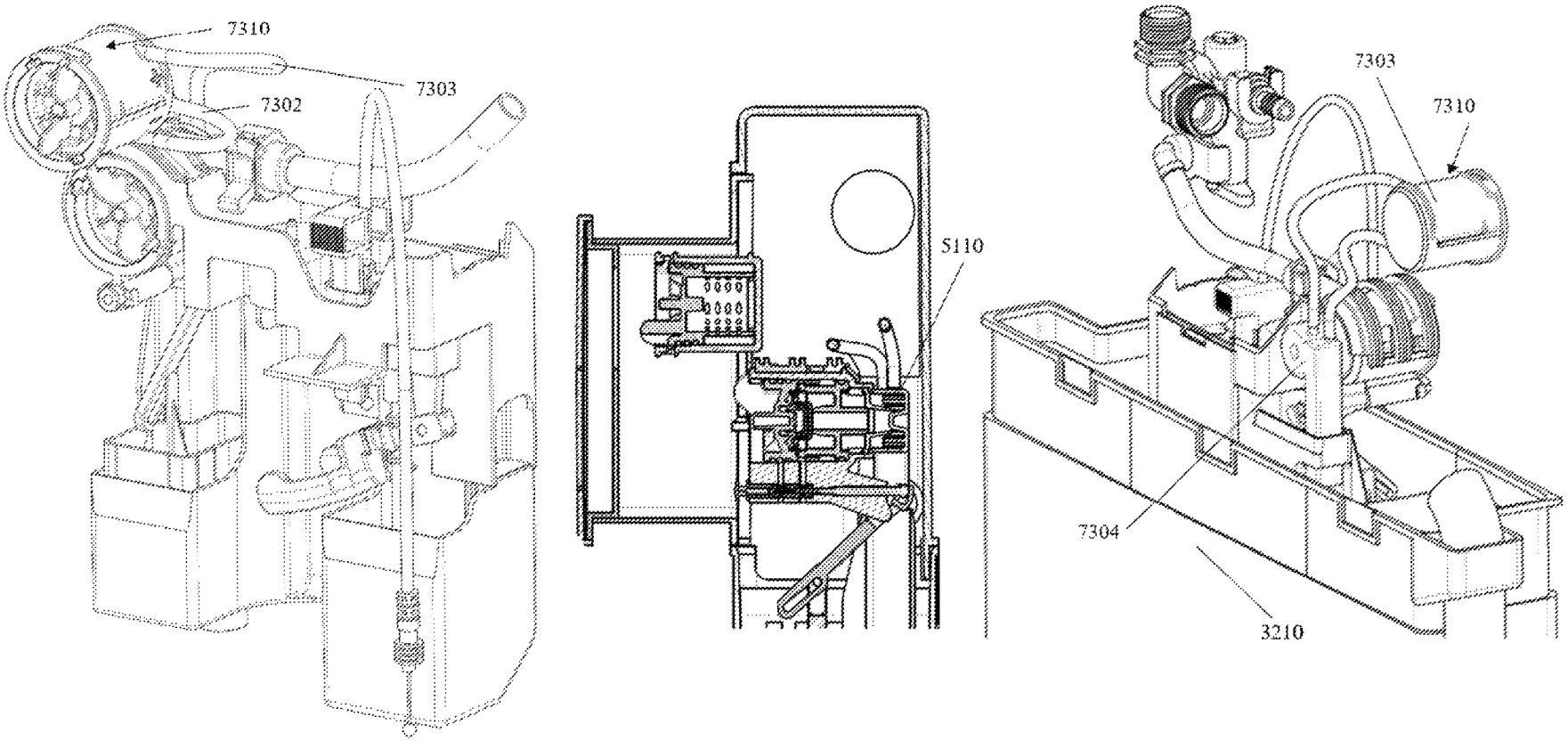
FIG. 73 shows a cleaning module system 7310 configured to work with dry cleaning tablet according to some embodiments.

FIG. 73 shows a cleaning module system 7310 configured to work with dry cleaning tablet according to some embodiments. In some embodiments, the cleaning module system 7310 utilizes a fluid supply tapped from the outlet of the fill valve assembly 5110 to dissolve the tablet into the cartridge housing 7303. In some embodiments, the drain tube 7302 is configured to use a vacuum generated from fluid flow out of the fill valve outlet 7304 due to a venturi effect to suck all diluted solution inside the cartridge housing 7303 back to the fill valve outlet which is then dispersed into the tank 3210. In some embodiments, this helps to keep the cleaning tablet dry for longevity purposes.

Figure 74:
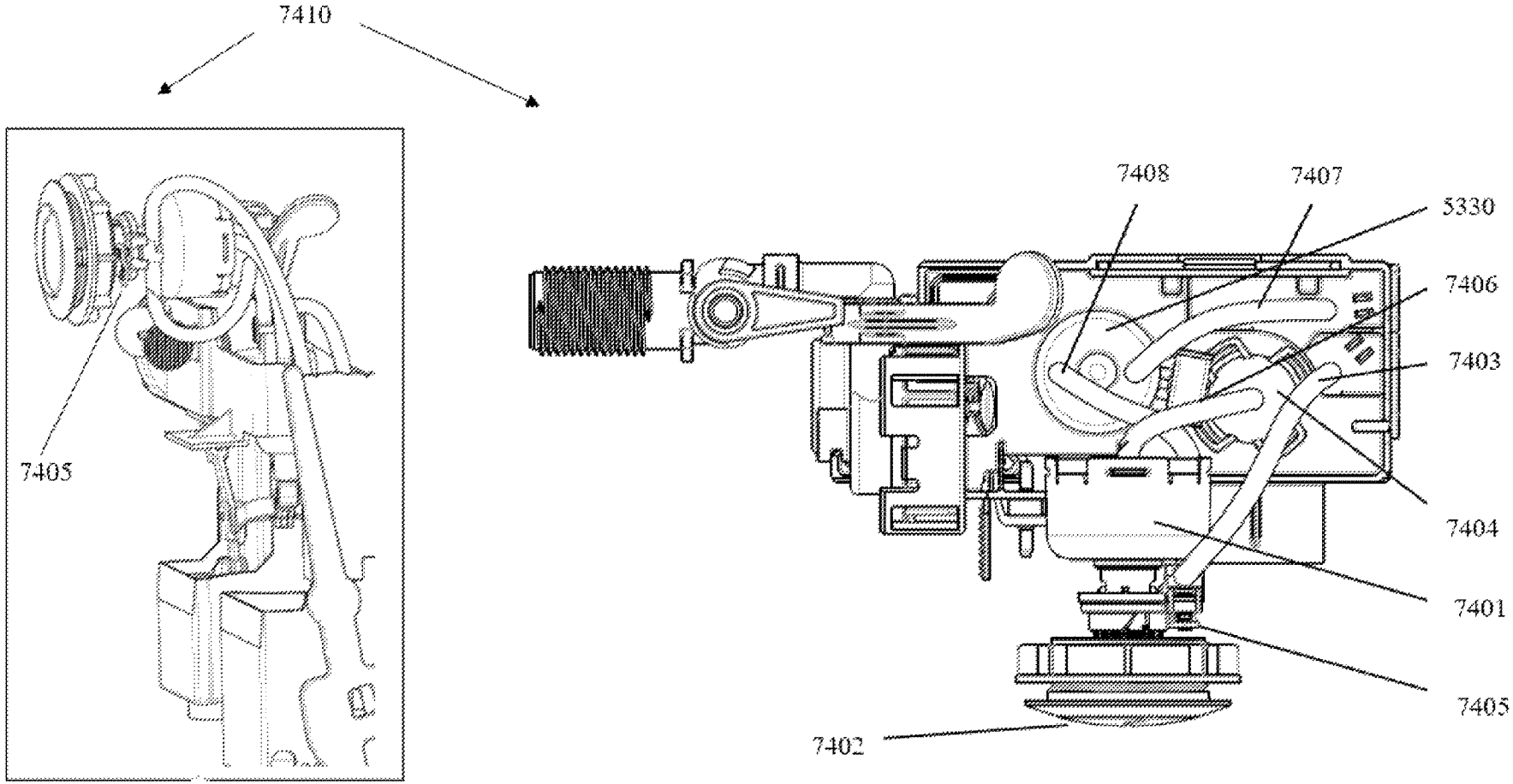
FIG. 74 shows some embodiments of the system 100, in which a pneumatic activation mechanism 7410 is used as an actuation device according to some embodiments.

FIG. 74 shows some embodiments of the system 100, in which a pneumatic activation mechanism 7410 is used as an actuation device according to some embodiments. In some embodiments, the pneumatic activation mechanism 7410 includes a driving piston 7401 mounted on a housing, interfaced and driven by two buttons 7402 installed in the housing, where one button is for a full flush and the other for a partial flush.

In some embodiments, a flexible hose 7406 is connects the driving piston 7401 to a slave piston 7204 mounted on top of the flush valve assembly 3420, which is used to drive the flush fork 5150. In some embodiments, a diverter valve 7405 interfaces with both buttons 7402 and is mounted on the same housing. In some embodiments, the buttons 7204 have a cam on the surface that interfaces with the diverter valve 7405 so that when activated can toggle the diverter valve 7405 to switch from controlling a full flush to a partial flush and vice versa. In some embodiments, the hose 7408 is connected to the vacuum cap housing 5330.

In some embodiments, another hose 7403 is used to connect the diverter valve back to an air valve of one level sensor mounted inside a vacuum manifold for the communication among the vacuum chamber, diverter valve and level sensor. In some embodiments, another hose 7407 is used to connect the vacuum cap housing 5330 to the air valve of another level sensor mounted inside the vacuum manifold. In some embodiments, the way the level sensors of this embodiment work will be similar to the sensor of the previous embodiment shown in FIGS. 53-55.

Figure 75:
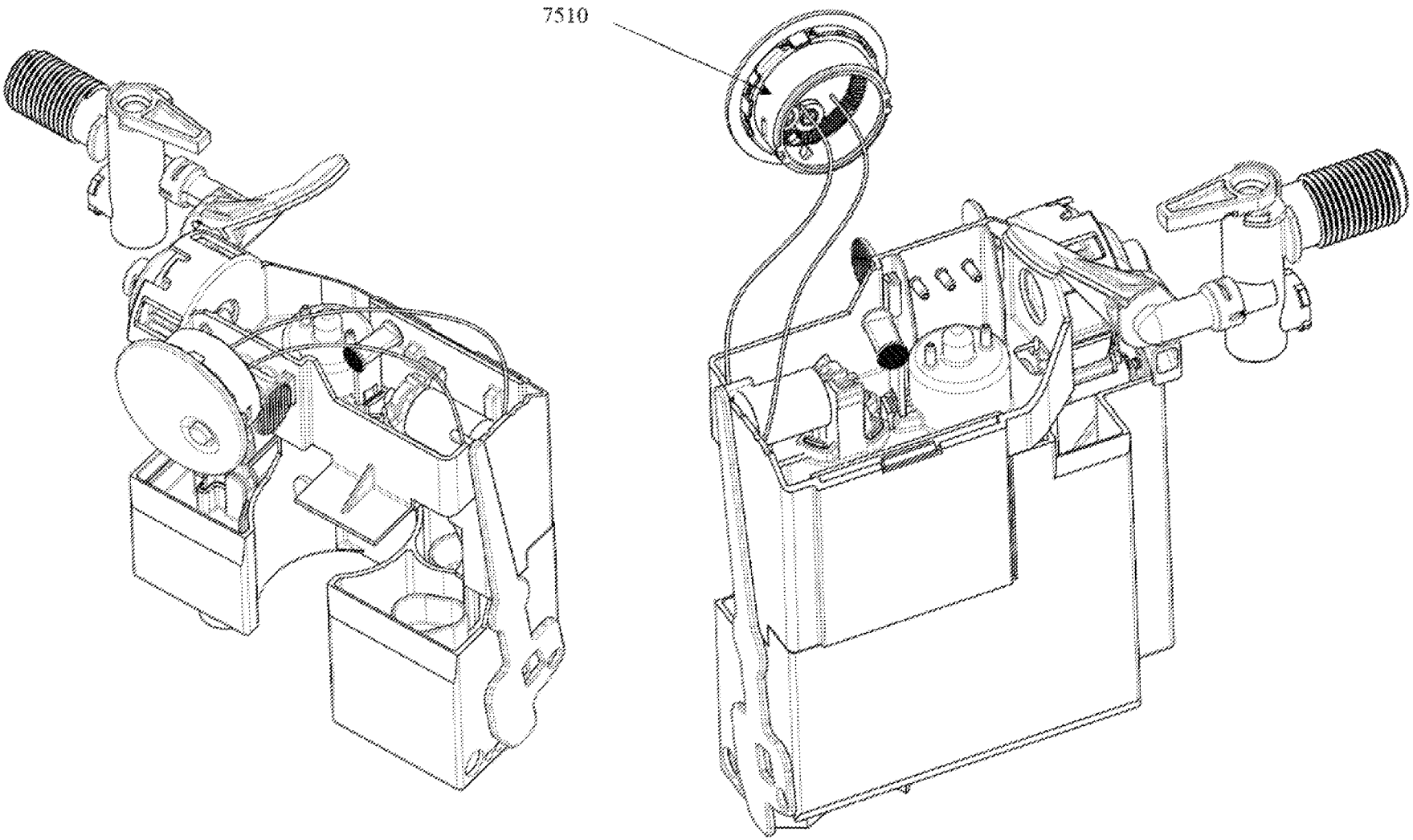
FIG. 75 shows electronically controlled activation mechanism 7510 configured to send signal commands from an end user activator to the flush fork 5150 to open and close the flush tube 3430 to control flush volumes of the system 100 according to some embodiments.

FIG. 75 shows electronically controlled activation mechanism 7510 configured to send signal commands from an end user activator to the flush fork 5150 to open and close the flush tube 3430 to control flush volumes of the system 100. In some embodiments, water level sensors described previously control the opening duration of the flush tube 3430. In some embodiments, the opening duration of the flush tube 3430 can be controlled directly by a linear actuator and/or motor with rack and pinion activating the flush fork 5150 according to some embodiments.

Figure 76:
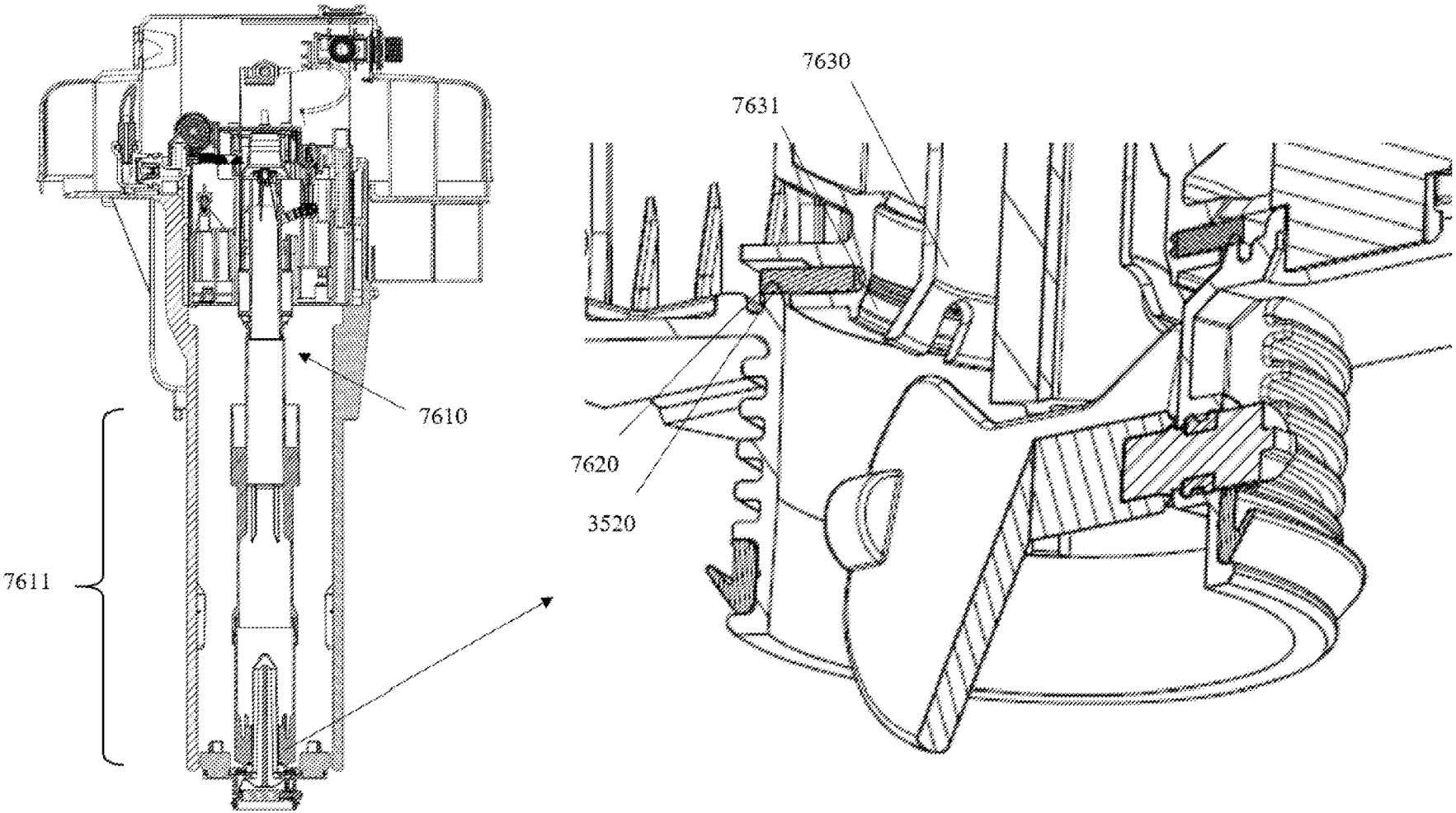
FIG. 76 illustrates another arrangement of a flush tube 7610 according to some embodiments. In some embodiments, the flush tube 7610 is similar to flush tube 3430 in operation and construction except for a bottom portion 7611.
Figure 79:
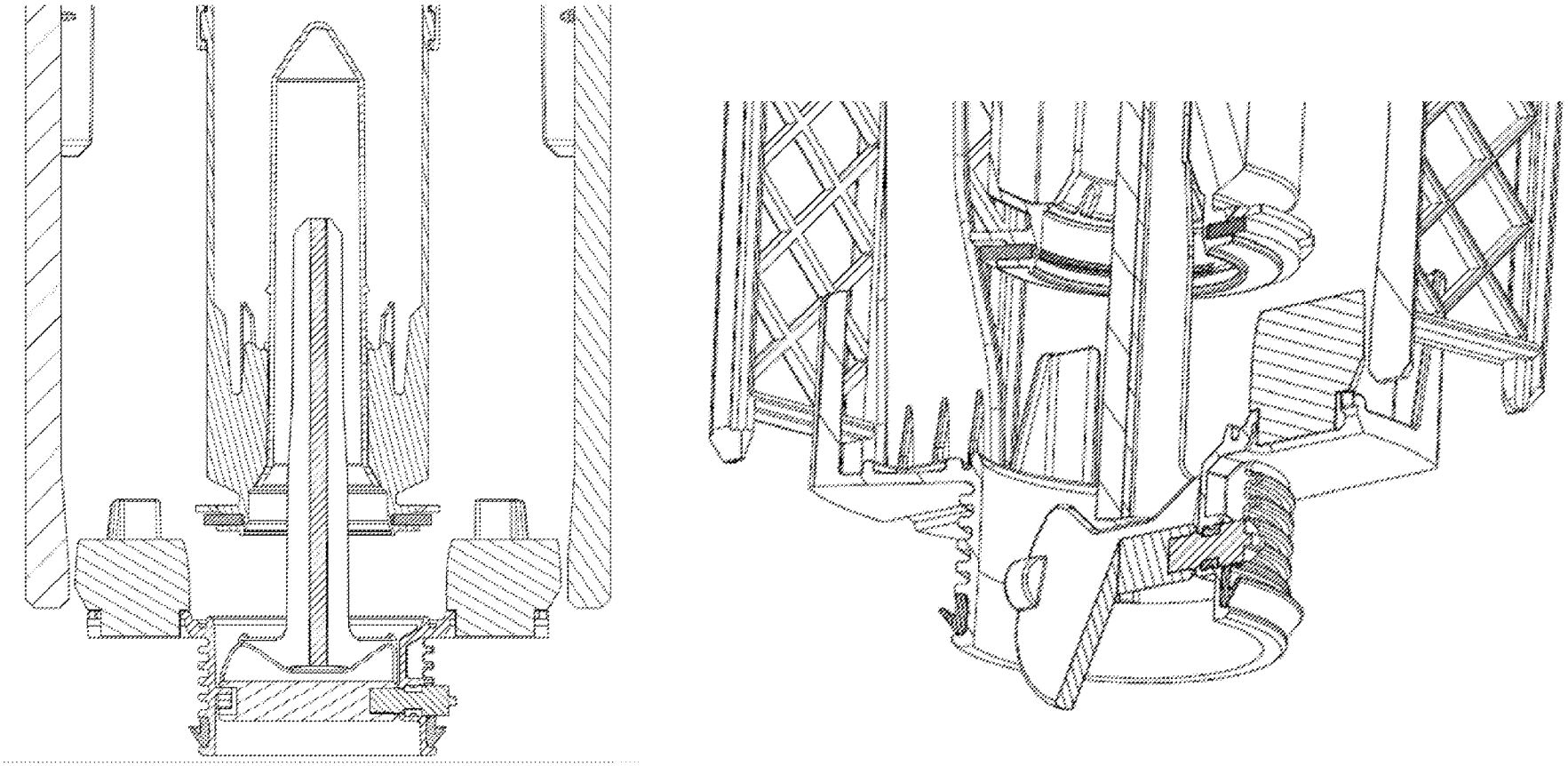
FIG. 79 shows the bottom portion 7611 in its fully open position according to some embodiments.

FIG. 76 illustrates another arrangement of a flush tube 7610 according to some embodiments. In some embodiments, the flush tube 7610 is similar to flush tube 3430 in operation and construction except for a bottom portion 7611 according to some embodiments. In some embodiments, before a flushing operation, the flush tube seal 7620 is seated on the valve seat 3520. In some embodiments, a check valve 7630 is in an open position 7631 which enables any overflow to pass therethrough. FIG. 77 shows an initial break of the seal between the flush tube seal 7620 and the valve seat 3520 according to some embodiments. In some embodiments, at this time the check valve 7630 is still in an open position 7631 as it is still exposed to atmosphere from the tank outlet 3250. FIG. 78 shows a flush tube 7610 stage where water now fills underneath the flush tube driving the check valve 7630 up to create a seal 7831 with the flush housing 7840 to prevent unmetered flow into the flush housing according to some embodiments. In some embodiments, at this time, one or more fill slots 7850 enable fluid to start to fill the inside 7860 of the flush housing 7840 in a metered fashion reducing the buoyancy effect of the housing slowly during the flushing operation to assist in the subsequent seating by adding weight after the flushing operation is complete. FIG. 79 shows the bottom portion 7611 in its fully open position according to some embodiments.

Figure 80:
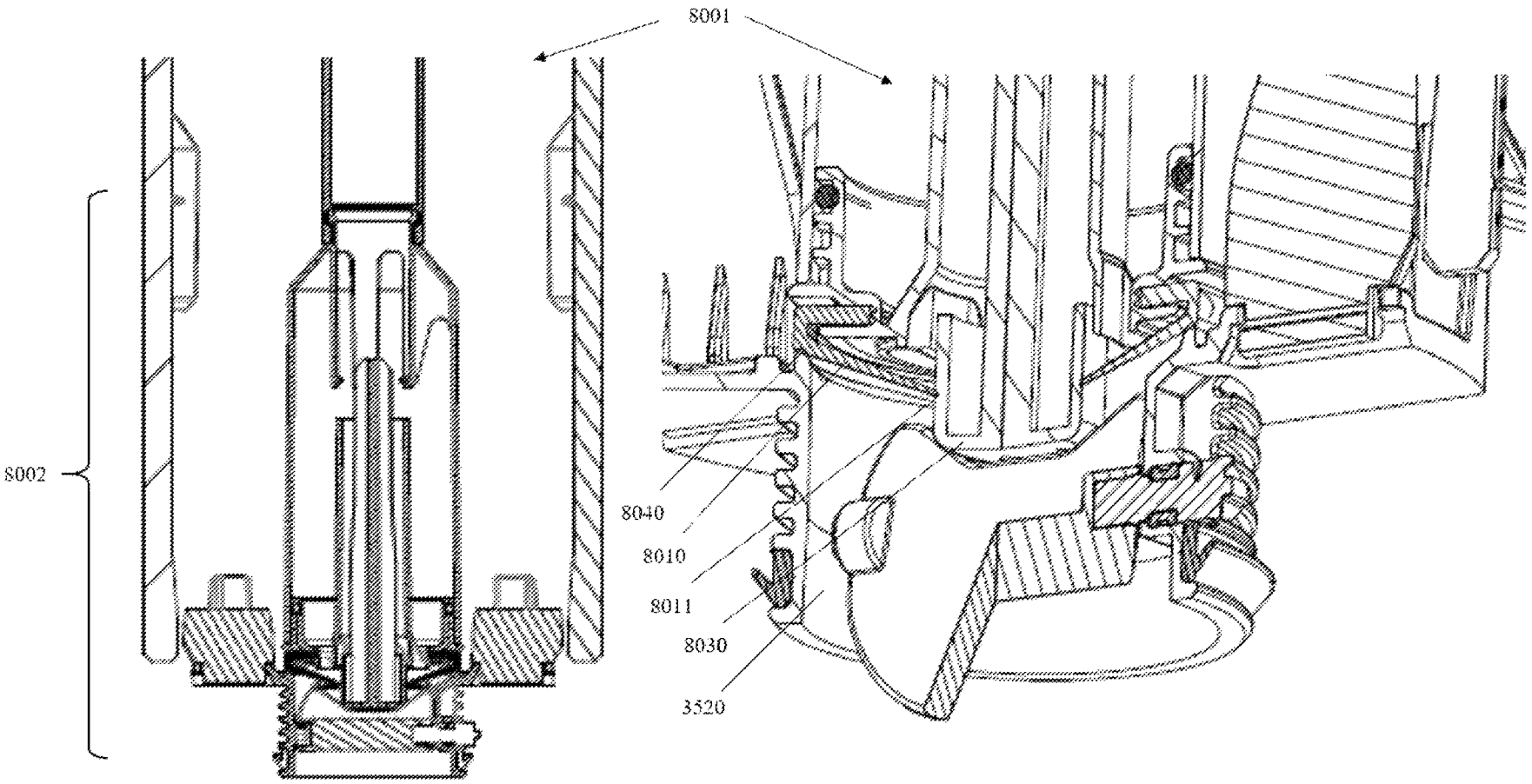
FIG. 80 shows another an alternate configuration for a bottom portion 8002 of a flush tube 8001 according to some embodiments.

FIG. 80 shows another an alternate configuration for a bottom portion 8002 of a flush tube 8001 according to some embodiments. In some embodiments, the flush tube 8010 comprises a flexible check valve 8010 configured to seal 8011 against a tube guide 8030 coupled to the fill valve seat 3520. In some embodiments, the flexible check valve 8010 is configured to enable overflow to drain therethrough by yielding to the weight of the fluid as the other side is only exposed to atmosphere. In some embodiments, a seat seal portion 8040 is configured to seal against the valve seat 3520 before a flushing operation has started.

Figure 81:
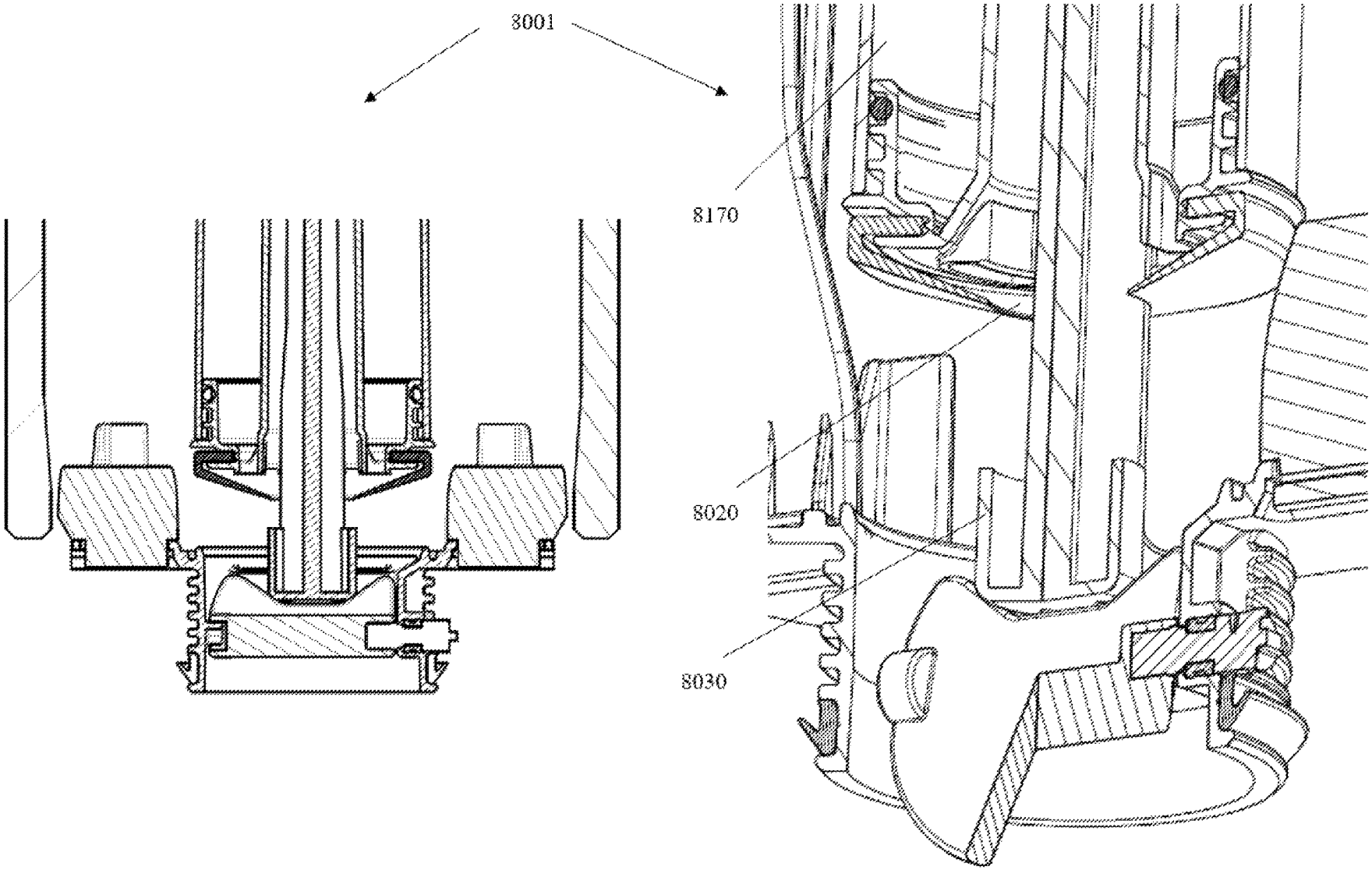
FIG. 81 shows the flush tube 8001 during a flushing operation according to some embodiments.

FIG. 81 shows the flush tube 8001 during a flushing operation according to some embodiments. In some embodiments, the flexible check valve 8010 enables fluid to enter the flush cover 8170 through the opening 8120 created by the separation from the tube guide 8030, adding weight for a seating operation as previously described.

Figure 82:
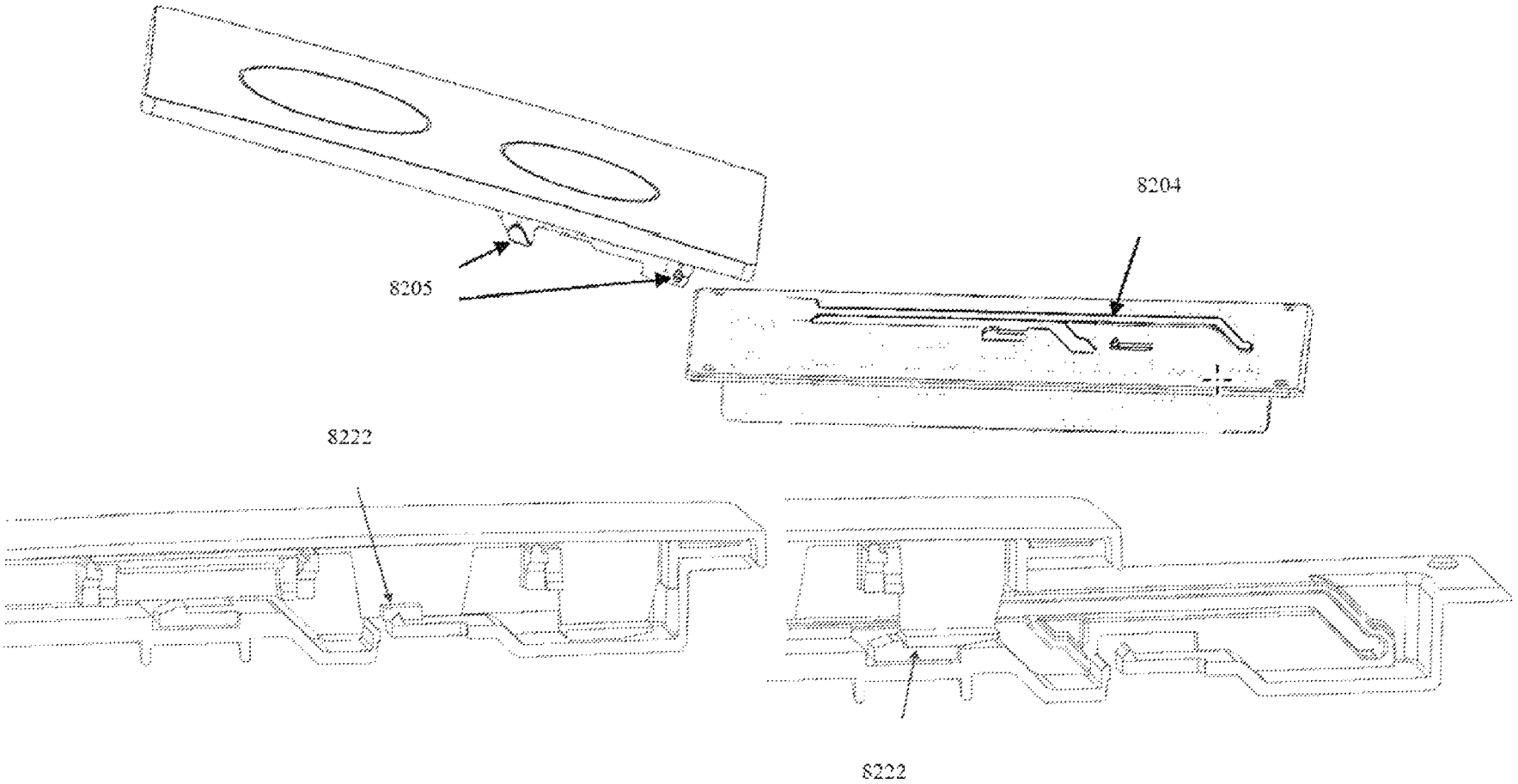
FIG. 82 shows feature of a Some embodiments provide a sliding control plate (1) design for a flush plate 6510 using a fixed base plate 8202 and a removable face plate 8203 using a rail system according to some embodiments.

FIG. 82 shows feature of a Some embodiments provide a sliding control plate (1) design for a flush plate 6510 using a fixed base plate 8202 and a removable face plate 8203 using a rail system where the rail 8204 is part of the base plate and the slide 8205 is part of the face plate to allow for an intuitive, one hand, tool-free, opening of the flush plate 6510 to the maintenance window 140 according to some embodiments. After access, in some embodiments, the panel can be closed by sliding it into the lock 8222. Some embodiments provide the ability to remove the entire faceplate through a resistance feature or through a hidden locking feature connected to the slide or through a locking feature housed in the actuation panel 6520.

The subject matter described herein are directed to technological improvements to the field of cistern installation and maintenance by providing a compact system where all components and adjustment mechanisms can be accessed through a single maintenance window. Indeed, the systems and methods described herein were unknown and/or not present in the public domain at the time of filing, and they provide technologic improvements advantages not known in the prior art. Furthermore, the system includes unconventional steps that confine the claim to a useful application.

It is understood that the system is not limited in its application to the details of construction and the arrangement of components set forth in the previous description or illustrated in the drawings. The system and methods disclosed herein fall within the scope of numerous embodiments. The previous discussion is presented to enable a person skilled in the art to make and use embodiments of the system. Any portion of the structures and/or principles included in some embodiments can be applied to any and/or all embodiments: it is understood that features from some embodiments presented herein are combinable with other features according to some other embodiments. Thus, some embodiments of the system are not intended to be limited to what is illustrated but are to be accorded the widest scope consistent with all principles and features disclosed herein.

Some embodiments of the system are presented with specific values and/or setpoints. These values and setpoints are not intended to be limiting and are merely examples of a higher configuration versus a lower configuration and are intended as an aid for those of ordinary skill to make and use the system.

Any text in the drawings is part of the system's disclosure and is understood to be readily incorporable into any description of the metes and bounds of the system. Any functional language in the drawings is a reference to the system being configured to perform the recited function, and structures shown or described in the drawings are to be considered as the system comprising the structures recited therein. It is understood that defining the metes and bounds of the system using a description of images in the drawing during patent prosecution does not need a corresponding text description in the written specification to fall with the scope of the disclosure.

Furthermore, acting as Applicant's own lexicographer, Applicant imparts the explicit meaning and/or disavow of claim scope to the following terms:

Applicant defines any use of "and/or" such as, for example, "A and/or B," or "at least one of A and/or B" to mean element A alone, element B alone, or elements A and B together. In addition, a recitation of "at least one of A, B, and C," a recitation of "at least one of A, B, or C," or a recitation of "at least one of A, B, or C or any combination thereof" are each defined to mean element A alone, element B alone, element C alone, or any combination of elements A, B and C, such as AB, AC, BC, or ABC, for example.

"Substantially" and "approximately" when used in conjunction with a value encompass a difference of 5% or less of the same unit and/or scale of that being measured.

As used herein, "can" or "may" or derivations there of (e.g., the system display can show X) are used for descriptive purposes only and is understood to be synonymous and/or interchangeable with "configured to" (e.g., the computer is configured to execute instructions X) when defining the metes and bounds of the system.

In addition, the term "configured to" means that the limitations recited in the specification and/or the claims must be arranged in such a way to perform the recited function: "configured to" excludes structures in the art that are "capable of" being modified to perform the recited function but the disclosures associated with the art have no explicit teachings to do so. For example, a recitation of a "container configured to receive a fluid from structure X at an upper portion and deliver fluid from a lower portion to structure Y" is limited to systems where structure X, structure Y, and the container are all disclosed as arranged to perform the recited function. The recitation "configured to" excludes elements that may be "capable of" performing the recited function simply by virtue of their construction but associated disclosures (or lack thereof) provide no teachings to make such a modification to meet the functional limitations between all structures recited. The recitation "configured to" can also be interpreted as synonymous with operatively connected when used in conjunction with physical structures.

It is understood that the phraseology and terminology used herein is for description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The previous detailed description is to be read with reference to the figures, in which like elements in different figures have like reference numerals. The figures, which are not necessarily to scale, depict some embodiments and are not intended to limit the scope of embodiments of the system.

Although method operations are presented in a specific order according to some embodiments, the execution of those steps do not necessarily occur in the order listed unless explicitly specified. Also, other housekeeping operations can be performed in between operations, operations can be adjusted so that they occur at slightly different times, and/or operations can be distributed in a system which allows the occurrence of the operations at various intervals as long as the processing of the operations result in the desired system output.

It will be appreciated by those skilled in the art that while the invention has been described above in connection with some embodiments and examples, the system is not necessarily so limited, and that numerous other embodiments, examples, uses, modifications and departures from some embodiments, examples, and uses are intended to be encompassed by the claims attached hereto. The entire disclosure of each patent and publication cited herein is incorporated by reference, as if each such patent or publication were individually incorporated by reference herein. Various features and advantages of the system are set forth in the following claims.

We claim:

1. A cistern system comprising:

a frame, a cistern assembly, and a discharge assembly;

wherein the cistern assembly and the discharge assembly are coupled to the frame;

wherein the discharge assembly is configured to couple to a toilet;

wherein the cistern assembly is configured to couple to the discharge assembly;

wherein the cistern assembly comprises one or more adjustable components;

wherein the cistern assembly comprises a maintenance window; and wherein the maintenance window is configured to enable an adjustment of at least a portion of each of the one or more adjustable components.

2. The cistern system of claim 1, wherein the cistern assembly comprises a flush valve assembly, a fill valve assembly, a fluid supply assembly, an actuation assembly, and a flowrate valve.

3. The cistern system of claim 2, wherein the cistern system is configured to enable at least a portion of the flush valve assembly, the fill valve assembly, the fluid supply assembly, the actuation assembly, and the flowrate valve are visible through the maintenance window.

4. The cistern system of claim 2, wherein the one or more adjustable components comprise a flush timer at least partially housed within the flush valve assembly;

wherein the flush timer comprises a timing knob;

wherein the timing knob is configured to control the release of a flush tube from the flush valve assembly;

wherein the flush tube is configured to seat against the flowrate valve to seal a tank outlet; and wherein the cistern system is configured to enable the timing knob to be visible when looking through the maintenance window along a horizontal axis.

5. The cistern system of claim 2, wherein the one or more adjustable components comprise a fill valve seal within the fill valve assembly;

wherein the fill valve assembly comprises a service cap configured to enable access and/or removal of the fill valve seal; and wherein the cistern system is configured to enable the service cap to be visible when looking through the maintenance window along a horizontal axis.

6. The cistern system of claim 2, wherein the one or more adjustable components comprise a flowrate valve adjuster coupled to the flowrate valve;

wherein the flowrate valve adjuster is configured to limit and/or increase a fluid flowrate through a tank outlet; and wherein the cistern system is configured to enable the flowrate valve adjuster to be visible when looking through the maintenance window along a horizontal axis.

7. The cistern system of claim 2, wherein the flush valve assembly is configured to be removed from the cistern assembly through the maintenance window.

8. The cistern system of claim 2, wherein the fill valve assembly is configured to be removed from the cistern assembly through the maintenance window.

9. The cistern system of claim 2, wherein the fluid supply assembly is configured to be removed from the cistern assembly through the maintenance window.

10. The cistern system of claim 2, wherein the actuation assembly is configured to be removed from the cistern assembly through the maintenance window.

11. The cistern system of claim 2, wherein the flowrate valve is configured to be removed from the cistern assembly through the maintenance window.

12. The cistern system of claim 2, further comprising a dosing assembly;

wherein at least a portion of the dosing assembly is configured to be removed from the cistern assembly through the maintenance window.

13. The cistern system of claim 4, wherein the flush tube is configured to be removed from the cistern assembly through the maintenance window.

14. The cistern system of claim 4, wherein the flowrate valve comprises a flexible handle accessible through the maintenance window; and wherein the cistern assembly comprises a fluid tank;

wherein the flowrate valve is configured to retrieve a component that has fallen to a bottom of the fluid tank by pulling at least a portion of the flexible handle through the maintenance window.

15. The cistern system of claim 14, wherein the cistern assembly comprises a fill member and a dosing member;

wherein the fill member comprises a fill support structure comprising one or more openings configured to enable fluid to flow laterally within the fluid tank at any fluid level;

wherein the dosing member comprises a dosing support structure comprising one or more openings configured to enable fluid to flow laterally within the fluid tank at any fluid level; and wherein the fill support structure and the dosing support structure are each configured to prevent the component that has fallen to the bottom of the tank from falling off the flowrate valve when the flexible handle is being pulled through the maintenance window.

* * * * *